US005797795A

United States Patent [19]

Takemoto et al.

[11] Patent Number: 5,797,795

[45] Date of Patent: Aug. 25, 1998

[54] GAMING FACILITIES FOR PLAYER TO PLAY GAME BY REMOTE OPERATION

[75] Inventors: Takatoshi Takemoto, Tokyo; Kazuo Tohge, Taito-ku, both of Japan

[73] Assignee: Kabushiki Kaisha Ace Denken, Tokyo, Japan

[21] Appl. No.: 737,856

[22] PCT Filed: May 10, 1995

[86] PCT No.: PCT/JP95/00891

§ 371 Date: Nov. 12, 1996

§ 102(e) Date: Nov. 12, 1996

[87] PCT Pub. No.: WO95/30463

PCT Pub. Date: Nov. 16, 1995

[30] Foreign Application Priority Data

May 10, 1994 [JP] Japan ..... 6-096511
Jan. 26, 1995 [JP] Japan ..... 7-010764

[51] Int. Cl.[6] ..... A63F 7/02

[52] U.S. Cl. ..... 463/42

[58] Field of Search ..... 463/39, 40, 41, 463/42, 47; 273/121 A, 121 B, 120 A

[56] References Cited

U.S. PATENT DOCUMENTS 5,388,828 2/1995 Takemoto et al. ..... 273/121 B
5,405,143 4/1995 Takemoto et al. ..... 273/121 B
5,496,032 3/1996 Okada ..... 463/25

FOREIGN PATENT DOCUMENTS 54-88431 7/1979 Japan .
63-21511 5/1988 Japan .
64-26094 2/1989 Japan .
2-5102 1/1990 Japan .
2-29350 6/1990 Japan .
4-263887 9/1992 Japan .
6-210068 8/1994 Japan .

*Primary Examiner*—George Manuel
*Attorney, Agent, or Firm*—Seed and Berry LLP

[57] ABSTRACT

Pinball equipment by which a player at a remote place can play pinball using a pinball machine. Indicated on a display device provided on a remote pinball terminal is an image of a pinball machine which is picked up by a video camera and transmitted through a public communication network from a pinball control device. Thus when a player operates an operating device provided on the remote pinball terminal, the details of the operation are transmitted through the public communication network to the pinball control device whereby pinballs are shot in the pinball machine in accordance with the details of the operation received by the pinball control device for start of playing. The state of playing on the pinball machine can be viewed at any time on the display device provided on the remote pinball terminal.

32 Claims, 39 Drawing Sheets

THANK YOU FOR USING OUR FACILITIES

YOU HAVE SPENT

YEN

WE WILL BE PAID THE AMOUNT FROM ACCOUNT OF

*Fig. 8A*

THANK YOU FOR USING OUR FACILITIES

YOU HAVE WON

YEN

WE WILL PAY THE AMOUNT INTO ACCOUNT OF

*Fig. 8B*

| | | | | |
|---|---|---|---|---|
| BIG WIN TABLE | A, A, A | B, B, B | ··· | P, P, P |
| LOSS TABLE | A, A, B | A, A, C | ··· | A, A, P |
| | A, B, A | A, B, B | ··· | A, B, P |
| | ⋮ | ⋮ | | ⋮ |
| | P, P, P | P, P, B | ··· | P, P, O |

Fig. 24A

GAMING MACHINE INFORMATION TABLE

| IDENTIFICATION NO. | TYPE | IDLE/ BUSY INFORMATION |
|---|---|---|
| 1 | | |
| 2 | | |
| ⋮ | ⋮ | ⋮ |
| m | | |

2401

Fig. 24B

PLAYER INFORMATION TABLE

| IDENTIFICATION NO. | PLAYER INFORMATION |
|---|---|
| ○○○−○○−○○○○ | |
| ×××−××××−×××× | |
| ⋮ | ⋮ |
| △△−△△△△−△△△△ | |

2402

Fig. 24C

GAME PLAY INFORMATION TABLE

| | |
|---|---|
| IDENTIFICATION NO. | ×××−××××−×××× |
| PLAYER INFORMATION | |
| IDENTIFICATION NO. | i |
| AMOUNT | |

2403

GAMING FACILITIES FOR PLAYER TO PLAY GAME BY REMOTE OPERATION

TECHNICAL FIELD

This invention relates to a pachinko (Japanese pinball) remote gaming system which enables players at distant locations to play pachinko machines.

TECHNICAL BACKGROUND

At present, pachinko halls having various types of pachinko machines enjoy brisk business.

An example of the current mainstream type of pachinko machine will be discussed.

FIG. 2 is a front view of a pachinko machine.

As shown in the figure, the pachinko machine has a gaming board 200 for providing a space required to move pachinko balls of game play media, a glass plate (not shown) spaced from the gaming board 200 at a given interval to cover the gaming board 200, and a propelling mechanism (not shown) for propelling pachinko balls in to the space sandwiched between the gaming board 200 and the glass plate. It is set up so that the gaming board 200 becomes substantially parallel to the vertical direction.

The pachinko machine is provided on the front with a propelling handle 201 for a player to propel pachinko balls and a return 202 for storing pachinko balls. The propelling handle 201 forms a part of the propelling mechanism. That is, as the player turns the propelling handle 201 by a desired angle, the pachinko balls stored in the return 202 are propelled one by one with the strength responsive to the turn angle.

A guide rail 203 is provided so as to surround the gaming board 200. It guides a pachinko ball propelled by the propelling handle 201 along the rail 203 to the upper position in the vertical direction of the gaming board 200.

The gaming board 200 is formed with winning parts 204, a special winning part 205, and a variable winning part 206 for the player to cause a pachinko ball to enter into for a winning game play, as a result of which the pachinko ball is discharged from the gaming board 200, and an out ball discharge part 207 into which pachinko balls not entered in to any of the winning parts 204, the special winning part 205, or the variable winning part 206 are finally collected for discharging the pachinko balls from the gaming board 200. When a pachinko ball enters the winning part 204, the special winning part 205, or the variable winning part 206, a predetermined number of pachinko balls are paid out to the return 202. When a special condition occurs, the variable winning part 206 changes to a state in which it enables the player to win a game, as described later.

A large number of obstacle pegs (not shown) with which pachinko balls dropping along the gaming board 200 frequently collide for causing their motion direction to fluctuate, are placed substantially vertical to the gaming board 200 in a state in which they project from the gaming board 200 as far as the diameter of the pachinko ball. The pachinko hall can finely adjust the inclination of the obstacle pegs for changing ease of entering a pachinko ball into the special winning part 205.

Further, the gaming board 200 is formed with a symbol display section 208 which operates when a pachinko ball enters the special winning part 205. When a pachinko ball enters the special winning part 205, the symbol display section 208 starts displaying different symbols in a plurality of display positions (here, three positions) so as to dynamically change the symbols displayed in the three display positions in sequence. When a predetermined time or the time found by random number calculation has elapsed, the symbol display section 208 stops the dynamic change display of the symbols in the three display positions at different timings.

The symbols displayed in the display positions when the symbol display section 208 stops the dynamic change display of the symbols is called "display symbols."

If a combination of the display symbols in the three display positions is a predetermined special combination, which will be hereinafter referred to as "big win combination," the variable winning part 206 changes to the win enable state in which it enables the player to win a game if a pachinko ball enters the part. More particularly, the variable winning part 206 has a lid, which is closed so as to be integral with the gaming board 200 at the normal time and is opened to provide a space to allow a pachinko ball to enter when the combination of the three display symbols becomes the big win combination. When a predetermined number of pachinko balls have entered the variable winning part 206 or a predetermined time has elapsed, the variable winning part 206 closes the lid.

The fact that the display symbol combination becomes the big win combination is called "big win."

Considering that a pachinko ball enters the special winning part 205 while the symbol display section 208 is operating, a maximum of four pachinko balls entering the special winning part 205 can be displayed as wins on a number-of-wins display section 209, ensuring the operation of the symbol display section 208.

The display positions in which the symbol display section 208 displays symbols can be provided by a display such as a plasma display or a liquid crystal display, and the symbol display section 208 produces dynamic change display of symbols in the display positions. A plurality of rotating drums on which different symbols are drawn may be provided for the symbol display section 208 to provide dynamic change display of the symbols by rotating the drums.

When starting to play a game, a player receives a number of pachinko balls proportional to inserted cash and loads the pachinko balls into the return 202. When the player turns the propelling handle 201 by a desired angle, the pachinko balls stored in the return are propelled one by one with the strength responsive to the turn angle and guided by the guide rail 203 to the upper position of the gaming board 200. On the gaming board 200, the pachinko balls start free falling and while falling, they collide with the obstacle pegs and change their passage irregularly.

When one of the pachinko balls enters the winning part 204 or the special winning part 205, a predetermined number of pachinko balls (for example, seven balls) are paid out to the return 202. Particularly, when a pachinko ball enters the special winning part 205, the symbol display section 208 starts dynamic change display of different symbols in the three display positions. When a predetermined time or the time found by random number calculation has elapsed, the symbol display section 208 stops the dynamic change display of the symbols in the three display positions at different timings.

Here, consider an example in which the symbol display section 208 produces dynamic change display of 16 symbols of A to P in each of the three display positions. Assume that the symbol display section 208 stops the dynamic change display of the symbols in the order of the first to third display positions. Also, assume that the big win combinations are 16 combinations of the same display symbols in the three display positions, like "AAA," "BBB,". . ., "PPP."

When the dynamic change display of the symbol in the second display position is stopped, if the display symbols in the first and second display positions match, this condition is called "close to winning" because there is a chance that the display symbols in the three display positions will match.

When the player comes close to winning and then the dynamic change display of the symbol in the third display position stops and the display symbols in the three display positions match, the player has a big win. Then, the variable winning part 206 opens the lid and changes to the win enable state. When a predetermined number of pachinko balls (for example, 10 balls) have entered the variable winning part 206 or a predetermined time (for example, 30 seconds) has elapsed, the variable winning part 206 closes the lid. A predetermined number of pachinko balls (for example, 15 balls) are paid out to the return 202 for each of the pachinko balls entering the variable winning part 206 between the instant when the variable winning part 206 opens the lid and the instant when closing the lid, namely, in one round.

A predetermined number of rounds (for example, 16 rounds) can be provided for one big win. The player may advance to the next round only when entering a pachinko ball in a special point in the variable winning part 206 in one round.

On the other hand, pachinko balls not entering any of the winning parts 204, the special winning part 205, or the variable winning part 206 fall into the out ball discharge part 207 and are collected by the pachinko hall.

Normally, a sound effect is produced from the pachinko machine to raise player's mood during the operation of the symbol display section 208. When the player comes close to winning, a sound effect different from the normal sound effect is produced to increase his or her expectations. When the player has a big win, a sound effect different from the normal sound effect or the sound effect produced when the player comes close to winning is produced to increase his or her pleasure.

Generally, the operation of the pachinko machine is carried out under the control of an internal controller.

The operation of the controller will be discussed with reference to FIG. 3.

Whenever a pachinko ball enters the special winning part 205, the controller performs the operation as shown in a flowchart in FIG. 3. That is, first the controller controls the symbol display section 208 so that the symbol display section 208 starts dynamic change display of symbols in the three display positions at step 301.

Subsequently, when a predetermined time or the time found by random number calculation has elapsed, the controller controls the symbol display section 208 so that the symbol display section 208 stops the dynamic change display of the symbol in the first display position at step 302. Likewise, when a predetermined time or the time found by random number calculation has elapsed, the controller controls the symbol display section 208 so that the symbol display section 208 stops the dynamic change display of the symbol in the second display position at step 303. If the display symbols in the first and second display positions match at this point in time, the player comes close to winning.

Likewise, when a predetermined time or the time found by random number calculation has elapsed, the controller controls the symbol display section 208 so that the symbol display section 208 stops the dynamic change display of the symbol in the third display position at step 304.

Subsequently, the controller determines whether or not the display symbols in the three display positions match at step 305. If they match, the player has a big win. Then, the controller controls the variable winning part 206 so that the variable winning part 206 opens the lid and changes to the win enable state at step 306. When a predetermined number of pachinko balls have entered the variable winning part 206 or a predetermined time has elapsed, the controller controls the variable winning part 206 so that the variable winning part 206 closes the lid and releases the win enable state at step 307.

The example pachinko machine is described in Japanese Patent Publication Nos. Sho 63-21511, Hei 2-5102, and Hei 2-29350.

The player can exchange remaining pachinko balls for various prizes in response to the number of balls. Some of the prizes can be furthermore exchanged for money at a prize exchange window outside the pachinko hall. Therefore, in fact, most players convert pachinko balls left into money.

By the way, many pachinko halls are located in the best commercial districts in town surrounding stations for attracting customers; pachinko halls, which are located in the suburbs, are completely equipped with large parking lots. The pachinko hall requires a wide area to install various pachinko machines. Opening a new pachinko hall requires a considerable amount of funds which makes it somewhat difficult to open a new pachinko hall.

DISCLOSURE OF INVENTION

The present specification proposes a pachinko remote gaming system which enables a player at a distant location to play a pachinko machine without coming to a pachinko hall.

Thus, the player can play the pachinko machine at home, for example, as with a video game and can play games as he or she likes whenever he or she wants to play without coming all the way to a pachinko hall.

The pachinko hall is free from limitations on the location conditions (for example, it can be opened at a location like a warehouse), and players do not actually come to the pachinko hall. Thus, the pachinko hall does not require an interior fund.

As described above, it is an object of the invention to provide a pachinko remote gaming system which enables a player at a distant location to play a pachinko machine.

To the end, according to the invention, there are provided gaming facilities comprising a gaming machine, a gaming condition detection system for detecting a gaming progress condition of the gaming machine, a gaming control system being connected to the gaming machine and the gaming condition detection system and comprising a control section for controlling operation of the gaming machine, a first transmission section for transmitting a signal to a communication network, and a first reception section for receiving a signal transmitted over the communication network, and a remote gaming terminal comprising a second transmission section for transmitting a signal to a communication network, a second reception section for receiving a signal transmitted over the communication network, a display section for displaying the signal received by the second reception section, an operation section for accepting an external command, and a signal generation section for generating a signal based on the command accepted through the operation section, characterized in that the first transmission section transmits a signal indicating a gaming condition detected by the gaming condition detection system to the remote gaming terminal via the communication network, that the second reception section receives the signal indicating the gaming condition transmitted via the communication network from the gaming control system, that the display section displays an image indicating the gaming condition in the gaming machine based on the signal indicating the gaming condition received by the second reception section, that the operation section accepts an operation command for causing the gaming machine whose image indicating the gaming condition therein is displayed by the display section to operate, that the signal generation section generates a gaming signal, which is a signal indicating a command for causing the gaming machine to operate, based on the operation command accepted through the operation section, that the second transmission section transmits the gaming signal generated by the signal generation section to the gaming control system via the communication network, that the first reception section receives the gaming signal transmitted via the communication network from the remote gaming terminal, and that the control section controls the gaming machine for which the first transmission section transmits the signal indicating the gaming condition so that the gaming machine operates based on the gaming signal received by the first reception section.

More specifically, the invention provides, for example, a pachinko remote gaming system comprising:

(1) a plurality of pachinko machines;

(2) a plurality of shooting devices provided in one-to-one correspondence with the pachinko machines for shooting the corresponding pachinko machines;

(3) a gaming control system being connected to the pachinko machines and the plurality of shooting devices and comprising a pachinko control section for controlling the operation of the plurality of pachinko machines, a first transmission section for transmitting a signal to a communication network, and a first reception section for receiving a signal transmitted over the communication network; and (4) one or more remote gaming terminals each comprising a second transmission section for transmitting a signal to a communication network, a second reception section for receiving a signal transmitted over the communication network, a display section for displaying the signal received by the second reception section, an operation section for accepting an external command, and a signal generation section for generating a signal based on the command accepted through the operation section.

The first transmission section transmits a video signal of the pachinko machine shot by any of the plurality of shooting devices to the remote gaming terminal via the communication network, the second reception section receives the video signal of the pachinko machine transmitted via the communication network from the gaming control system, the display section displays the video signal of the pachinko machine received by the second reception section, the operation section accepts an operation command for causing the pachinko machine, whose video signal is displayed by the display section, to operate, the signal generation section generates a gaming signal, which is a signal indicating a command for causing the pachinko machine to operate, based on the operation command accepted through the operation section, the second transmission section transmits the gaming signal generated by the signal generation section to the gaming control system via the communication network, the first reception section receives the gaming signal transmitted via the communication network from the remote gaming terminal, and the pachinko control section controls the pachinko machine whose video signal is transmitted by the first transmission section so that the pachinko machine operates based on the gaming signal received by the first reception section.

The operation section can accept a gaming start command to indicate starting a game play and a gaming end command to indicate quitting a game play, the signal generation section can generate a gaming start signal indicating a gaming start instruction based on the gaming start command accepted through the operation section and generate a gaming end signal indicating a gaming end instruction based on the gaming end command accepted through the operation section, the second transmission section can transmit the gaming start signal and the gaming end signal generated by the signal generation section to the gaming control system via the communication network, and the first reception section can receive the gaming start signal and the gaming end signal transmitted via the communication network from the remote gaming terminal.

Further, the remote gaming terminal may comprise a first network connection section for connecting the remote gaming terminal and the gaming control system by a communication line of a communication network when the operation section accepts the gaming start command, and the gaming control system may comprise a second network connection section for disconnecting the communication line of the communication network between the gaming control system and the remote gaming terminal when the first reception section receives the gaming end signal.

The remote gaming control system can also comprise a menu generation section for generating a data signal representing a menu for enabling a player of the remote gaming terminal to select a pachinko machine to be played from among the plurality of pachinko machines when the first reception section receives the gaming start signal, in which case the first transmission section transmits the data signal generated by the menu generation section to the remote gaming terminal via the communication network, the second reception section receives the data signal transmitted from the gaming control system via the communication network, the display section displays the data signal received by the second reception section, the operation section accepts a selection command of the pachinko machine to be played out of the menu represented by the data signal displayed by the display section, the signal generation section generates a menu signal indicating the pachinko machine to be played based on the selection command accepted through the operation section, the second transmission section transmits the menu signal generated by the signal generation section to the gaming control system via the communication network, the first reception section receives the menu signal transmitted via the communication network from the remote gaming terminal, and the first transmission section transmits a video signal of the pachinko machine indicated by the menu signal received by the first reception section.

Further, if the operation section has a handle that can be turned laterally, the signal generation section generates a gaming signal at a level responsive to a turn angle of the handle. At this time, each of the pachinko machines can comprise a propelling section for propelling a pachinko ball with a strength responsive to the level of the gaming signal, one or more winning parts that a pachinko ball propelled by the propelling section can enter, a gaming condition change section operating so as to change to either of a big win condition of a predetermined gaming condition and a loss condition of any other gaming condition if a pachinko ball enters a special winning part of a predetermined one of the winning parts, a variable winning part changing to a win enable state in which a pachinko ball can enter the variable winning part if the gaming condition change section changes to the big win condition, a number-of-paid-balls count section for counting the number of pachinko balls to be paid out to the player of the remote gaming terminal based on the number of pachinko balls entering the winning parts containing the special winning part and the variable winning part, and a number-of-propelled-balls count section for counting the number of pachinko balls propelled by the propelling section.

Further, the gaming control system can comprise a first calculation section for determining whether the player of the remote gaming terminal has finally won or lost pachinko balls based on a difference between the number of propelled balls calculated by the number-of-propelled-balls count section and the number of paid balls calculated by the number-of-paid-balls count section, when determining that the player has finally won pachinko balls, for calculating the number of won pachinko balls and when determining that the player has finally lost pachinko balls, for calculating the number of lost pachinko balls, and a second calculation section for calculating a won amount of money related to the number of won balls if the first calculation section calculates the number of won balls or a lost amount of money related to the number of lost balls if the first calculation section calculates the number of lost balls.

In this case, further, the gaming control system may comprise a message generation section for generating a data signal representing a message to the effect that the owner of the gaming control system pays out a share related to the won amount of money to the player of the remote gaming terminal if the second calculation section calculates the won amount of money and generating a data signal representing a message to the effect that the player pays out a charge related to the lost amount of money to the owner if the second calculation section calculates the lost amount of money, the first transmission section may transmit the data signal generated by the message generation section to the remote gaming terminal via the communication network, the second reception section may receive the data signal transmitted via the communication network from the gaming control system, and the display section may display the data signal received by the second reception section.

In the remote gaming terminal, the display section displays the video signal of the pachinko machine transmitted via the communication network from the gaming control system. Then, the player of the remote gaming terminal enters an operation command for causing the pachinko machine to operate through the operation section, for example, by turning the handle of the operation section by a desired angle.

When the operation section accepts the operation command, the signal generation section generates a gaming signal, which is a signal indicating a command for causing the pachinko machine to operate, based on the operation command, and the second transmission section transmits the gaming signal generated by the signal generation section to the gaming control system via the communication network. The signal generation section generates the gaming signal at the level responsive to the turn angle of the handle of the operation section.

In the gaming control system, the first reception section receives the gaming signal transmitted via the communication network from the remote gaming terminal, and the pachinko control section controls the pachinko machine whose video signal is transmitted by the first transmission section so that the pachinko machine operates based on the gaming signal received by the first reception section. Then, in the pachinko machine, the propelling section propels a pachinko ball with the strength responsive to the level of the gaming signal and the operation is started.

Thus, according to the pachinko remote gaming system of the invention, the plurality of pachinko machines, the plurality of shooting devices, and the gaming control system are installed in a pachinko hall and the remote gaming terminal is installed at player's home, etc., whereby the player of the remote gaming terminal, namely, the player at a distant location can play the pachinko machine.

If the player of the remote gaming terminal causes a pachinko ball propelled by the propelling section to enter into any of the winning parts including the special winning part and the variable winning part in the pachinko machine, as many pachinko balls as the predetermined number per pachinko ball entering the winning part are paid out to the player, as in the prior art.

By the way, in the pachinko remote gaming system of the invention, the user of the remote gaming terminal, who is at a distant location from the pachinko hall, cannot pay cash related to the number of pachinko balls used for playing games to the pachinko hall or receive a prize related to the number of pachinko balls remaining on hand when the game is over.

Then, in the pachinko machine, the number of paid-out pachinko balls is counted by the number-of-paid-balls count section and the number of pachinko balls propelled by the propelling section is counted by the number-of-propelled-balls count section, whereby in the gaming control system, the first calculation section can determine whether the player of the remote gaming terminal has finally won or lost pachinko balls based on the difference between the number of propelled balls calculated by the number-of-propelled-balls count section and the number of paid balls calculated by the number-of-paid-balls count section. That is, when determining that the player has finally won pachinko balls, the first calculation section calculates the number of won pachinko balls, and when determining that the player has finally lost pachinko balls, the first calculation section calculates the number of lost pachinko balls. The second calculation section calculates the won amount of money related to the number of won balls if the first calculation section calculates the number of won balls or the lost amount of money related to the number of lost balls if the first calculation section calculates the number of lost balls.

In the gaming control system, if the message generation section generates a data signal representing a message to the effect that the owner of the gaming control system (pachinko hall) pays out a share related to the won amount of money to the player of the remote gaming terminal when the second calculation section calculates the won amount of money, and generates a data signal representing a message to the effect that the player pays out a charge related to the lost amount of money to the owner when the second calculation section calculates the lost amount of money, and the first transmission section transmits the data signal generated by the message generation section to the remote gaming terminal via the communication network, at the remote gaming terminal, the second reception section can receive the data signal transmitted via the communication network from the gaming control system and the display section can display the data signal received by the second reception section. Then, the player of the remote gaming terminal can know the amount of money lost or won each time he or she plays a game.

Thus, the user of the remote gaming terminal can see the lost amount of money to be paid to the pachinko hall or the won amount of money to be received from the pachinko hall; the charge or share related to the amount of money may be transferred between the pachinko hall and the user, for example, by paying cash equivalent to the lost amount of money from the user's bank account or paying cash equivalent to the won amount of money into the user's bank account.

In the invention, remote operation may be enabled by using matrix sensors each for detecting an electromagnetic effect produced by the presence of a pachinko ball moving on the base board of the pachinko machine in place of the shooting devices.

BRIEF DESCRIPTION OF THE DRAWINGS

FIGS. 8A and 8B are illustrations showing respective messages displayed on the display of the remote gaming terminal.

FIGS. 24A–24C are illustrations showing respective tables stored in a memory in the gaming control system.

BEST MODE FOR CARRYING OUT THE INVENTION

Referring now to the accompanying drawings, there are shown preferred embodiments of the invention.

A pachinko remote gaming system of a first embodiment enables a player at a distant location to play a pachinko machine.

Figure 1:
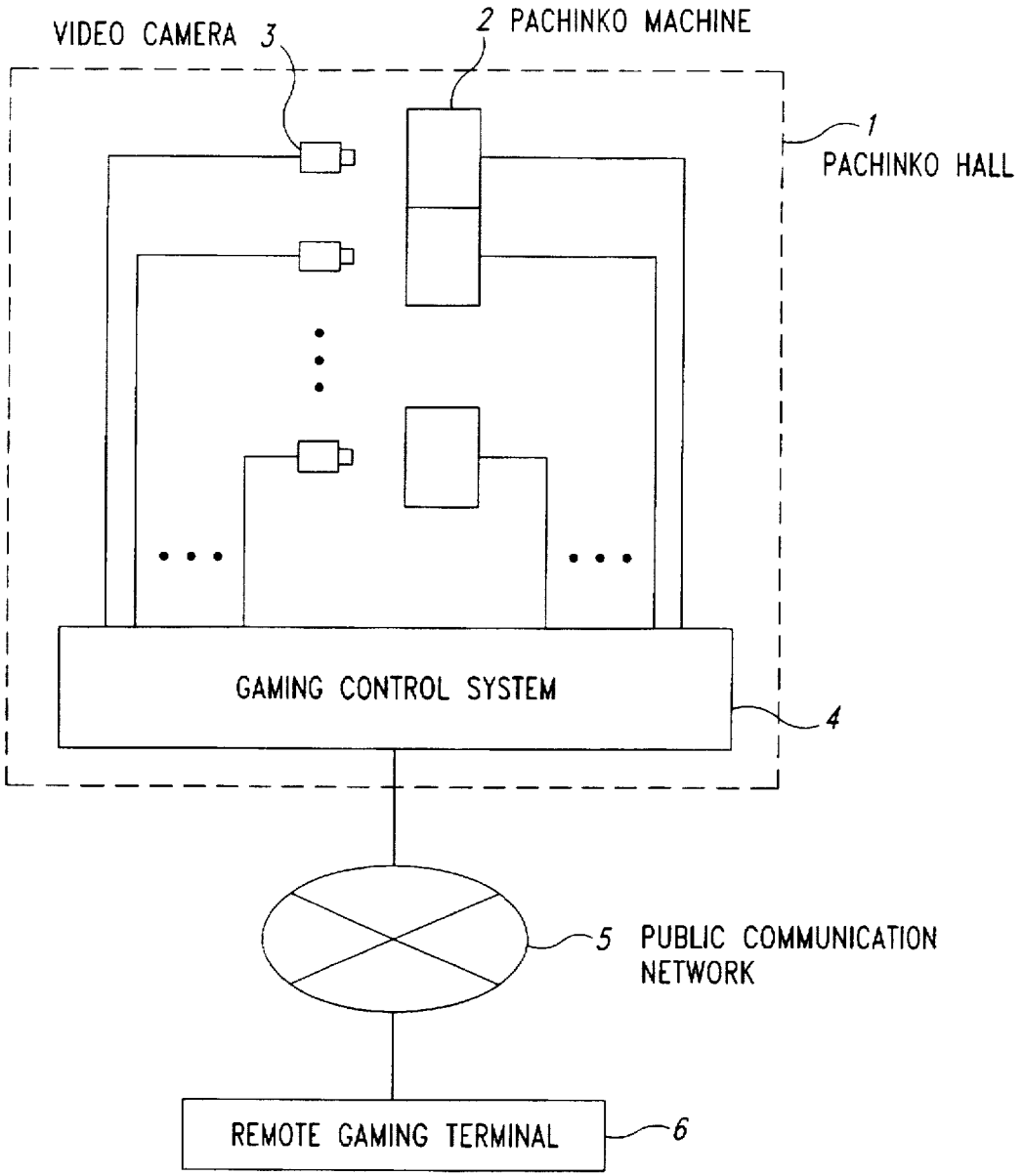
FIG. 1 is a block diagram of a first embodiment of a pachinko remote gaming system.

FIG. 1 is a block diagram of the pachinko remote gaming system of the embodiment.

In the figure, numeral 1 is a pachinko hall, numeral 2 is a pachinko machine, numeral 3 is a video camera, numeral 4 is a gaming control system, numeral 5 is a public communication network, and numeral 6 is a remote gaming terminal.

The remote gaming terminal 6 can be installed at various locations. In the description that follows, an example in which the remote gaming terminal 6 is installed at player's home will be covered.

In the example, the player executes predetermined procedures, thereby signing a gaming contract with the pachinko hall 1 and obtaining the remote gaming terminal 6. The main purpose of signing the gaming contact with the pachinko hall 1 is so that the pachinko hall 1 can know the financial institution account number of the player as well as his or her name, address, and telephone number to enable the player to pay out the charge related to the number of pachinko balls lost by him or her to the pachinko hall 1 and the pachinko hall 1 to pay out the share related to the number of pachinko balls won by the player to him or her.

In the embodiment, since players do not sit in chairs in front of the pachinko machines 2 in order to play them, the pachinko machines 2 can be arranged in such a manner that they are installed on bookshelves from top to bottom and from side to side. Chairs in which the players sit need not be installed.

The video cameras 3 are provided in one-to-one correspondence with the pachinko machines 2. Each of the video cameras 3 takes a picture of the corresponding pachinko machine 2 from the front thereof, reads the picture, and outputs it to the gaming control system 4. It starts or ends taking a picture under the control of the gaming control system 4 described later. The video cameras 3 can also be arranged in such a manner that they are installed on bookshelves from top to bottom and from side to side, or the pachinko machine 2 can also be provided with a base for installing the video camera 3.

First, how a player plays the pachinko machine 2 with the remote gaming terminal 6 will be discussed with reference to FIGS. 4–8.

Figure 4:
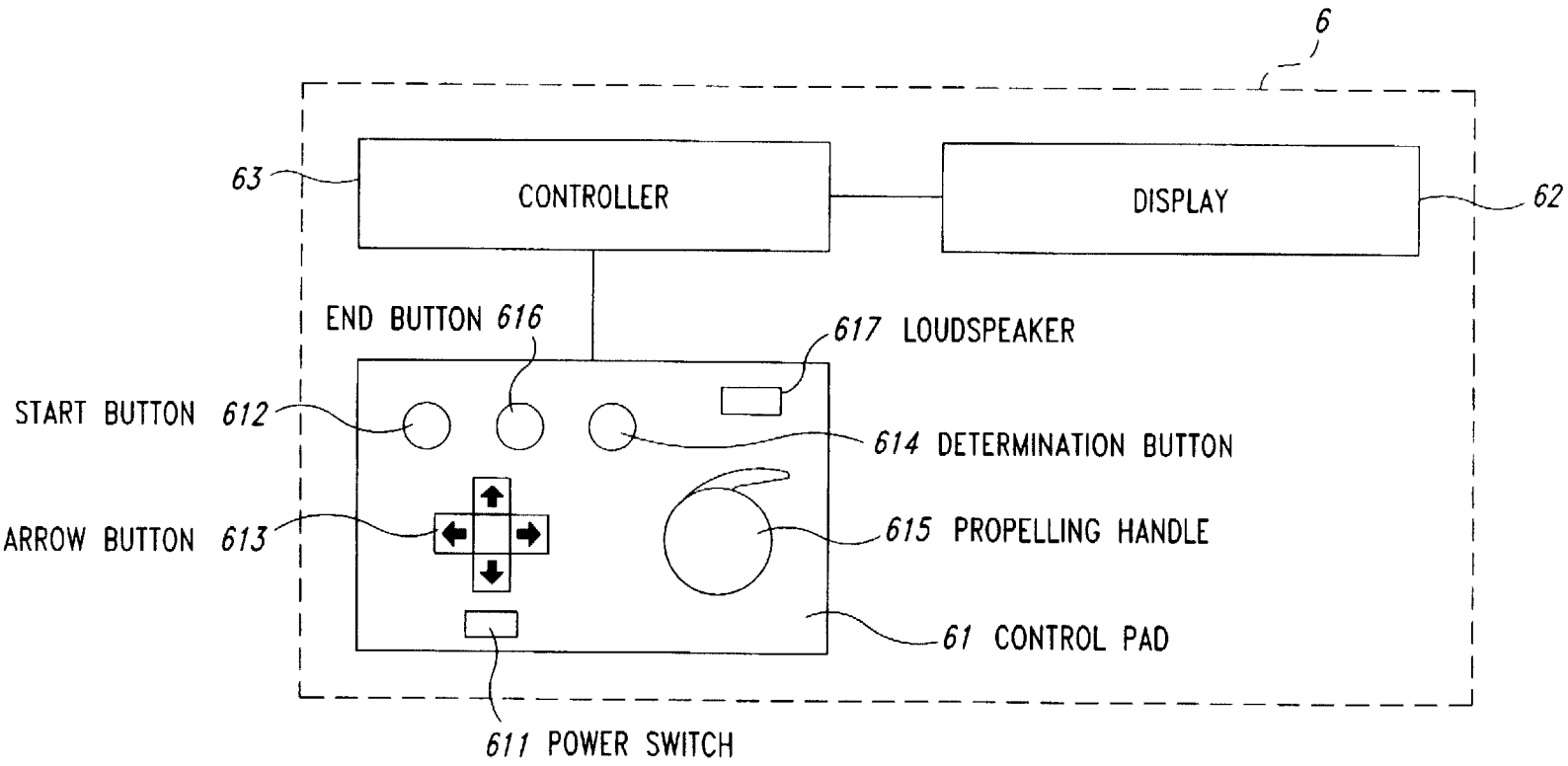
FIG. 4 is an internal block diagram of a remote gaming terminal 6.

FIG. 4 is a block diagram of the remote gaming terminal 6.

In the figure, numeral 61 is a control pad, numeral 62 is a display, and numeral 63 is a controller.

Figure 5:
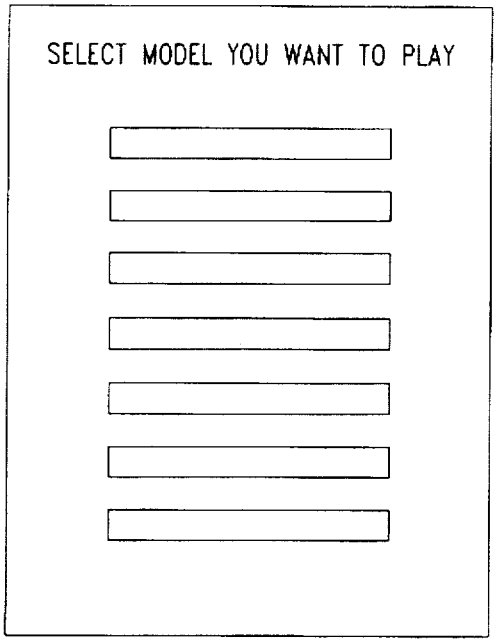
FIG. 5 is an illustration showing a menu displayed on a display of the remote gaming terminal.

When the player turns on a power switch 611 disposed on the control pad 61 and presses a start button 612, a communication line between the remote gaming terminal 6 and the gaming control system 4 in the pachinko hall 1 is connected and a menu for selecting the type of pachinko machine 2 to be played is displayed on the display 62, as shown in FIG. 5.

Figure 6:
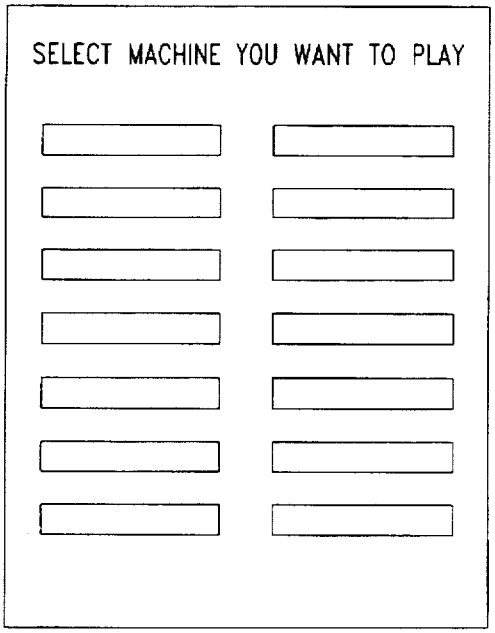
FIG. 6 is an illustration showing a menu displayed on the display of the remote gaming terminal.

When the player selects the desired type of pachinko machine 2 by pressing arrow buttons 613 disposed on the control pad 61 and presses a determination button 614, a menu for selecting the pachinko machine 2 to be played is displayed on the display 62, as shown in FIG. 6.

In FIG. 6, identification numbers of the pachinko machines 2 not played by other players among all pachinko machines 2 of the type selected by the player are displayed as a menu on the display 62.

Figure 7:
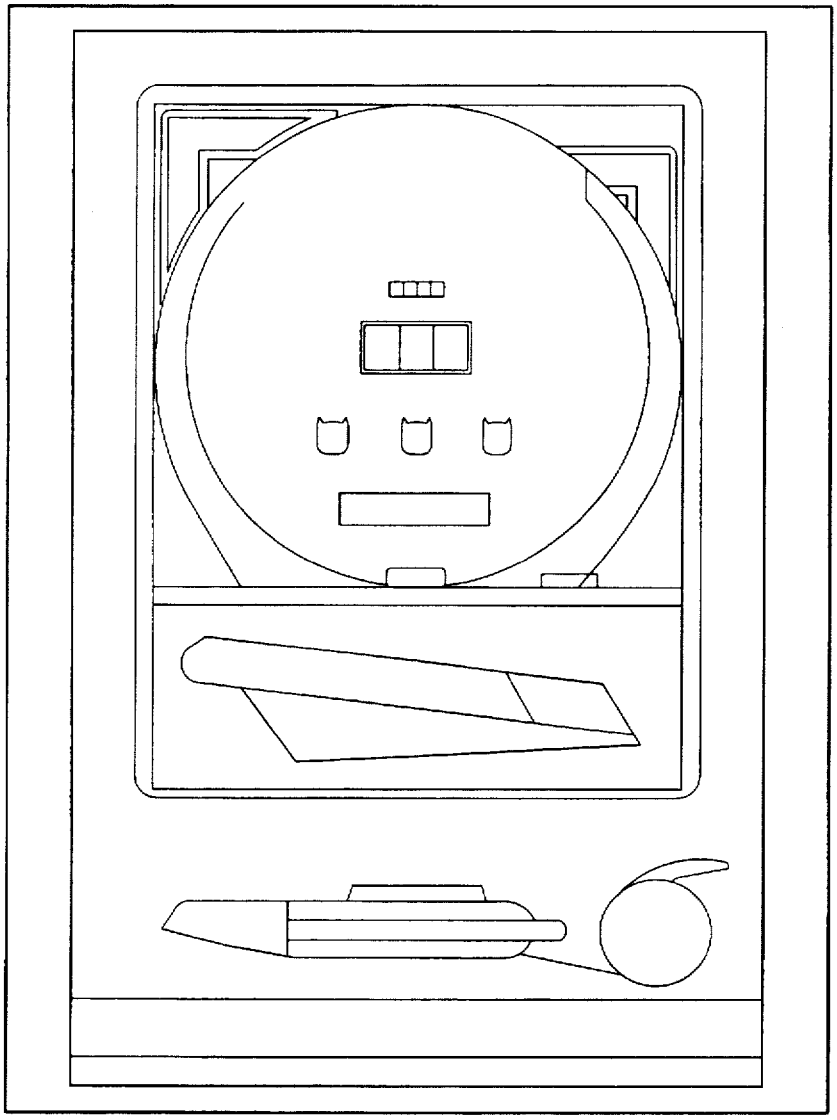
FIG. 7 is an illustration showing a picture of the pachinko machine displayed on the display of the remote gaming terminal.

When the player selects any desired identification number by pressing the arrow buttons 613 and presses the determination button 614, a picture of the selected pachinko machine 2 is displayed on the display 62, as shown in FIG. 7.

Then, the user can play the pachinko machine 2 whose picture is displayed on the display 62 by turning a propelling handle 615 disposed on the control pad 61, and can monitor the pachinko machine 2 played by him or her as a picture displayed on the display 62. A sound effect from the pachinko machine 2 is output through a loudspeaker 617 and in the pachinko machine 2, pachinko balls are propelled one by one in the strength responsive to the turn angle of the propelling handle 615, as described later.

According to the embodiment, the player can play the pachinko machine 2 whose picture is displayed on the display 62 by turning the propelling handle 615 disposed on the control pad 61 instead of turning the propelling handle 201 of the conventional pachinko machine.

To quit the game play, the player may press an end button 616 disposed on the control pad 61. When the player presses the end button 616, a message indicating the charge related to the number of pachinko balls lost by him or her, namely, the amount indicating cash to be paid from his or her financial institution account is displayed on the display 62, as shown in FIG. 8(*a*) or a message indicating the share related to the number of pachinko balls won by the player, namely, the amount indicating cash to be paid into his or her financial institution account is displayed on the display 62, as shown in FIG. 8(*b*), then the communication line between the remote gaming terminal 6 and the gaming control system 4 in the pachinko hall 1 is disconnected.

The control pad 61 can be further provided with a volume control for adjusting the sound level of the sound effect output through the loudspeaker 617 and a headphone connection terminal for outputting the sound effect to be output through the loudspeaker 617 to headphones.

Next, the operation of the remote gaming terminal 6 will be discussed with reference to FIGS. 9–11.

Figure 9:
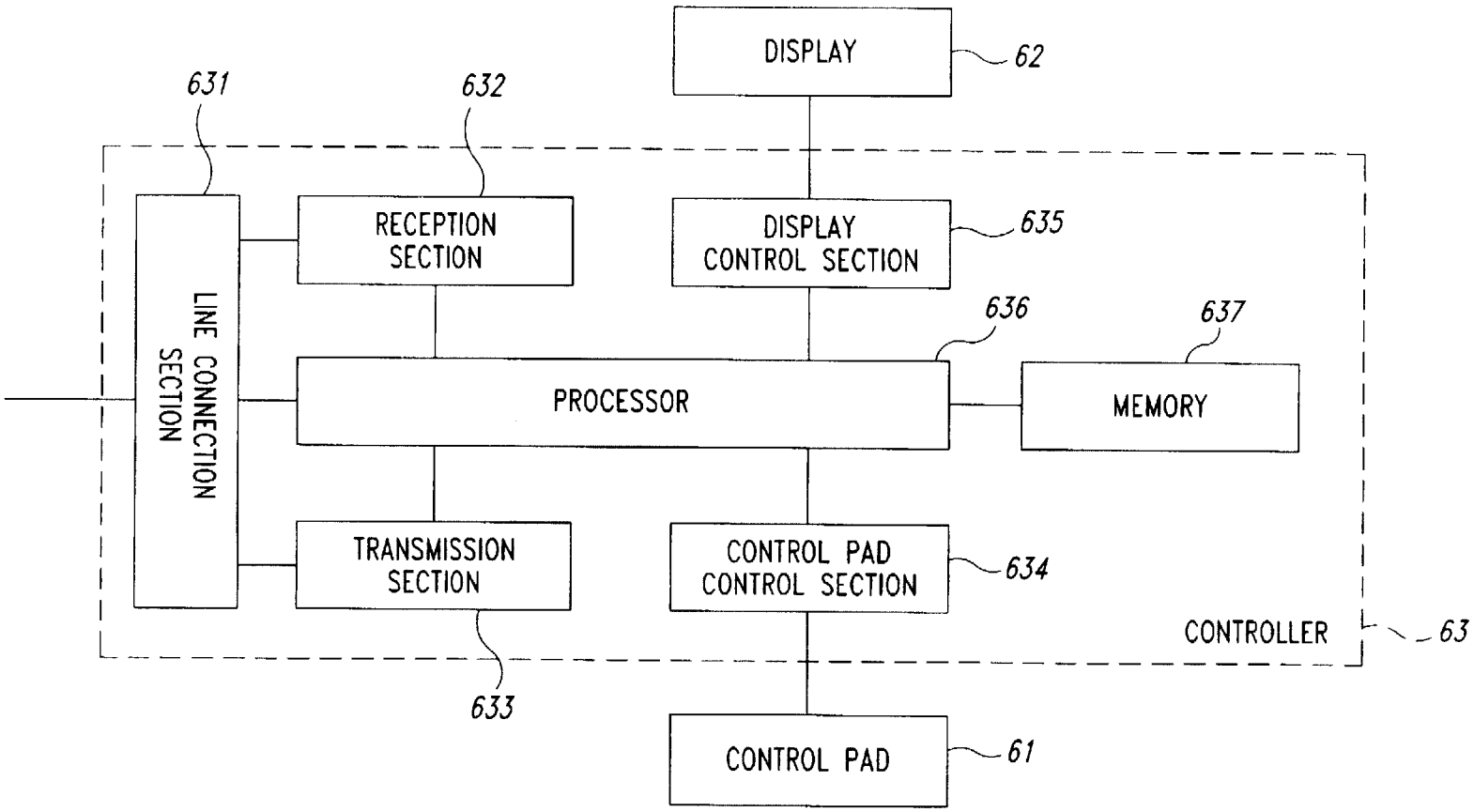
FIG. 9 is an internal block diagram of the controller.

FIG. 9 is an internal block diagram of the controller 63.

In the figure, the controller 63 comprises a line connection section 631 for connecting a communication line between the remote gaming terminal and the gaming control system 4 in the pachinko hall 1, a reception section 632 for receiving a signal transmitted from the gaming control system 4, a transmission section 633 for transmitting a signal to the gaming control system 4, a control pad control section 634 for controlling the control pad 61, a display control section 635 for controlling the display 62, a processor 636 for controlling the operation of the sections, and a memory 637 for storing programs executed by the processor 636.

In fact, the line connection section 631 is provided by a modem connected to a player's telephone and has a connection terminal for connecting to the telephone.

Figure 10A:
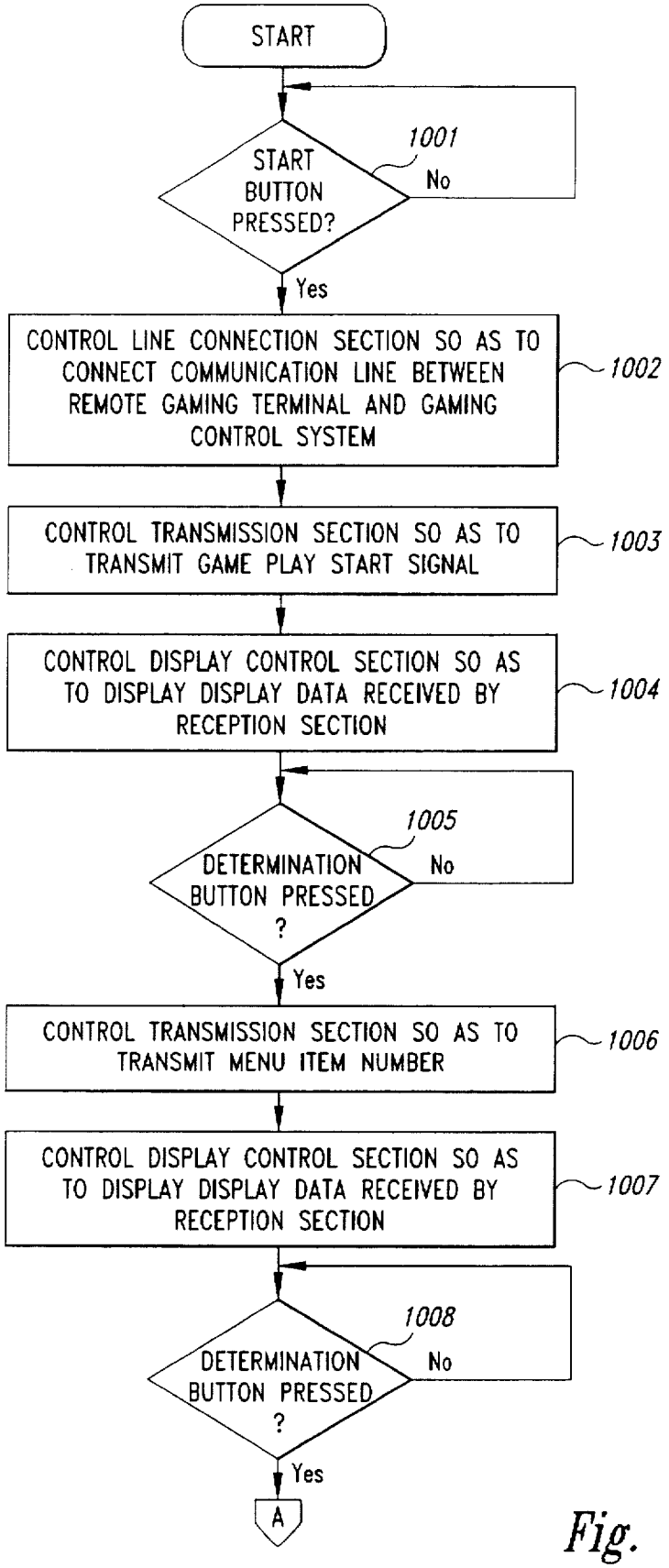
FIGS. 10A and 10B together are showing an operation flow of a processor in the controller of the remote gaming terminal.
Figure 10B:
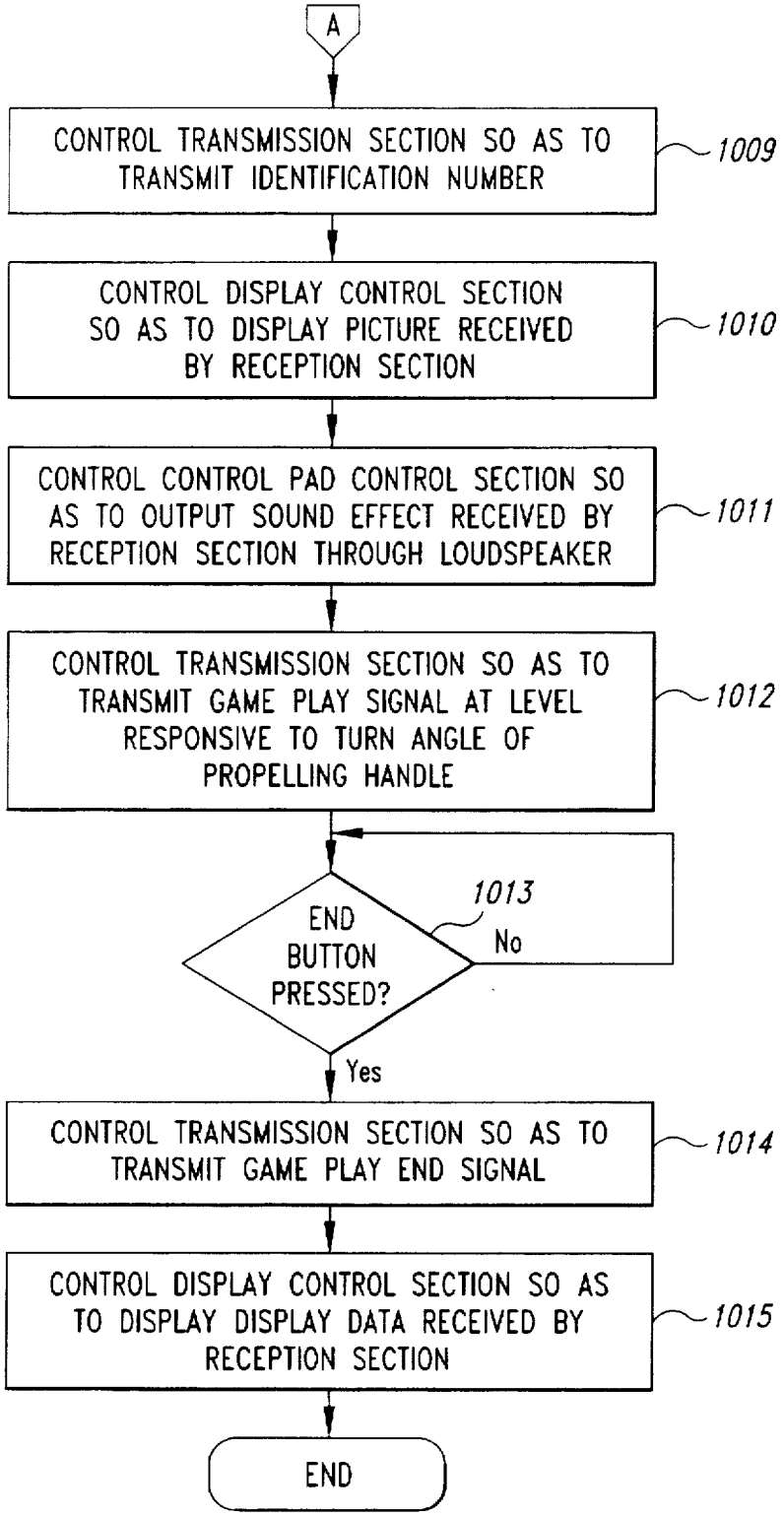

FIGS. 10A and 10B together are a flowchart showing an operation flow of the processor 636.

In the controller 63, soon after turning on the power switch 611, the player will press the start button 612; thus when the control pad control section 634 senses that the start button 612 has been pressed at step 1001, the processor 636 controls the line connection section 631 so that the line connection section 631 connects the communication line between the remote gaming terminal and the gaming control system 4 in the pachinko hall 1 at step 1002.

Then, the line connection section 631 performs a call originating process so that the player's telephone originates a call based on the telephone number of the pachinko hall 1, and executes a line connection process to connect the communication line between the remote gaming terminal and the gaming control system 4. During the line connection process or after the termination thereof, the line connection section 631 transmits the telephone number of the player's telephone to the gaming control system 4.

Subsequently, the processor 636 controls the transmission section 633 so that the transmission section 633 transmits a message indicating the start of a game play to the gaming control system 4 at step 1003.

Display data to display the menu shown in FIG. 5 is transmitted from the gaming control system 4, as described later. Then, the processor 636 controls the display control section 635 so that the display control section 635 displays the display data received by the reception section 632 on the display 62 at step 1004.

Thus, the menu shown in FIG. 5 is displayed on the display 62 and the player selects the type of pachinko machine 2 to be played.

When the control pad control section 634 senses that the determination button 614 has been pressed at step 1005, the processor 636 controls the transmission section 633 so that the transmission section 633 transmits the menu item number indicating the menu item corresponding to the position of the arrow button 613 at the point in time to the gaming control system 4 at step 1006.

Display data to display the menu shown in FIG. 6 is transmitted from the gaming control system 4, as described later. Then, the processor 636 controls the display control section 635 so that the display control section 635 displays the display data received by the reception section 632 on the display 62 at step 1007.

Thus, the message shown in FIG. 6 is displayed on the display 62 and the player selects the identification number of pachinko machine 2 to be played.

When the control pad control section 634 senses that the determination button 614 has been pressed at step 1008, the processor 636 controls the transmission section 633 so that the transmission section 633 transmits the identification number corresponding to the position of the arrow button 613 at the point in time to the gaming control system 4 at step 1009.

A picture of the pachinko machine 2 is transmitted from the gaming control system 4, as described later. Then, the processor 636 controls the display control section 635 so that the display control section 635 displays the picture received by the reception section 632 on the display 62 at step 1010.

A sound effect of the pachinko machine 2 is transmitted from the gaming control system 4, as described above. Then, the processor 636 controls the control pad control section 634 so that the control pad control section 634 outputs the sound effect received by the reception section 632 through the loudspeaker 617 at step 1011.

Thus, the picture of the pachinko machine 2 continues to be displayed on the display 62 as shown in FIG. 7 so long as it is transmitted from the gaming control system 4, and the sound effect continues to be output through the loudspeaker 617 so long as it is transmitted from the gaming control system 4.

Since the picture and sound effect of the pachinko machine 2 are transmitted as multiplexed signals, the reception section 632 demultiplexes the multiplexed signals.

When the picture of the pachinko machine 2 is displayed on the display 62, the player starts playing a game by turning the propelling handle 615.

Then, the processor 636 controls the transmission section 633 so that the transmission section 633 transmits a game play signal at the level responsive to the turn angle of the propelling handle 615 sensed by the control pad control section 634 to the gaming control system 4 at step 1012.

Thus, the transmission section 633 continues transmitting the game play signal at the level responsive to the turn angle to the gaming control system 4 so long as the propelling handle 615 is turned.

On the other hand, to quit the game play, the player presses the end button 616. When the control pad control section 634 senses that the end button 616 has been pressed at step 1013, the processor 636 controls the transmission section 633 so that the transmission section 633 transmits a game play end signal indicating the end of the game play to the gaming control system 4 at step 1014.

Display data to display the message shown in FIG. 8A or 8B is transmitted from the gaming control system 4, as described later. Then, the processor 636 controls the display control section 635 so that the display control section 635 displays the display data received by the reception section 632 on the display 62 at step 1015.

Thus, the menu shown in FIG. 8A or 8B is displayed on the display 62, enabling the player to know the amount indicating cash paid from or into the player's financial institution account.

After this, the communication line between the remote gaming terminal and the gaming control system 4 is disconnected by the gaming control system 4, as described later, and the picture of the pachinko machine 2 disappears from the display 62.

The gaming control system 4 may transmit the number of pachinko balls lost or won by the player together with the picture of the pachinko machine 2 to the remote gaming terminal 6. In doing so, the number of pachinko balls lost or won by the player can be displayed on the display 62 of the remote gaming terminal 6, enabling the player to know the current number of pachinko balls lost or won by him or her even during the game playing and use it as a guideline for quitting the game playing.

Figure 11:
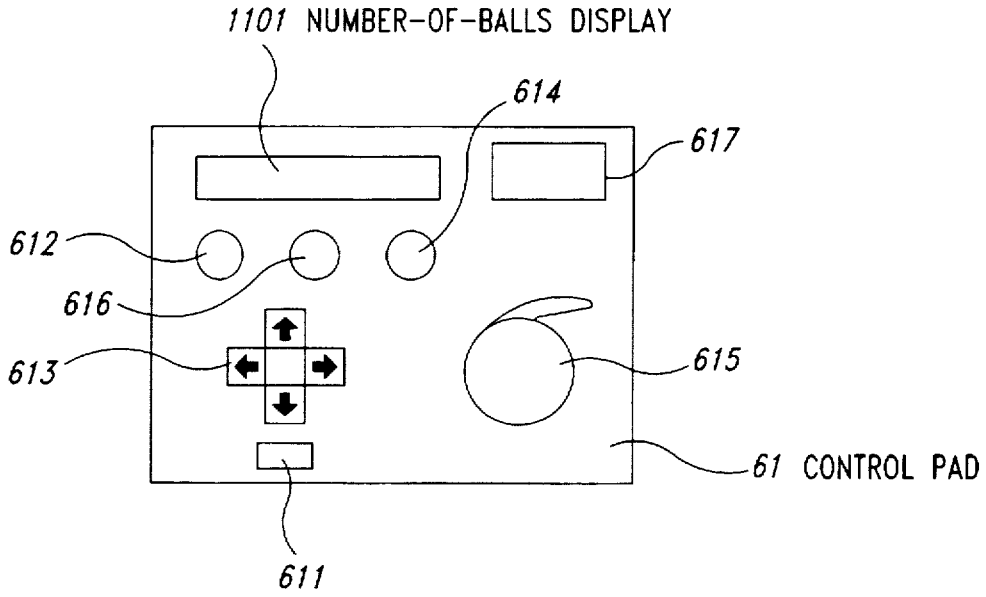
FIG. 11 is an illustration showing another example of a control pad of the remote gaming terminal.

The number of pachinko balls lost or won by the player may be displayed on a number-of-balls display 1101 disposed on the control pad 61, as shown in FIG. 11.

In the figure, the value resulting from subtracting the number of pachinko balls paid out from the pachinko machine 2 to the player from that of pachinko balls propelled into the pachinko machine 2 is displayed on the number-of-balls display 1101.

Then, if the value displayed on the number-of-balls display 1101 is positive, the player sees that he or she loses as many pachinko balls as the number indicated by the value; if the value is negative, the player sees that he or she wins as many pachinko balls as the number indicated by the value.

The amount related to the number of pachinko balls lost or won by the player may be displayed, rather than the number.

Next, the operation of the pachinko machine 2 will be discussed with reference to FIGS. 2 and 12 to 20.

Figure 2:
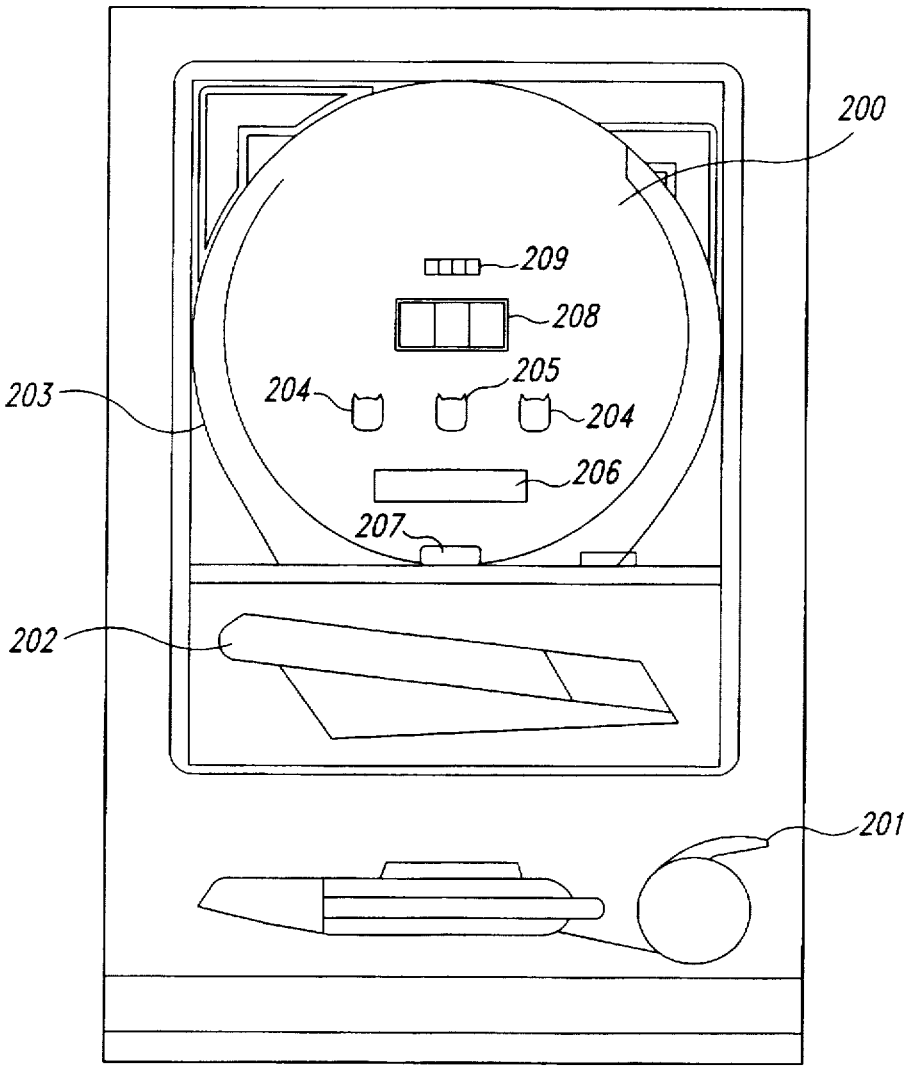
FIG. 2 is a front view of a conventional pachinko machine and a pachinko machine of the first embodiment.
Figure 3:
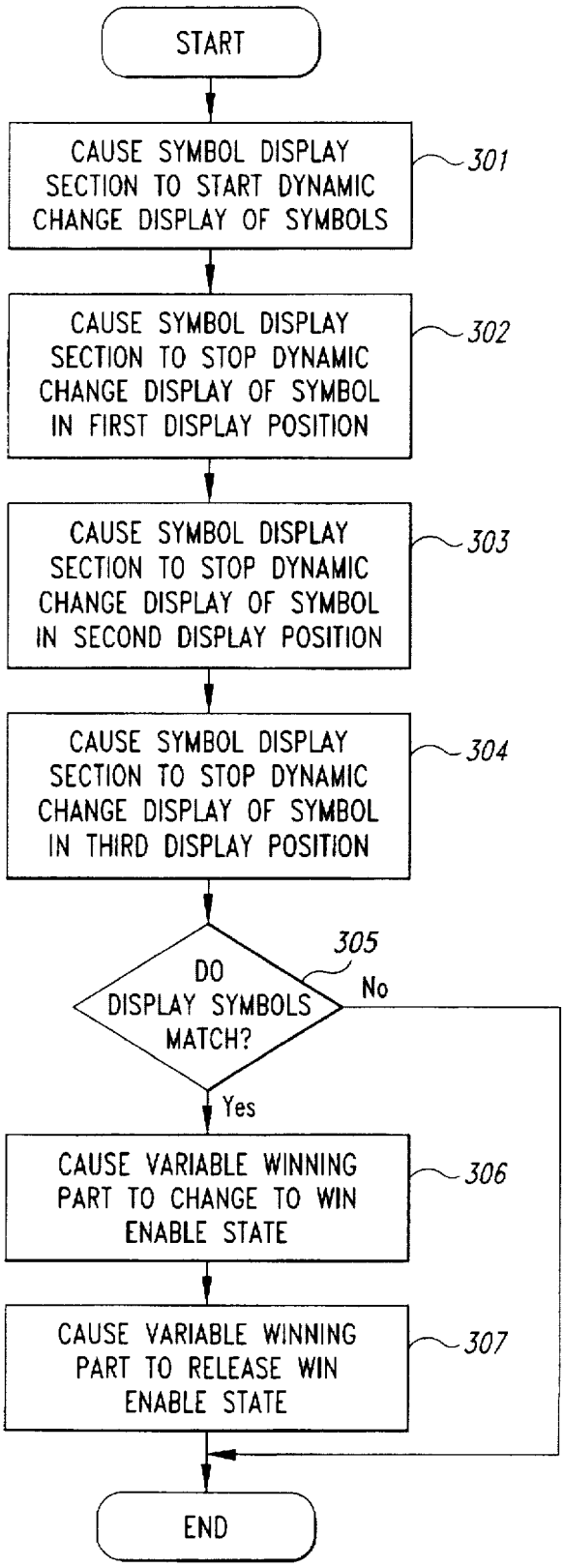
FIG. 3 is a flowchart showing an operation flow of a controller in the conventional pachinko machine.

The front view of the pachinko machine 2 is the same as FIG. 2, the front view of the conventional pachinko machine.

In the conventional pachinko machine, pachinko balls stored in the return 202 are propelled one by one with the strength responsive to the turn angle of the propelling handle 201 turned by a player. In the pachinko machine 2 of the embodiment, pachinko balls stored in a return 202 are propelled one by one with the strength responsive to the level of a game play signal transmitted from the remote gaming terminal 6 (in fact, output via the gaming control system 4). In this case, the pachinko machine 2 of the embodiment does not require the propelling handle 201.

The propelling handle 201 may be turned automatically in response to the level of a game play signal transmitted from the remote gaming terminal 6, in which case the propelling handle 201 is required.

Propelled pachinko balls are guided by a guide rail 203 to the upper position of a gaming board 200. On the gaming board 200, the pachinko balls start free falling and while falling, collide with obstacle pegs (not shown) and change their passage irregularly.

The gaming board 200 is formed with winning parts 204, a special winning part 205, and a variable winning part 206 for the player to cause a pachinko ball to enter into for a winning game play, as a result of which the pachinko is discharged from the gaming board 200. When a pachinko ball enters the winning part 204 or the special winning part 205, a predetermined number of pachinko balls (for example, seven balls) are paid out to the return 202. Particularly, when a pachinko ball enters the special winning part 205, a symbol display section 208 starts dynamic change display of different symbols in three positions. When a predetermined time or the time found by random number calculation has elapsed, the symbol display section 208 stops the dynamic change display of the symbols in the three display positions at different timings.

Here, assume that the different symbols displayed by the symbol display section 208 are 16 symbols of A to P, that the symbol display section 208 stops the dynamic change display of the symbols in the order of the first to third display positions, and that big win combinations are 16 combinations of the same display symbols in the three display positions, like "AAA," "BBB,". . . , "PPP."

When the dynamic change display of the symbol in the second display position is stopped, if the display symbols in the first and second display positions match, there is a chance that the display symbols in the three display positions will match, thus the player comes close to winning. Further, if the dynamic change display of the symbol in the third display position stops and the display symbols in the three display positions match, the player has a big win. Then, the variable winning part 206 opens its lid and changes to the win enable state. When a predetermined number of pachinko balls (for example, 10 balls) have entered the variable winning part 206 or a predetermined time (for example, 30 seconds) has elapsed, the variable winning part 206 closes the lid. A predetermined number of pachinko balls (for example, 15 balls) are paid out to the return 202 for each of the pachinko balls entering the variable winning part 206 between the instant when the variable winning part 206 opens the lid and the instant when the lid is closed, namely, in one round.

A predetermined number of rounds (for example, 16 rounds) can be provided for one big win. The player may advance to the next round only when entering a pachinko ball in a special point in the variable winning part 206 in one round.

Considering that a pachinko ball enters the special winning part 205 while the symbol display section 208 is operating, a maximum of four pachinko balls entering the special winning part 205 can be displayed as wins on a number-of-wins display section 209, ensuring the operation of the symbol display section 208.

On the other hand, pachinko balls not entering any of the winning parts 204, the special winning part 205, or the variable winning part 206 fall into an out ball discharge part 207 and are collected by the pachinko hall 1.

Normally, a sound effect is produced from the pachinko machine to raise player's mood during the operation of the symbol display section 208. When the player comes close to winning, a sound effect which is different from the normal sound effect is produced to increase his or her expectations. When the player has a big win, a sound effect which is different from the normal sound effect or the sound effect produced when the player comes close to winning is produced to increase his or her pleasure.

To prevent the player from becoming bored during the round, the symbol display section 208 preferably displays at least one provided moving picture or the count result of the number of pachinko balls entering the variable winning part 206.

Next, a controller for carrying out the operation of the pachinko machine 2 will be discussed with reference to FIGS. 12–20.

The controller is installed in the pachinko machine 2 for executing control to carry out the operation of the pachinko machine 2.

Figure 12:
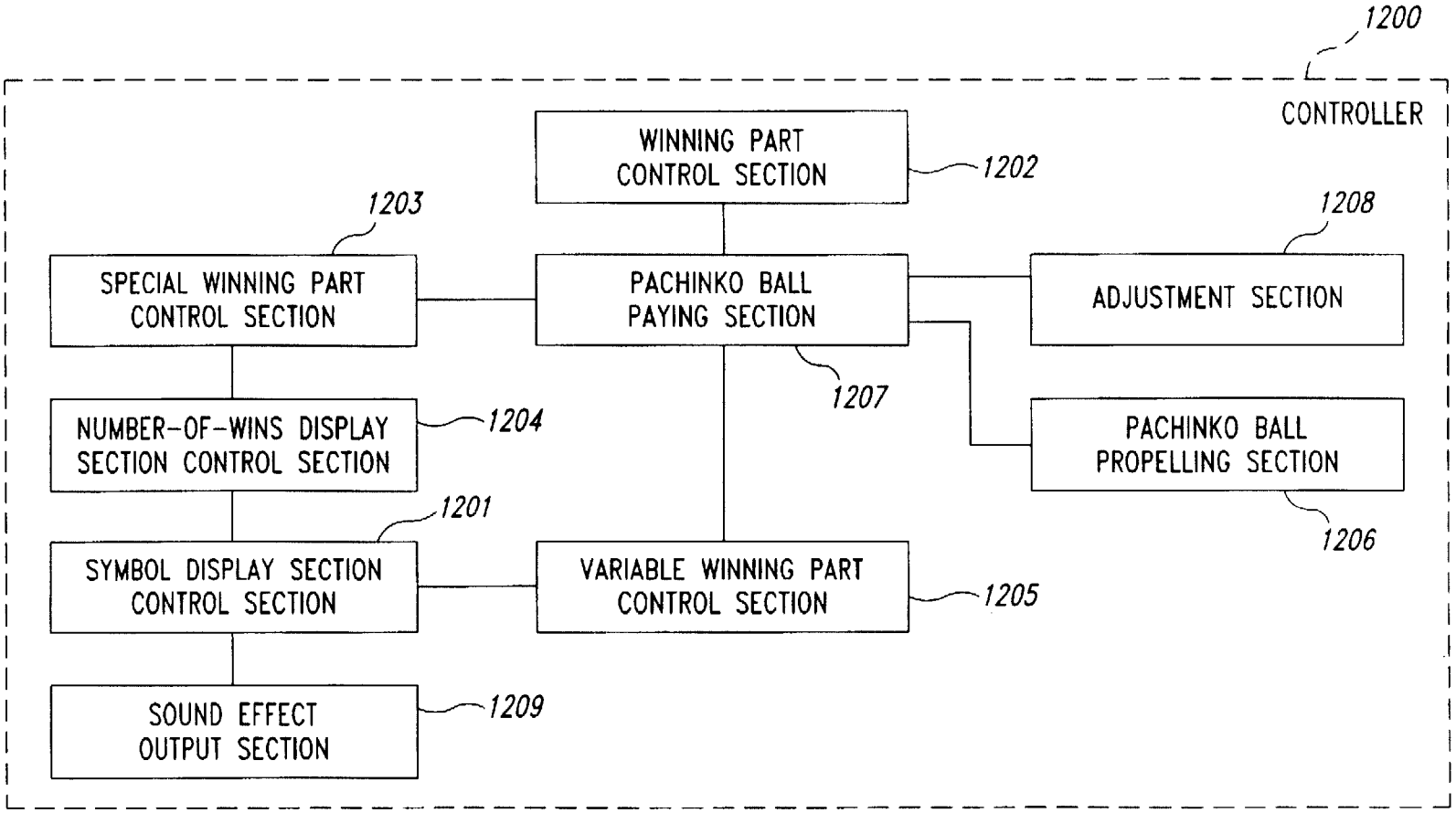
FIG. 12 is a block diagram of a controller of the pachinko machine.

FIG. 12 is a block diagram of the controller.

In the figure, numeral 1200 is the controller, numeral 1201 is a symbol display section control section, numeral 1202 is a winning part control section, numeral 1203 is a special winning part control section, numeral 1204 is a number-of-wins display section control section, numeral 1205 is a variable winning part control section, numeral 1206 is a pachinko ball propelling section, numeral 1207 is a pachinko ball paying section, numeral 1208 is an adjustment section, and numeral 1209 is a sound effect output section.

First, the winning part control section 1202 and the special winning part control section 1203 will be discussed with reference to FIG. 13.

As shown in the figure, in the winning part control section 1202, when a sensor 1301 senses that a pachinko ball enters the winning part 204, a signal output section 1302 outputs a win signal indicating that a pachinko ball enters the winning part 204 to the pachinko ball paying section 1207 for a predetermined time.

Figure 13:
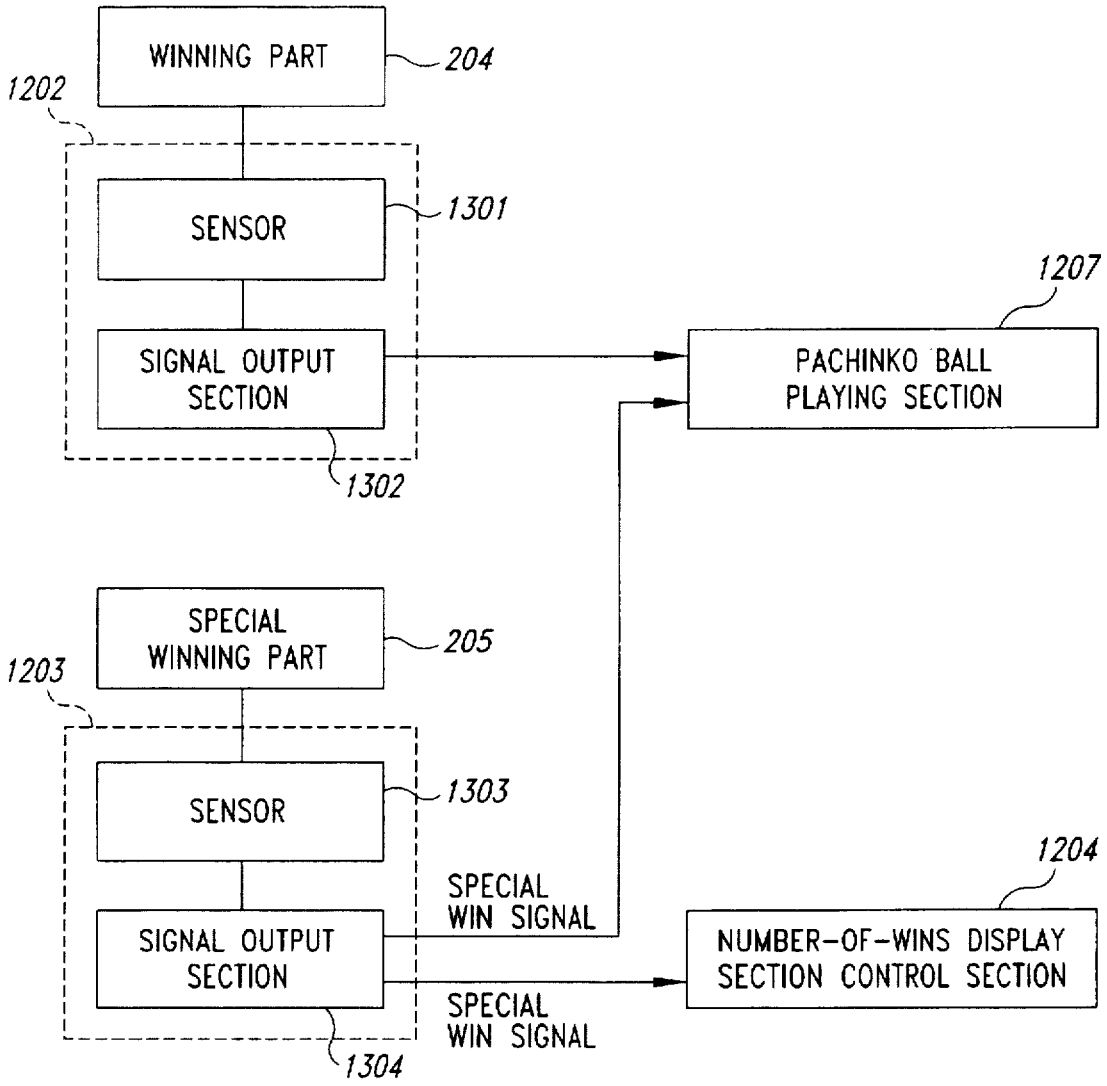
FIG. 13 is an illustration showing the operation of a winning part control section and a special winning part control section.

As shown in FIG. 13, in the special winning part control section 1203, when a sensor 1303 senses that a pachinko ball enters the special winning part 205, a signal output section 1304 outputs a special win signal indicating that a pachinko ball enters the special winning part 205 to the number-of-wins display section control section 1204 and the pachinko ball paying section 1207 for a predetermined time.

Next, the number-of-wins display section control section 1204 will be discussed with reference to FIG. 14.

The embodiment provides the number-of-wins display section 209 for displaying a maximum of four pachinko balls entering the special winning part 205 by turning on/off four provided lamps.

Figure 14:
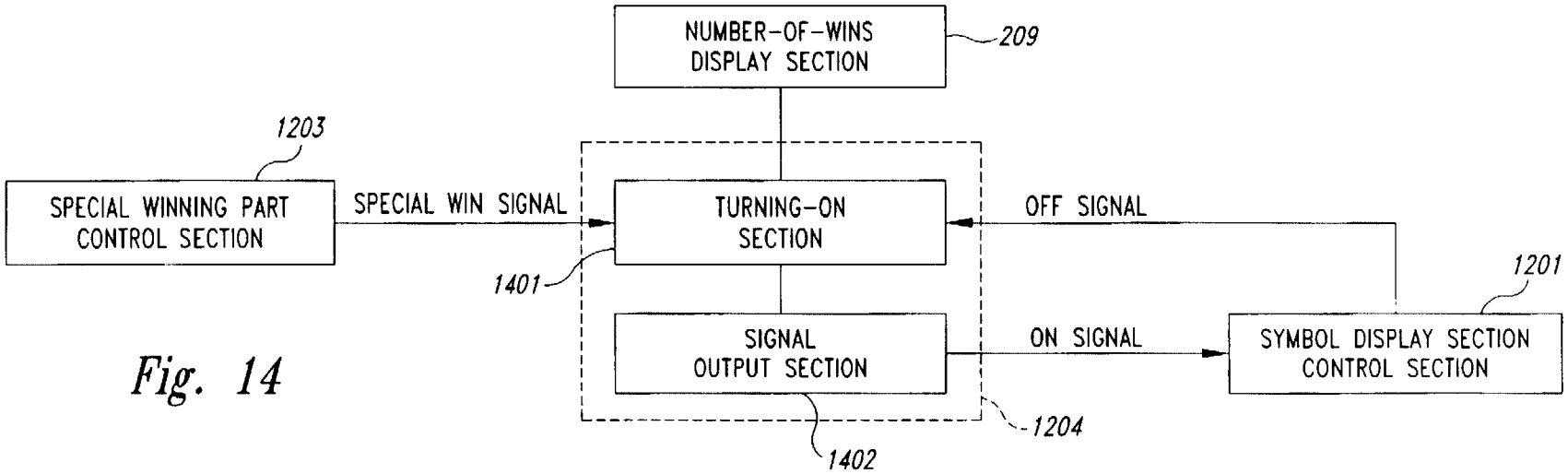
FIG. 14 an illustration showing the operation of a number-of-wins display section control section.

As shown in FIG. 14, the number-of-wins display section control section 1204 comprises a turning-on section 1401 for turning on the four lamps and a signal output section 1402 for an on signal indicating, while at least one lamp is turned on, the fact that the lamp is on to the symbol display section control section 1201.

Whenever a special win signal is output from the special winning part control section 1203, the turning-on section 1401 turns on the four lamps one at a time in the placement order. Whenever an off signal (described later) is output from the symbol display section control section 1201, the turning-on section 1401 turns off the four lamps one at a time in the reverse order to the turning-on order. When all the four lamps are on, if another special win signal is output from the special winning part control section 1203, the turning-on section 1401 ignores the special win signal.

While at least one lamp is turned on, the signal output section 1402 always outputs an on signal indicating that the lamp is on to the symbol display section control section 1201.

Next, the symbol display section control section 1201 will be discussed with reference to FIG. 15.

The symbol display section control section 1201 comprises a processor and a memory. The processor executes a program stored in the memory, thereby carrying out the operation of the symbol display section control section 1201.

Figure 15A:
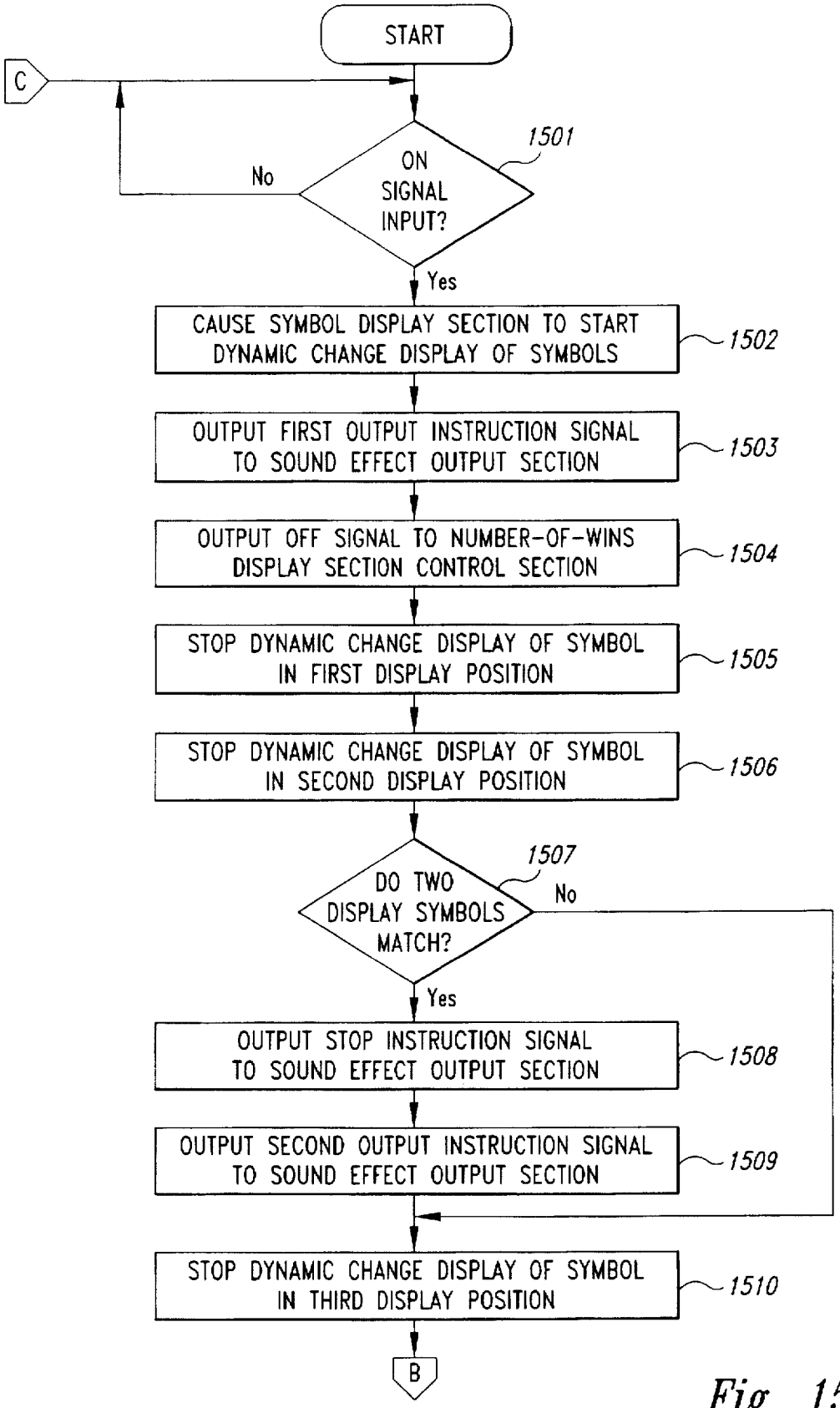
FIG. 15 is a flowchart showing an operation flow of a processor in a symbol display section control section.
Figure 15B:
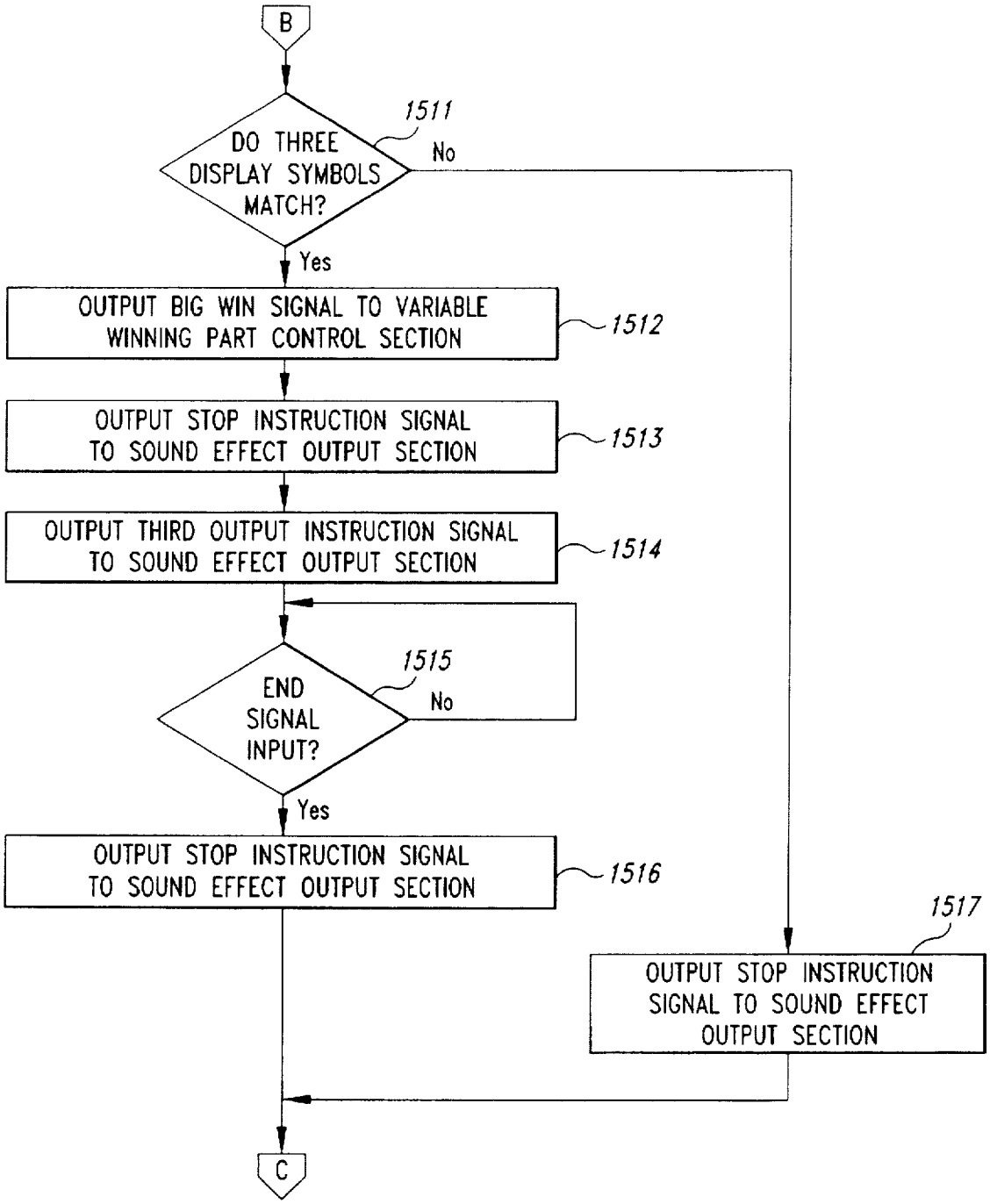

FIGS. 15A and 15B together are a flowchart showing an operation flow of the processor.

As shown in the figure, in the symbol display section control section 1201, when an on signal is output from the number-of-wins display section control section 1204 at step 1501, the processor controls the symbol display section 208 so that the symbol display section 208 starts dynamic change display of symbols in the three display positions at step 1502, and outputs a first output instruction signal indicating an output instruction of a normal sound effect to the sound effect output section 1209 at step 1503, whereby the symbol display section 208 starts dynamic change display of symbols in the three display positions and the sound effect output section 1209 outputs a normal sound effect, as described later.

When the dynamic change display of symbols in the three display positions is started, it means that the symbol display section 208 starts the operation for one pachinko ball entering the special winning part 205. Then, the processor outputs an off signal for turning off only one lamp to the number-of-wins display section control section 1204 at step 1504.

Subsequently, when a predetermined time or the time found by random number calculation has elapsed, the processor controls the symbol display section 208 so that the symbol display section 208 stops the dynamic change display of the symbol in the first display position at step 1505, whereby the symbol display section 208 stops the dynamic change display of the symbol in the first display position.

Likewise, when a predetermined time or the time found by random number calculation has elapsed, the processor controls the symbol display section 208 so that the symbol display section 208 stops the dynamic change display of the symbol in the second display position at step 1506, whereby the symbol display section 208 stops the dynamic change display of the symbol in the second display position.

Subsequently, the processor determines whether or not the display symbols in the two display positions match at step 1507. If both the display symbols match, it means that the player comes close to winning. Then, the processor outputs a stop instruction signal indicating a stop instruction of the sound effect output by the sound effect output section 1209 (in this case, normal sound effect) thereto at step 1508 and outputs a second output instruction signal indicating an output instruction of a sound effect produced when the player comes close to winning to the sound effect output section 1209 at step 1509, whereby the sound effect output section 1209 outputs the sound effect produced when the player comes close to winning, as described later.

Subsequently, when a predetermined time or the time found by random number calculation has elapsed, the processor controls the symbol display section 208 so that the symbol display section 208 stops the dynamic change display of the symbol in the third display position at step 1510, whereby the symbol display section 208 stops the dynamic change display of the symbol in the third display position.

Subsequently, the processor determines whether or not the display symbols in the three display positions match at step 1511. If they match, the processor outputs a big win signal indicating the fact that they match to the variable winning part control section 1205 at step 1512. Also, the processor outputs a stop instruction signal indicating a stop instruction of the sound effect output by the sound effect output section 1209 (in this case, sound effect produced when the player comes close to winning) thereto at step 1513 and outputs a third output instruction signal indicating an output instruction of a big win sound effect to the sound effect output section 1209 at step 1514, whereby the variable winning part control section 1205 changes the variable winning part 206 to the win enable state and the sound effect output section 1209 outputs the big win sound effect, as described later.

Then, the processor waits for an end signal (described later) to be output from the variable winning part control section 1205 at step 1515 and outputs a stop instruction signal indicating a stop instruction of the sound effect output by the sound effect output section 1209 (in this case, big win sound effect) thereto at step 1516 before returning to step 1501. If they do not match, the processor outputs a stop instruction signal indicating a stop instruction of the sound effect output by the sound effect output section 1209 (in this case, normal sound effect or sound effect produced when the player comes close to winning) thereto at step 1517 before returning to step 1501.

Next, the variable winning part control section 1205 will be discussed with reference to FIGS. 16 and 17.

Figure 16:
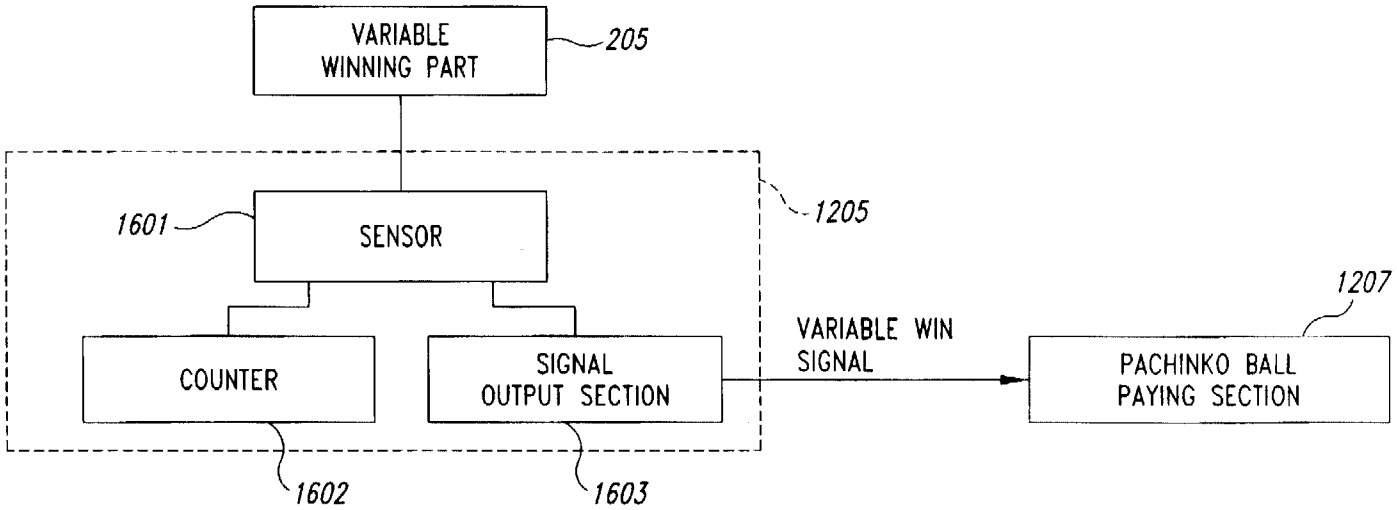
FIG. 16 is an illustration showing the operation of a variable winning part control section.

As shown in FIG. 16, in the variable winning part control section 1205, whenever a sensor 1601 senses that a pachinko ball has entered the variable winning part 206, a counter 1602 increments the count by one, and a signal output section 1603 outputs a variable win signal indicating that a pachinko ball has entered the variable winning part 206 to the pachinko ball paying section 1207 for a predetermined time.

The variable winning part control section 1205 further includes a processor and a memory; the processor executes a program stored in the memory, thereby carrying out the operation of the variable winning part control section 1205.

Figure 17:
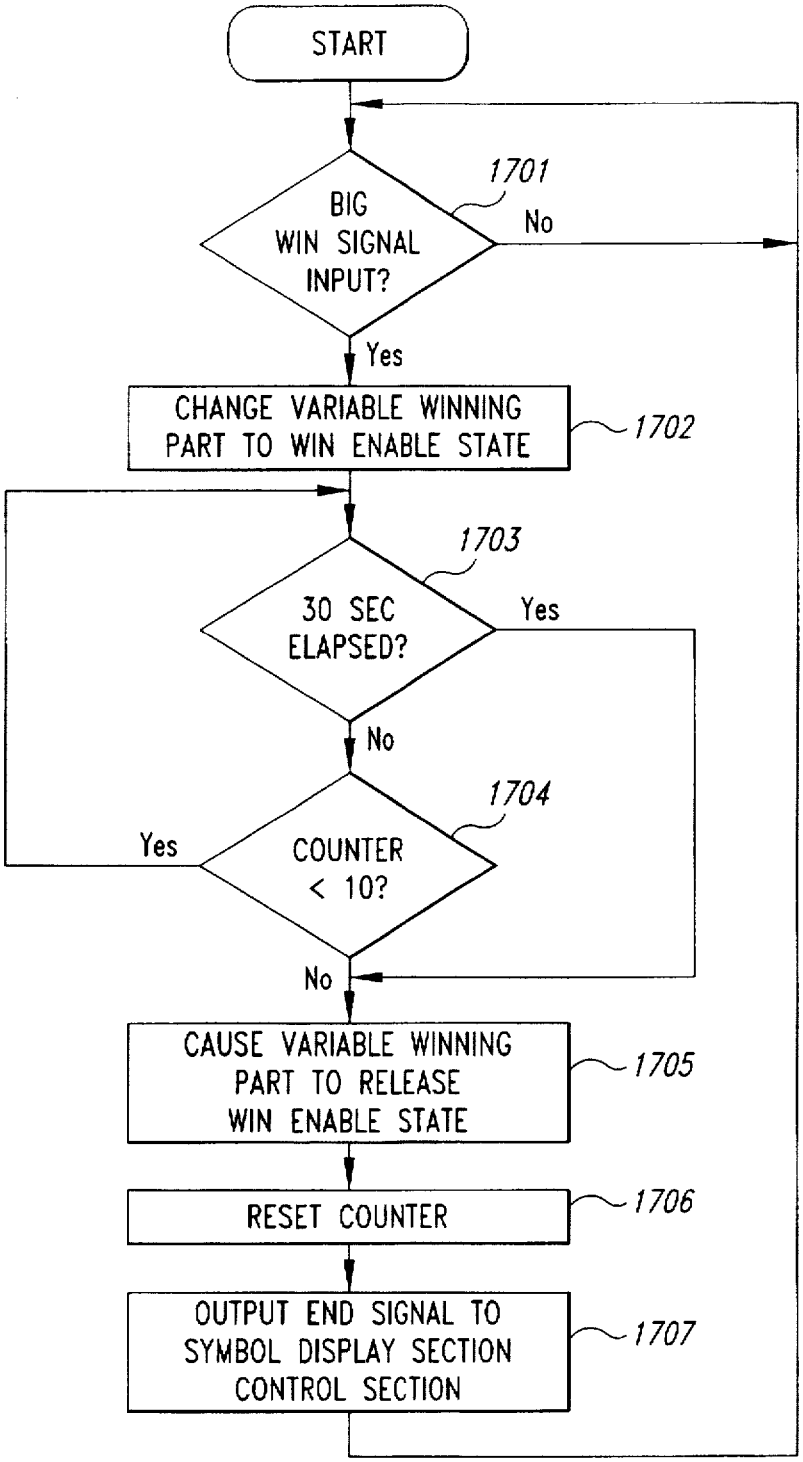
FIG. 17 is a flowchart showing an operation flow of a processor in the variable winning part control section.

FIG. 17 is a flowchart to show an operation flow of the processor.

As shown in the figure, in the variable winning part control section 1205, when a big win signal is output from the symbol display section control section 1201 at step 1701, the processor controls the variable winning part 206 so that the variable winning part 206 changes to the win enable state at step 1702, whereby the variable winning part 206 opens the lid for changing to the win enable state, and the counter 1602 counts the number of pachinko balls entering the variable winning part 206 while the variable winning part 206 opens the lid.

Subsequently, if a predetermined time (for example, 30 seconds) has elapsed at step 1703 or the count of the counter 1602 reaches 10 before a lapse of 30 seconds at step 1704, the processor controls the variable winning part 206 so that the variable winning part 206 releases the win enable state at step 1705, whereby the variable winning part 206 closes the lid for releasing the win enable state.

Last, the processor resets the count of the counter 1602 at step 1706 and outputs an end signal indicating the end of the big win to the symbol display section control section 1201 at step 1707.

Next, the sound effect output section 1209 will be discussed with reference to FIG. 18.

As shown in the figure, the sound effect output section 1209 comprises a sound effect storage section 1801 for storing normal sound effect data representing a normal sound effect, coming-close-to-winning sound effect representing a sound effect produced when a player comes close to winning, and a big win sound effect data representing a big win sound effect and are production section 1802 for reading any sound effect data stored in the sound effect storage section 1801 and reproducing the corresponding sound effect.

In the conventional pachinko machine, a reproduced sound effect is output through the loudspeaker disposed in the pachinko machine; the reproduction section 1802 in the pachinko machine 2 of the embodiment outputs a reproduced sound effect to the gaming control system 4.

In detail, if a first output instruction signal is output from the symbol display section control section 1201, the reproduction section 1802 reads the normal sound effect data from the sound effect storage section 1801, reproduces a normal sound effect, and outputs the reproduced sound effect to the gaming control system 4 until a stop instruction signal is output from the symbol display section control section 1201. If a second output instruction signal is output from the symbol display section control section 1201, the reproduction section 1802 reads the coming-close-to-winning sound effect data from the sound effect storage section 1801, reproduces a sound effect output when the player comes close to winning, and outputs the reproduced sound effect to the gaming control system 4 until a stop instruction signal is output from the symbol display section control section 1201. If a third output instruction signal is output from the symbol display section control section 1201, the reproduction section 1802 reads the big win sound effect data from the sound effect storage section 1801, reproduces a big win sound effect, and outputs the reproduced sound effect to the gaming control system 4 until a stop instruction signal is output from the symbol display section control section 1201.

Here, the sound effect reproduced by the sound effect output section 1209 is described as an electronic sound, but the sound effect output section 1209 may reproduce a sound effect previously recorded on tape.

Figure 19:
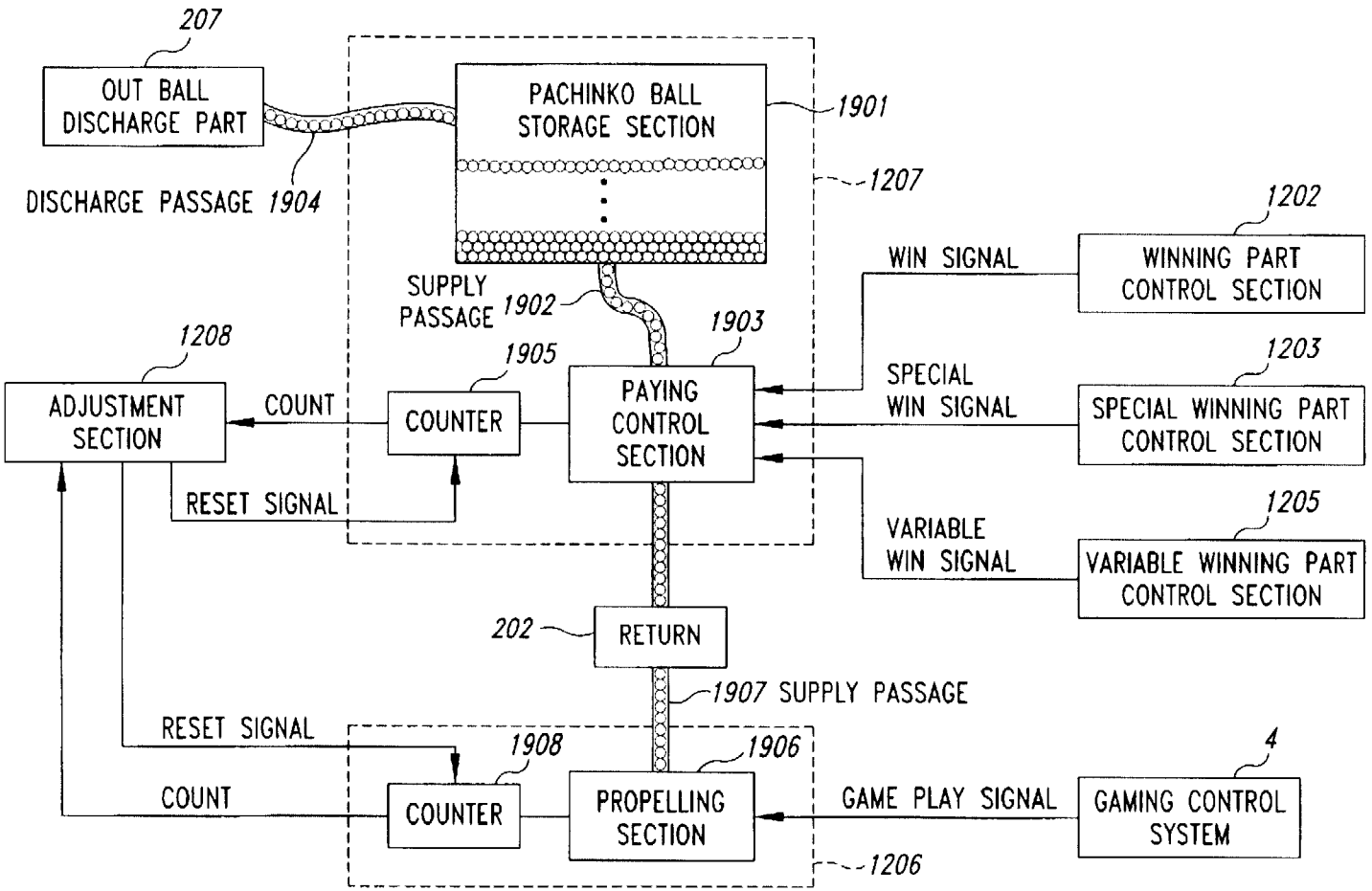
FIG. 19 is an illustration showing the operation of a pachinko ball propelling section and a pachinko ball paying section.

Next, the pachinko ball propelling section 1206 and the pachinko ball paying section 1207 will be discussed with reference to FIG. 19.

As shown in the figure, the pachinko ball paying section 1207 comprises a pachinko ball storage section 1901 for storing a large quantity of pachinko balls, a pachinko ball supply passage 1902 for connecting the pachinko ball storage section 1901 and the return 202 of the pachinko machine 2, a paying control section 1903 for paying pachinko balls to the return 202 by opening or blocking the supply passage 1902, a pachinko ball discharge passage 1904 for connecting the pachinko ball storage section 1901 and the out ball discharge part 207 of the pachinko machine 2, and a counter 1905 for counting the number of pachinko balls paid out to the return 202 from the paying control section 1903.

The supply passage 1902 forms a pipe having a diameter as large as the diameter of a pachinko ball; a string of pachinko balls is arranged in the supply passage 1902 between the pachinko ball storage section 1901 and the paying control section 1903.

The paying control section 1903 blocks the supply passage 1902 under normal conditions. When a win signal is output from the winning part control section 1202, the paying control section 1903 pays seven pachinko balls to the return 202; when a special win signal is output from the special winning part control section 1203, the paying control section 1903 pays seven pachinko balls to the return 202; and when a variable win signal is output from the variable winning part control section 1205, the paying control section 1903 pays 15 pachinko balls to the return 202. That is, when paying pachinko balls, the paying control section 1903 opens the supply passage 1902. It uses the counter 1905 to count the number of pachinko balls passing through the supply passage 1902 while the supply passage 1902 is open. When as many pachinko balls as the corresponding number have passed through, the paying control section 1903 again blocks the supply passage 1902.

The number of pachinko balls paid out from the paying control section 1903, namely, the count of the counter 1905 is always output to the adjustment section 1208. It is reset by a reset signal output from the adjustment section 1208.

Figures 18, 21:
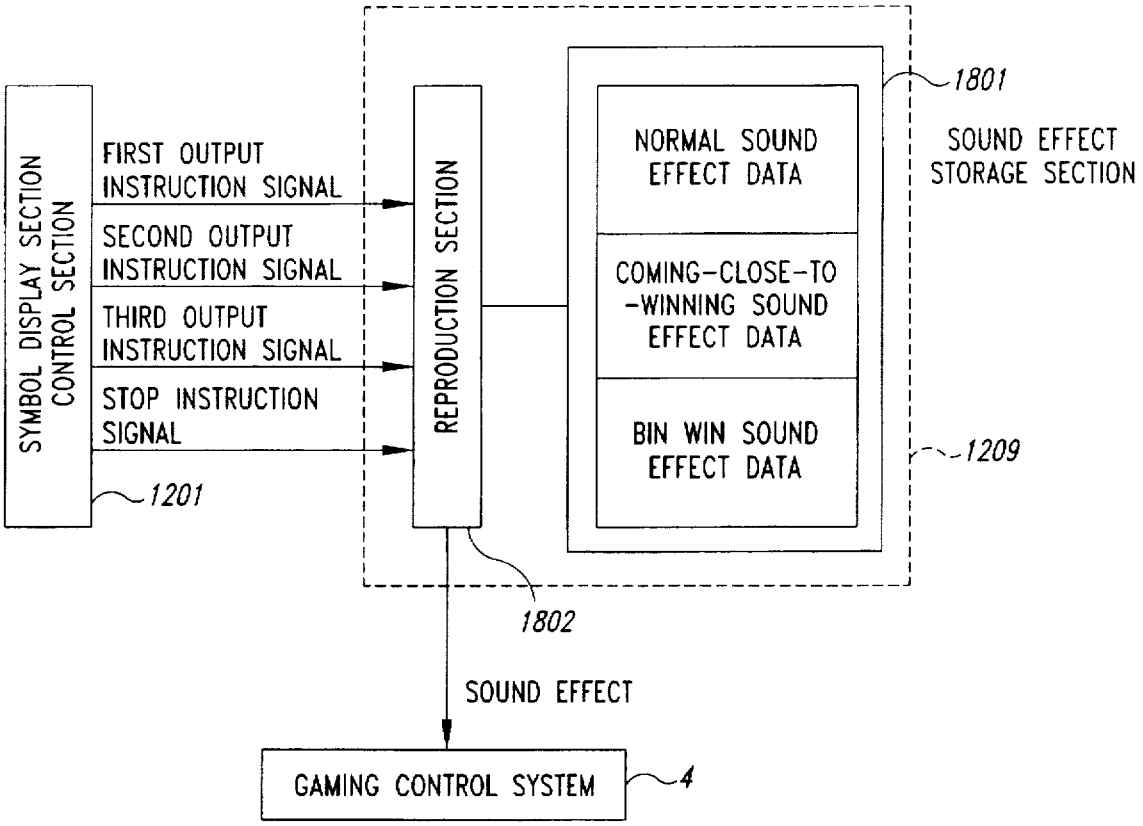
FIG. 18 is an illustration showing the operation of a sound effect output section.
FIG. 21 is an illustration showing tables stored in a memory of a symbol display section control section in another operation example of pachinko machine.

On the other hand, as shown in FIG. 18, the pachinko ball propelling section 1206 comprises a propelling section 1906 for propelling pachinko balls one by one with the strength responsive to the level of a game play signal output from the gaming control system 4, a pachinko ball supply passage 1907 for connecting the return 202 of the pachinko machine 2 and the propelling section 1906, and a counter 1908 for counting the number of pachinko balls propelled by the propelling section 1906.

The propelling section 1906 is disposed at the termination of the supply passage 1907 for propelling the pachinko ball placed in the position toward the guide rail 203. The number of pachinko balls propelled by the propelling section 1906 is counted by the counter 1908 and the count of the counter 1908 is always output to the adjustment section 1208. It is reset by a reset signal output from the adjustment section 1208.

The pachinko balls entering the out ball discharge part 207 of the pachinko machine 2 are discharged via the discharge passage 1904 to the pachinko ball storage section 1901 for circulating the pachinko balls in the pachinko machine 2.

Next, the adjustment section 1208 will be discussed with reference to FIG. 20.

The adjustment section 1208 comprises a processor and a memory; the processor executes a program stored in the memory, thereby carrying out the operation of the adjustment section 1208.

Figure 20:
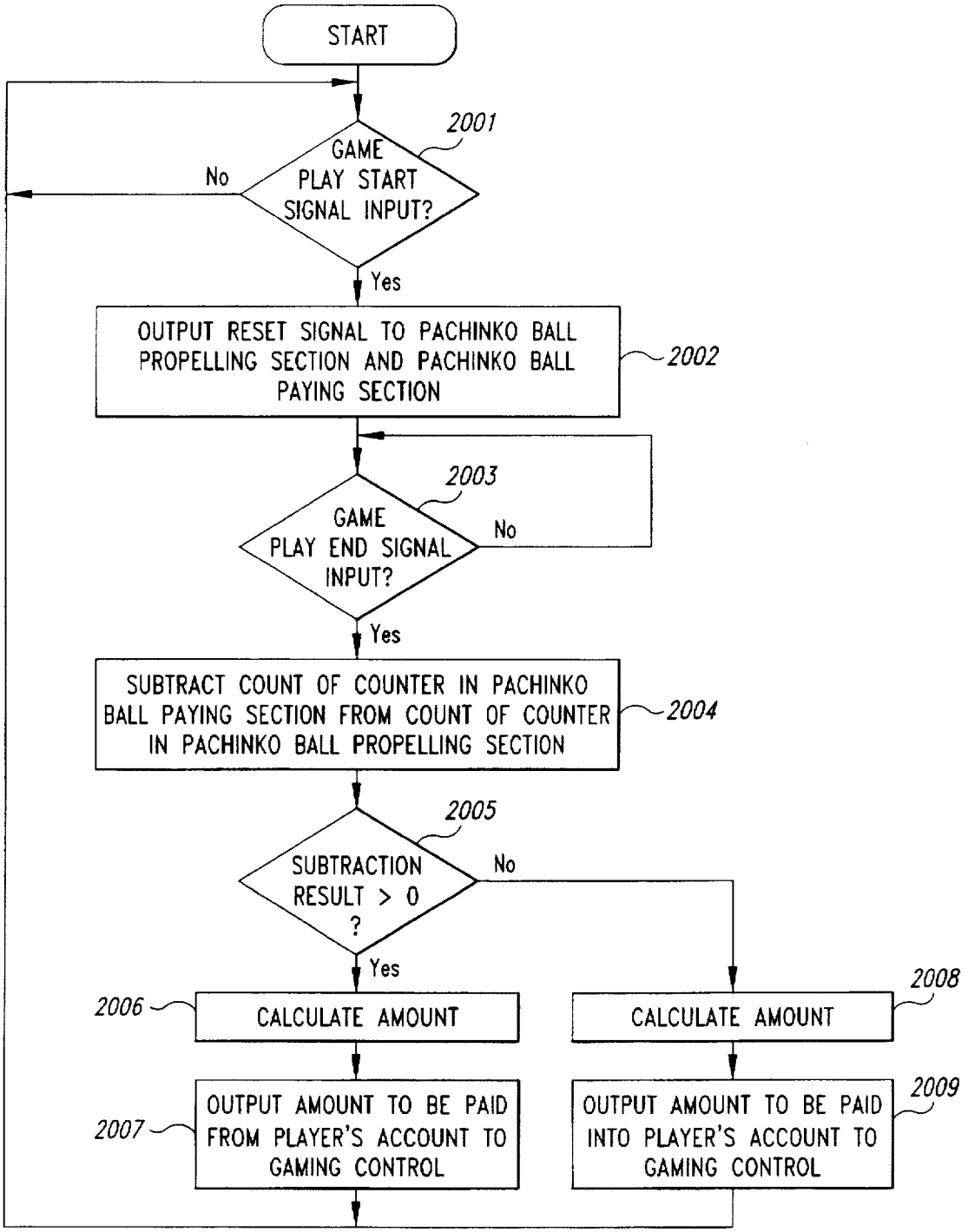
FIG. 20 is a flowchart showing an operation flow of a processor in the adjustment section.

FIG. 20 is a flowchart to show an operation flow of the processor.

As shown in the figure, in the adjustment section 1208, when a game play start signal is output from the gaming control system 4 at step 2001, the processor outputs a reset signal to the counter 1905 in the pachinko ball propelling section 1206 and the counter 1908 in the pachinko ball paying section 1207 for resetting the counts of the counters at step 2002.

Subsequently, when a game play end signal is output from the gaming control system 4 at step 2003, the processor subtracts the count output from the counter 1908 in the pachinko ball paying section 1207 from the count output from the counter 1905 in the pachinko ball propelling section 1206 at step 2004.

If the subtraction result value is positive at step 2005, it means that the player has lost as many pachinko balls as the number indicated by the value. Then, to pay the amount of money related to the number of pachinko balls from the player's financial institution account, the amount is calculated at step 2006, and the calculated amount and a signal indicating that the amount is to be paid from the player's account are output to the gaming control system 4 at step 2007. If the subtraction result value is not positive at step 2005, it means that the player has won as many pachinko balls as the number indicated by the value. Then, to pay the amount of money related to the number of pachinko balls into the player's financial institution account, the amount is calculated at step 2008, and the calculated amount and a signal indicating that the amount is to be paid into the player's account are output to the gaming control system 4 at step 2009.

The reason why the amount calculating process is divided into steps 2006 and 2008 is that the conversion rate into money per pachinko ball when the player wins differs from that when the player loses, in order for the pachinko hall 1 to make profits.

By the way, we have discussed an example of the operation of the pachinko machine 2 wherein whether or not the display symbol combination in the three display positions matches one of the big win combinations is determined and when they match, the player has a big win. However, in contrast, first whether or not the player has a big win may be determined and then the symbols to be displayed in the three display positions may be determined in response to the determination.

Such operation of the pachinko machine 2 will be discussed with reference to FIGS. 21 and 22.

The configuration of control system 1200 of the pachinko machine 2 is the same as that of the above-discussed embodiment except for the operation of symbol display section control section 1201.

The symbol display section control section 1201 comprises a processor and a memory; the processor executes a program stored in the memory, thereby carrying out the operation of the symbol display section control section 1201.

FIG. 21 is an illustration showing tables prestored in the memory.

As shown in the figure, the memory stores a big win table 2101 for storing big win combinations and a loss table 2102 for storing combinations other than the big win combinations, which will be hereinafter referred to as "loss combinations."

The big win table 2101 stores 16 big win combinations of "A, A, A" to "P, P, P." The loss table 2102 stores as many loss combinations as the result value of subtracting the number of big win combinations, 16, from the number of combinations of 16 symbols A to P (16×16×16), namely, 4080 loss combinations.

Figure 22A:
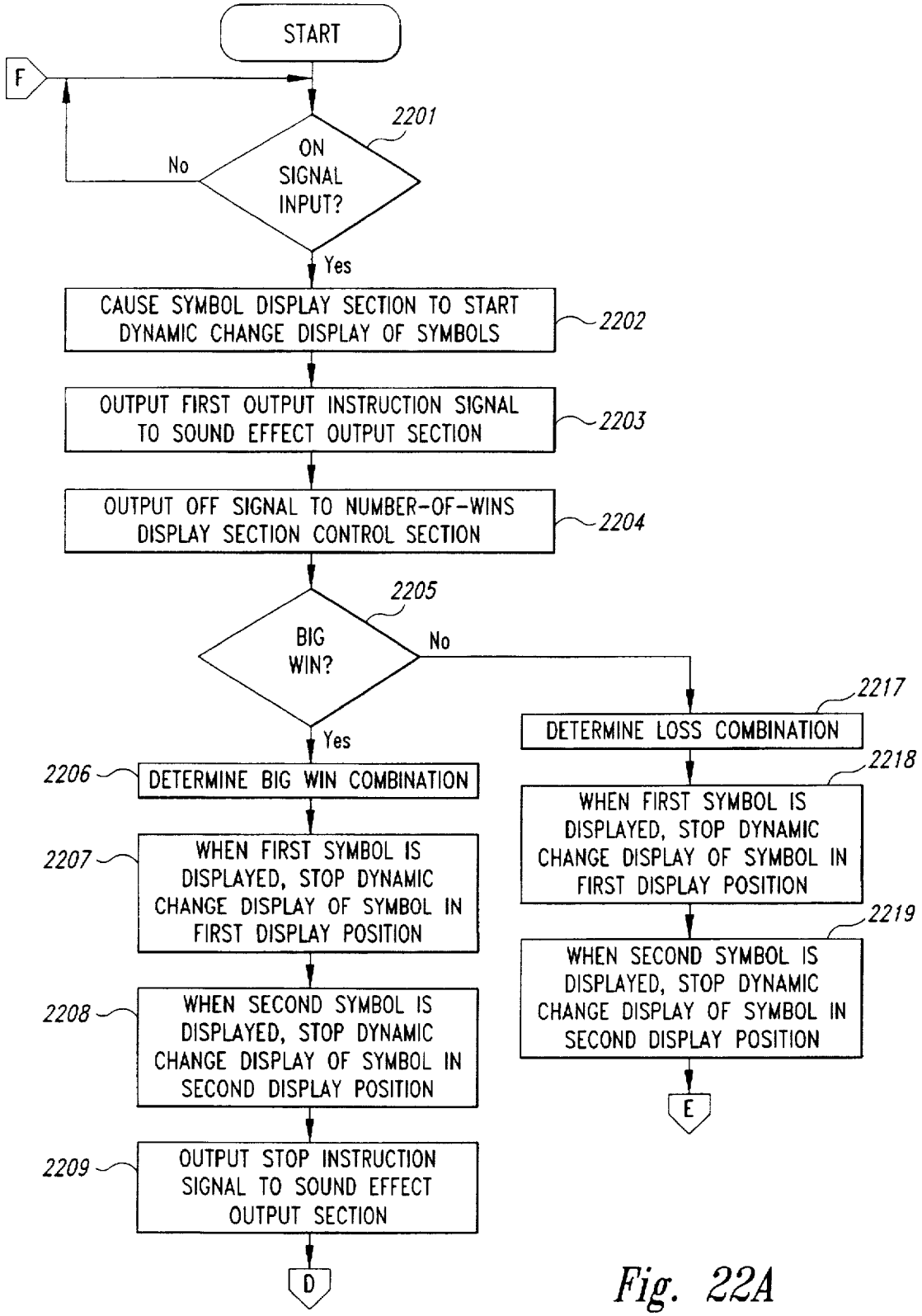
FIGS. 22A and 22B together are a flowchart showing an operation flow of a processor in the symbol display section control section in the operation example.
Figure 22B:
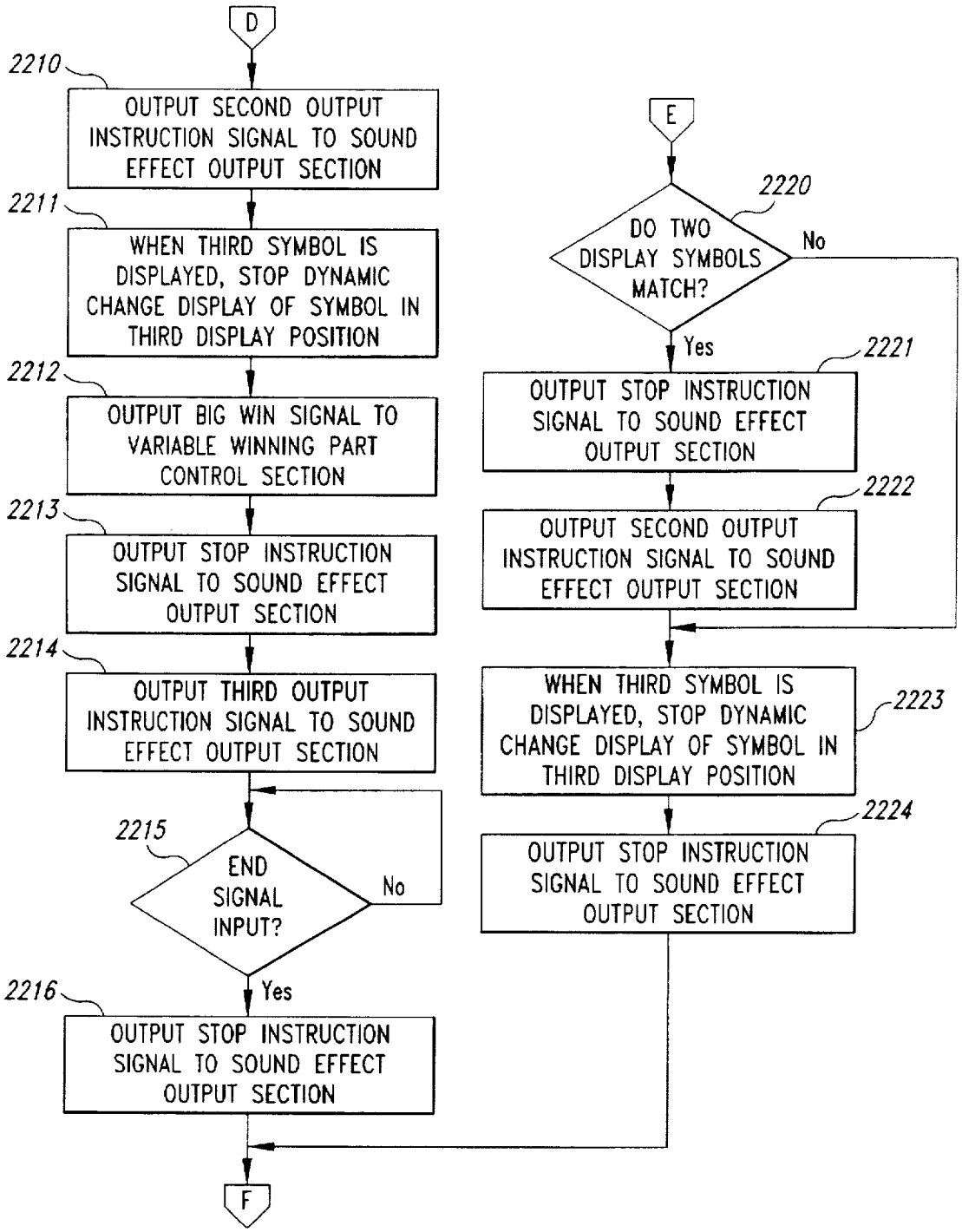

FIGS. 22A and 22B together are a flowchart showing an operation flow of a processor.

As shown in the figure, in the symbol display section control section 1201, when an on signal is output from the number-of-wins display section control section 1204 at step 2201, the processor controls the symbol display section 208 so that the symbol display section 208 starts dynamic change display of symbols in the three display positions at step 2202, and outputs a first output instruction signal indicating an output instruction of a normal sound effect to the sound effect output section 1209 at step 2203, whereby the symbol display section 208 starts dynamic change display of symbols in the three display positions and the sound effect output section 1209 outputs a normal sound effect.

When the dynamic change display of symbols in the three display positions is started, it means that the symbol display section 208 starts the operation for one pachinko ball entering the special winning part 205. Then, the processor outputs an off signal for turning off only one lamp to the number-of-wins display section control section 1204 at step 2204.

Subsequently, the processor determines whether or not a big win should be given at step 2205. If the processor determines that a big win is to be given, it furthermore determines a big win combination at step 2206.

Here, a process of determining whether or not a big win should be given will be discussed.

The processor finds a random number X having a range of 1 to 256 by random number calculation. If the value of the random number X found becomes a predetermined number, for example, 1, the processor determines that a big win should be given; if the value becomes any of 2–256, the processor determines that no big win should be given. The range of the random number X is related to the probability that a big win will be given, which is 1/256 in this example.

Here, a process of determining a big win combination will be discussed.

The processor finds a random number Y having a range of 1 to 16 by random number calculation, and determines any one of the big win combinations stored in the big win table 2101 in response to the value of the random number Y found. That is, if the value of the random number Y becomes 1, the processor determines that the big win combination is "A, A, A," if the value of the random number Y becomes 2, the processor determines that the big win combination is "B, B, B," and if the value of the random number Y becomes 16, the processor determines that the big win combination is "P, P, P."

Subsequently, when a predetermined time or the time found by random number calculation has elapsed, the processor controls the symbol display section 208 so that the symbol display section 208 stops the dynamic change display of the symbol in the first display position at step 2207 when the first symbol in the big win combination determined at step 2206 is displayed, whereby the symbol display section 208 stops the dynamic change display of the symbol in the first display position when the first symbol in the big win combination determined at step 2206 is displayed.

Likewise, when a predetermined time or the time found by random number calculation has elapsed, the processor controls the symbol display section 208 so that the symbol display section 208 stops the dynamic change display of the symbol in the second display position at step 2208 when the second symbol in the big win combination determined at step 2206 is displayed, whereby the symbol display section 208 stops the dynamic change display of the symbol in the second display position when the second symbol in the big win combination determined at step 2206 is displayed.

At this time, since the player comes close to winning, the processor outputs a stop instruction signal indicating a stop instruction of the sound effect output by the sound effect output section 1209 (in this case, a normal sound effect) thereto at step 2209 and outputs a second output instruction signal indicating an output instruction of a sound effect produced when the player comes close to winning to the sound effect output section 1209 at step 2210, whereby the sound effect output section 1209 outputs the sound effect produced when the player comes close to winning.

Subsequently, when a predetermined time or the time found by random number calculation has elapsed, the processor controls the symbol display section 208 so that the symbol display section 208 stops the dynamic change display of the symbol in the third display position at step 2211 when the third symbol in the big win combination determined at step 2206 is displayed, whereby the symbol display section 208 stops the dynamic change display of the symbol in the third display position when the third symbol in the big win combination determined at step 2206 is displayed.

At this time, since the player has a big win, the processor outputs a big win signal indicating the fact that the player has a big win to the variable winning part control section 1205 at step 2212. Also, the processor outputs a stop instruction signal indicating a stop instruction of the sound effect output by the sound effect output section 1209 (in this case, the sound effect produced when the player comes close to winning) thereto at step 2213 and outputs a third output instruction signal indicating an output instruction of a big win sound effect to the sound effect output section 1209 at step 2214, whereby the variable winning part control section 1205 changes the variable winning part 206 to the win enable state and the sound effect output section 1209 outputs the big win sound effect.

Then, the processor waits for an end signal to be output from the variable winning part control section 1205 at step 2215 and outputs a stop instruction signal indicating a stop instruction of the sound effect output by the sound effect output section 1209 (in this case, a big win sound effect) thereto at step 2216 before returning to step 2201.

If the processor determines that a big win is not to be given, it furthermore determines a loss combination at step 2217.

Here, a process of determining a loss combination will be discussed.

The processor finds a random number Z having a range of 1 to 4080 by random number calculation, and determines any one of the loss combinations stored in the loss table 2102 in response to the value of the random number Z found. That is, if the value of the random number Z becomes 1, the processor determines that the loss combination is "A, A, B," if the value of the random number Z becomes 2, the processor determines that the loss combination is "A, A, C," and if the value of the random number Z becomes 4080, the processor determines that the loss combination is "P, P, O."

Subsequently, when a predetermined time or the time found by random number calculation has elapsed, the processor controls the symbol display section 208 so that the symbol display section 208 stops the dynamic change display of the symbol in the first display position at step 2218 when the first symbol in the loss combination determined at step 2217 is displayed, whereby the symbol display section 208 stops the dynamic change display of the symbol in the first display position when the first symbol in the loss combination determined at step 2217 is displayed.

Likewise, when a predetermined time or the time found by random number calculation has elapsed, the processor controls the symbol display section 208 so that the symbol display section 208 stops the dynamic change display of the symbol in the second display position at step 2219 when the second symbol in the loss combination determined at step 2217 is displayed, whereby the symbol display section 208 stops the dynamic change display of the symbol in the second display position when the second symbol in the loss combination determined at step 2217 is displayed.

Although finally the player does not have a big win, he or she may come close to winning depending on the determined loss combination. That is, if a loss combination in which the first and second symbols match is determined, the player comes close to winning.

Then, the processor determines whether or not the display symbols in the two display positions match at step 2220. If both the display symbols match, it means that the player comes close to winning. Then, the processor outputs a stop instruction signal indicating a stop instruction of the sound effect output by the sound effect output section 1209 (in this case, a normal sound effect) thereto at step 2221 and outputs a second output instruction signal indicating an output instruction of a sound effect produced when the player comes close to winning to the sound effect output section 1209 at step 2222, whereby the sound effect output section 1209 outputs the sound effect produced when the player comes close to winning.

Subsequently, when a predetermined time or the time found by random number calculation has elapsed, the processor controls the symbol display section 208 so that the symbol display section 208 stops the dynamic change display of the symbol in the third display position at step 2223 when the third symbol in the loss combination determined at step 2217 is displayed, whereby the symbol display section 208 stops the dynamic change display of the symbol in the third display position when the third symbol in the loss combination determined at step 2217 is displayed.

Last, the processor outputs a stop instruction signal indicating a stop instruction of the sound effect output by the sound effect output section 1209 (in this case, a normal sound effect or sound effect produced when the player comes close to winning) thereto at step 2224 before returning to step 2201.

In the pachinko machine wherein first whether or not the player has a big win is determined and then the symbols to be displayed in the three display positions are determined in response to the determination, the player also has a big win if the display symbols in the three display positions match.

Next, the operation of the gaming control system 4 will be discussed with reference to FIGS. 23–26.

Figure 23:
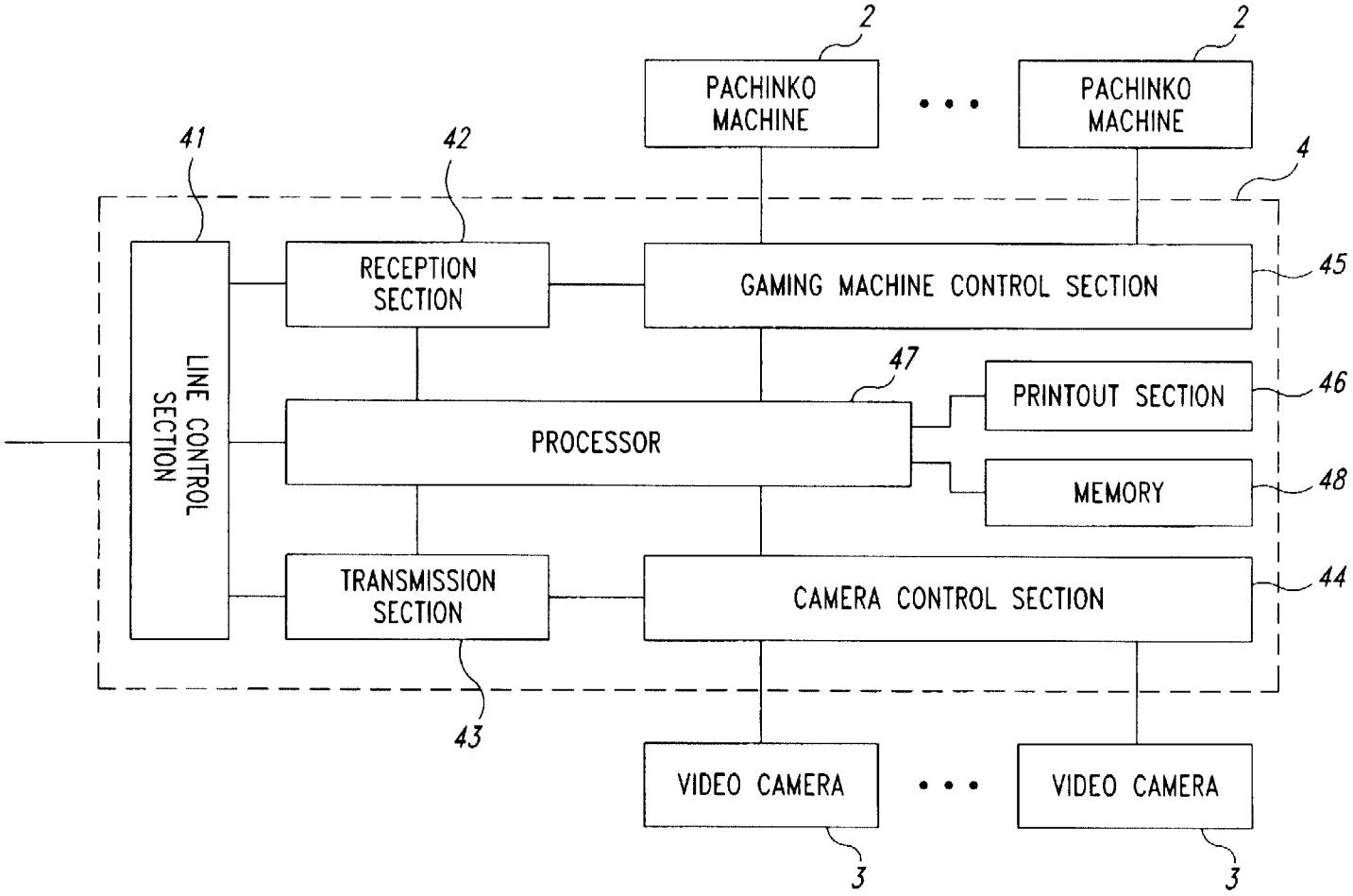
FIG. 23 is an internal block diagram of a gaming control system.

FIG. 23 is an internal block diagram of the gaming control system 4.

As shown in the figure, the gaming control system 4 comprises a line connection section 41 for connecting a communication line between the remote gaming terminal 6 and the gaming control system 4, a reception section 42 for receiving a signal transmitted from the remote gaming terminal 6, a transmission section 43 for transmitting a signal to the remote gaming terminal 6, a camera control section 44 for controlling video cameras 3, a gaming machine control section 45 for controlling the pachinko machines 2, a printout section 46 for printing out the amount of money to be paid from or into player's financial institution accounts, a processor 47 for controlling the operation of the sections, and a memory 48 for storing programs executed by the processor 47.

FIGS. 24A–24C are illustrations showing data stored in the memory 48.

As shown in the figure, the memory 48 always stores a gaming machine information table 2401 for storing information concerning the pachinko machines 2 installed in the pachinko hall 1 and a player information table 2402 for storing information concerning players.

The gaming machine information table 2401 stores the identification numbers and types of pachinko machines 2 for each pachinko machine 2 and idle/busy information indicating whether or not the pachinko machine 2 is being played.

The player information table 2402 stores player information containing the names and financial institution account numbers of players for each player's identification number.

In the embodiment, since the remote gaming terminal 6 is installed at a player's home, the telephone number of the telephone of the player is used as the player's identification number.

Further, prepared in the memory 48 is a game play information table 2403 for storing information concerning game play of the player corresponding to the remote gaming terminal 6 each time the communication line between a remote gaming terminal 6 and the gaming control system 4 is connected.

The game play information table 2403 stores the identification number and player information of the player, the identification number of the pachinko machine 2 played by the player, and the amount of money lost or won with the pachinko machine 2. When the amount of money to be paid from or into the player's financial institution account is printed out by the printout section 46, the game play information table 2403 is erased.

Figure 25A:
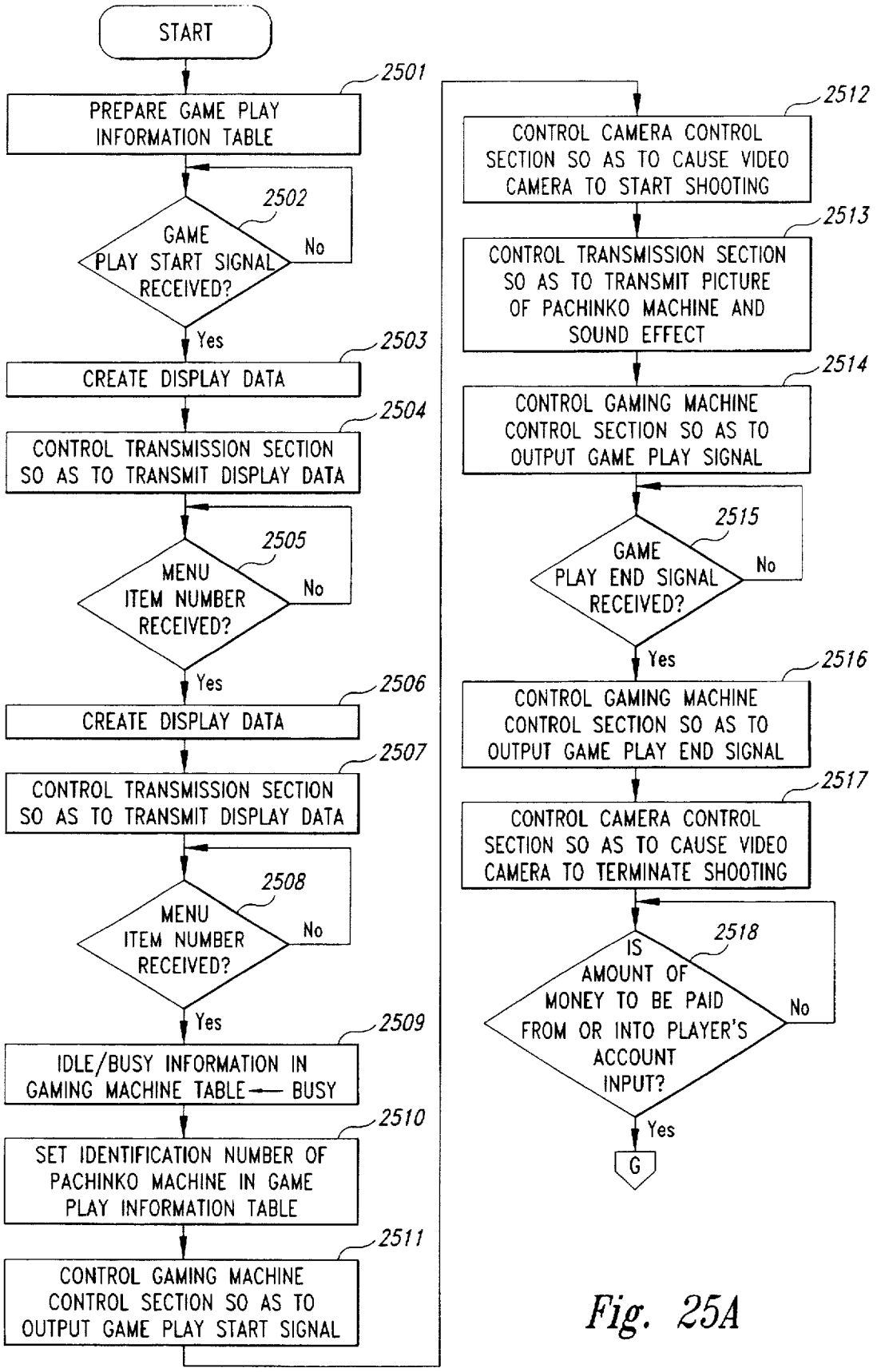
FIGS. 25A and 25B together are a flowchart showing an operation flow of a processor in the gaming control system.
Figure 25B:
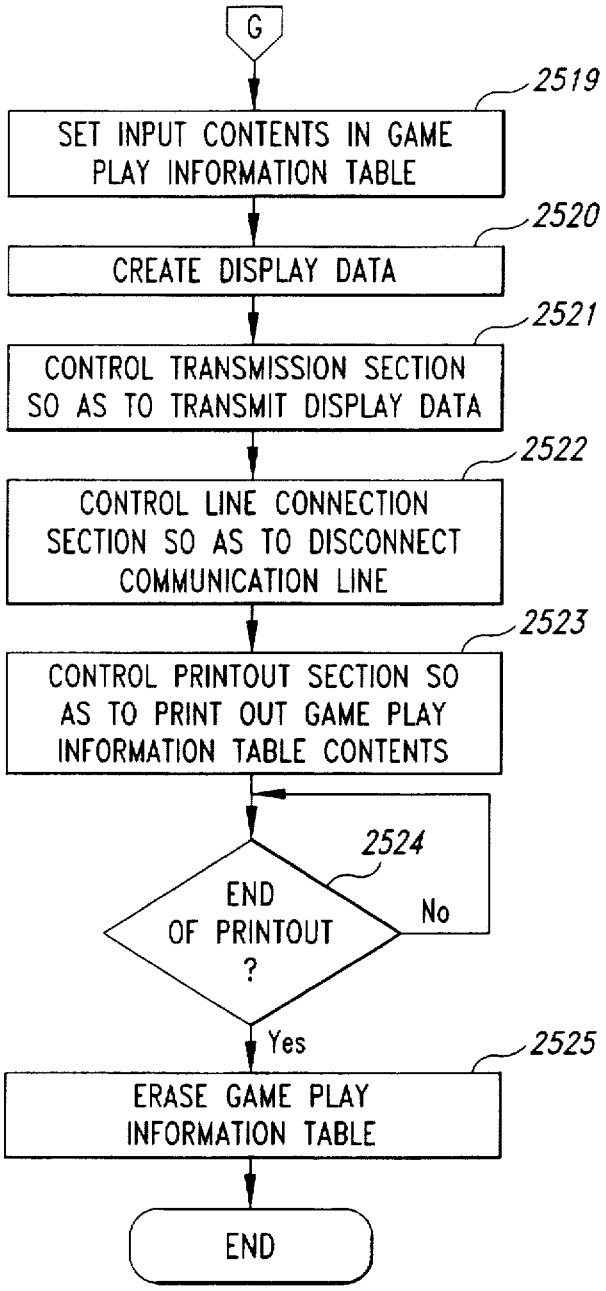

FIGS. 25A and 25B together are a flowchart indicating an operation flow of the processor 47.

As shown in the figure, when a call is originated from a remote gaming terminal 6 and the line connection section 41 connects the communication line between the remote gaming terminal 6 and the gaming control system 4 in response to the originated call, the gaming control system 4 starts the operation.

When the communication line between the remote gaming terminal 6 and the gaming control system 4 is connected, first the telephone number is transmitted from the remote gaming terminal 6, as described above. Then, the processor 47 retrieves the player information corresponding to the identification number of the player in the player information table 2402 based on the telephone number received by the reception section 42, namely, the identification number of the player, and prepares a game play information table 2403 in which the found player information and the identification number of the player are set at step 2501.

Subsequently, when the reception section 42 receives a game play start signal transmitted from the remote gaming terminal 6 at step 2502, the processor 47 looks up in the gaming machine information table 2401, creates display data for displaying the menu shown in FIG. 5 at step 2503, and controls the transmission section 43 so that the transmission section 43 transmits the created display data to the remote gaming terminal 6 at step 2504.

At step 2503, if "Busy" is set in all idle/busy information entries corresponding to the pachinko machines 2 of the type for each of all types stored in the gaming machine information table 2401, the processor 47 does not enter the type on the menu.

Subsequently, when the reception section 42 receives the menu item number transmitted from the remote gaming terminal 6 at step 2505, the processor 47 creates display data for displaying the menu shown in FIG. 6 at step 2506 by referring to the gaming machine information table and controls the transmission section 43 so that the transmission section 43 transmits the created display data to the remote gaming terminal 6 at step 2507.

At step 2506, the processor 47 enters into the menu the identification numbers of the pachinko machines 2 with "Idle" set under the idle/busy information among the pachinko machines 2 of the type corresponding to the menu item indicated by the menu signal received by the reception section 42.

Subsequently, when the reception section 42 receives the menu item number transmitted from the remote gaming terminal 6 at step 2508, the processor 47 changes the idle/busy information for the pachinko machine 2 corresponding to the menu item indicated by the menu item number from "Idle" to "Busy" in the gaming machine information table 2401 at step 2509 and sets the identification number of the pachinko machine 2 in the game play information table 2403 created at step 2501 at step 2510.

Subsequently, the processor 47 controls the gaming machine control section 45 so that the gaming machine control section 45 outputs a game play start signal to the corresponding pachinko machine 2 at step 2511, and controls the camera control section 44 so that the camera control section 44 causes the video camera 3 corresponding to the pachinko machine 2 to start shooting at step 2512. It also controls the transmission section 43 so that the transmission section 43 transmits a picture output through the camera control section 4 from the video camera 3 and a sound effect output through the gaming machine control section 45 from the pachinko machine 2 to the remote gaming terminal 6 at step 2513.

Thus, the picture of the pachinko machine 2 is transmitted to the remote gaming terminal 6 by the transmission section 43 so long as the video camera 3 shoots the corresponding pachinko machine 2. At this point in time, the sound effect is not output through the gaming machine control section 45 from the pachinko machine 2; if the symbol display section 208 operates or the player comes close to winning or has a big win, as described above, after pachinko balls are propelled in the pachinko machine 2, the corresponding sound effect is output. When the sound effect is output, the transmission section 43 multiplexes the sound effect on the picture of the pachinko machine 2.

On the other hand, a game play signal is transmitted from the remote gaming terminal 6 as described above. Then, the processor 47 controls the gaming machine control section 45 so that the gaming machine control section 45 outputs the game play signal received by the reception section 42 to the pachinko machine 2 at step 2514.

Thus, so long as a game play signal is output from the remote gaming terminal 6, it is output to the pachinko machine 2 by the gaming machine control section 45 and as described above, pachinko balls are propelled in the pachinko machine 2.

When the reception section 42 receives a game play end signal transmitted from the remote gaming terminal 6 at step 2515, the processor 47 controls the gaming machine control section 45 so that the gaming machine control section 45 outputs the game play end signal to the pachinko machine 2 at step 2516, and controls the camera control section 44 so that the camera control section 44 causes the video camera 3 corresponding to the pachinko machine 2 to terminate the shooting at step 2517.

The amount and a signal indicating that the amount is to be paid from or into the player's account are output from the pachinko machine 2, as described above. When the gaming machine control section 45 inputs the amount and a signal indicating that the amount is to be paid from or into the player's account at step 2518, the processor 47 sets the input contents of the gaming machine control section 45 in the game play information table 2403 at step 2519.

Subsequently, the processor 47 creates display data for displaying the message shown in FIG. 8(*a*) or (*b*) based on the input contents of the gaming machine control section 45 at step 2520 and controls the transmission section 43 so that the transmission section 43 transmits the created display data to the remote gaming terminal 6 at step 2521.

In detail, if the input of the gaming machine control section 45 contains the amount and a signal indicating that the amount is to be paid from the player's account, it means that the player has lost the cash indicated by the amount. Thus, the processor creates display data for displaying the message shown in FIG. 8(*a*). If the input of the gaming machine control section 45 contains the amount and a signal indicating that the amount is to be paid into the player's account, it means that the player has won the cash indicated by the amount. Thus, the processor creates display data for displaying the message shown in FIG. 8(*b*).

Subsequently, the processor 47 controls the line connection section 41 so that the line connection section 41 disconnects the communication line between the remote gaming terminal 6 and the gaming control system 4 at step 2522.

Last, the processor 47 controls the printout section 46 so that the printout section 46 prints out the contents of the game play information table 2403 at step 2523 and when the printout of the printout section 46 terminates at step 2524, the processor 47 erases the game play information table 2403 at step 2525.

If the reception section 42 receives a game play end signal transmitted from the remote gaming terminal 6 before receiving a game play start signal transmitted therefrom, immediately the processor 47 controls the line control section 41 so that the line control section 41 disconnects the communication line between the remote gaming terminal 6 and the gaming control system 4 although this step is not shown in the flowchart of FIG. 25.

In fact, the gaming control system 4 is connected to a plurality of remote gaming terminals 6 by communication lines at the same time, so that the operation shown in FIG. 25 is performed concurrently for as many pachinko machines 2 as connected at a maximum.

As we have discussed, the pachinko remote gaming system of the embodiment enables the player to use the remote gaming terminal 6 to play the pachinko machine 2 at home without coming to the pachinko hall 1.

Since no players come to the pachinko hall 1, the pachinko hall 1 is free from limitations on the location conditions and does not require an interior fund either. Therefore, it does not need a large amount of money to start up. Since the necessary number of pachinko hall employees can be reduced, the operating funds can also be reduced. Further, since no trouble is given to the people living in the neighborhood of the pachinko hall, the business hours can be drastically prolonged, for example, to round-the-clock business.

We have discussed the example in which the video camera 3 operates in association with the operation of the pachinko machine 2 in the embodiment, but the video camera 3 may always operate. In doing so, the gaming control system 4 need not execute the control process of the video camera 3.

Although we have discussed the embodiment wherein the player presses the end button 616 disposed on the control pad 61 of the remote gaming terminal 6 for quitting the game play, the pachinko hall 1 can also force the player to quit the game play when the number of pachinko balls lost by the player reaches a predetermined value.

In this case, when the number of propelled pachinko balls reaches a predetermined value, the pachinko machine 2 may notify the gaming machine control system 4 of the fact.

Although we have discussed the embodiment wherein the player presses the end button 616 disposed on the control pad 61 of the remote gaming terminal 6 for quitting the game play, after playing one pachinko machine 2, the player might want to play another gaming machine 2 of the same type or a pachinko machine 2 of a different type, namely, change the pachinko machine 2 to be played.

Then, if the player presses the end button 616 once, the menu shown in FIG. 4 may be once displayed on the display 62 of the remote gaming terminal 6 and if the player again presses the end button 616, the game play may be quitted. If the player presses the end button 614, a menu for asking the player whether he or she wants to quit the game play or change the pachinko machine 2 to be played may also be displayed on the display 62 of the remote gaming terminal 6.

Although we have discussed the embodiment wherein the menu shown in FIG. 5 indicates the types of gaming machines 2, the appearance and an explanatory note indicating the gaming method may further be displayed about each type of pachinko machine 2.

Although we have discussed the embodiment wherein the menu shown in FIG. 6 indicates the identification numbers of the pachinko machines 2, the pictures of the pachinko machines 2 can also be displayed on subscreens into which one full screen is divided. In this case, the video cameras 3 need always operate.

Although we have discussed the embodiment wherein the control pad 61 is provided with the loudspeaker 617, the display 62 may be provided with the loudspeaker 617.

Although we have discussed the embodiment wherein the gaming control system 4 is provided with only one as the gaming machine control section 45, one gaming machine control section 45 may be provided for each pair of a pachinko machine 2 and its corresponding video camera 3 or each set of a plurality of pachinko machines 2 and their corresponding video cameras 3.

The gaming control system 4 may also be provided for each pachinko machine 2 or every predetermined number of pachinko machines 2.

We have discussed the embodiment wherein the gaming control system 4 is provided with the printout section 46 for printing out the amount of money to be paid from or into player's financial institution accounts (contents of the game play information table 2403). However, in addition to or instead of it, the contents of the game play information table 2403 may be transmitted to another host via a public communication network or a leased line.

This enables an office for managing the amount of money to do business at a different location from the pachinko hall 1.

We have discussed the example in which the remote gaming terminal 6 is installed at a player's home. However, for example, it may be installed in each room of a no-frills hotel for businessmen.

In this case, the no-frills hotel may enter into a gaming contact with the pachinko hall 1 and transfer cash to and from lodgers who play the pachinko machines.

Figure 26:
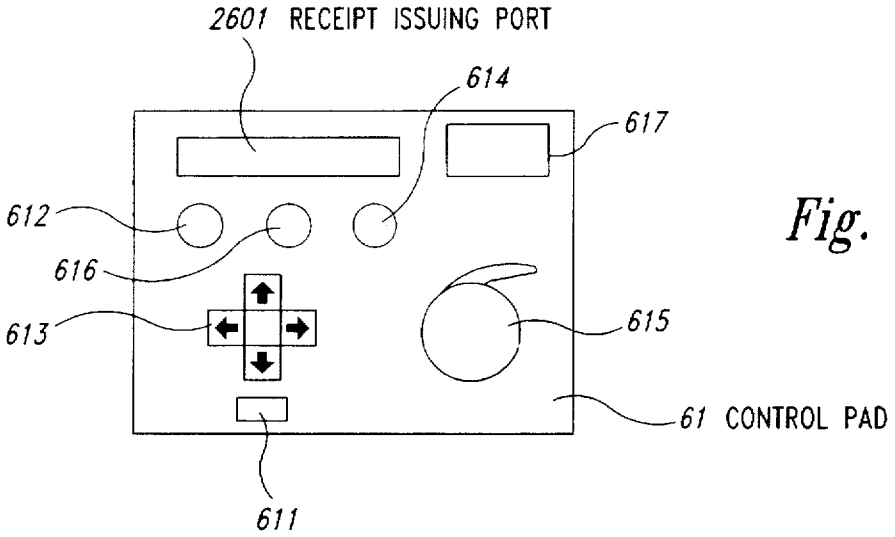
FIG. 26 is an illustration showing another example of the control pad of the remote gaming terminal.

We have discussed the embodiment wherein the amount of money lost or won by each player is paid from or into his or her financial institution accounts. However, for example, the following facilities may be provided:

A special telephone number allowing an extra charge to be collected together with the public communication network charge like dial $Q^2$ is used as the telephone number of the pachinko hall 1 called by a player who wants to play a pachinko machine 2, whereby the amount of money lost by the player is collected by the enterprise of the public communication network 5 instead of the pachinko hall 1. In this case, the pachinko hall 1 needs to previously contract with the enterprise of the public communication network 5. For the amount of money won by the player, as shown in FIG. 26, a receipt issuing port 2601 is made in the control pad 61 of the remote gaming terminal 6 and the amount of money won is printed out on a receipt. Later, the player brings the receipt to money exchange window or booth placed at various locations for exchanging the receipt for money. If the pachinko hall 1 previously contracts with a financial institution, the financial institution can also serve as the money exchange windows or booths instead of the pachinko hall 1.

Further, products or securities equivalent to the amount of money won by the player can also be distributed to player's home.

In this case, the player may select a product, equivalent to the amount of money won, out of a provided catalog, notify the pachinko hall 1 of the selected product, and later receive the product distributed from the pachinko hall 1. If the pachinko hall 1 previously contracts with a mail-order dealer, a catalog for mail-order selling provided by the mail-order dealer can also be used.

As we have discussed, the pachinko remote gaming system of the embodiment enables the players at distant locations to play pachinko machines.

Then, the player can play games as he or she likes whenever he or she wants to play without coming all the way to a pachinko hall. Since the pachinko hall is free from limitations on the location conditions and players do not actually come to the pachinko hall, the pachinko hall does not require an interior fund or can reduce the number of employees. Therefore, it becomes easy to run the pachinko hall.

Another embodiment of the pachinko remote gaming system according to the invention will be discussed.

This embodiment comprises a pachinko ball detection system for detecting motion of a pachinko ball (time position change) in a pachinko machine placed at a distant location and sends data on a position change of the pachinko ball via a communication line to a remote gaming terminal, which then generates image data showing how a game is played from the data.

The embodiment that we will discuss covers use of pachinko machines, but is not limited to it. As with the embodiment, the invention can be applied to any gaming machines if the gaming machines can be remotely operated and enable detection of a game play condition.

Figure 27:
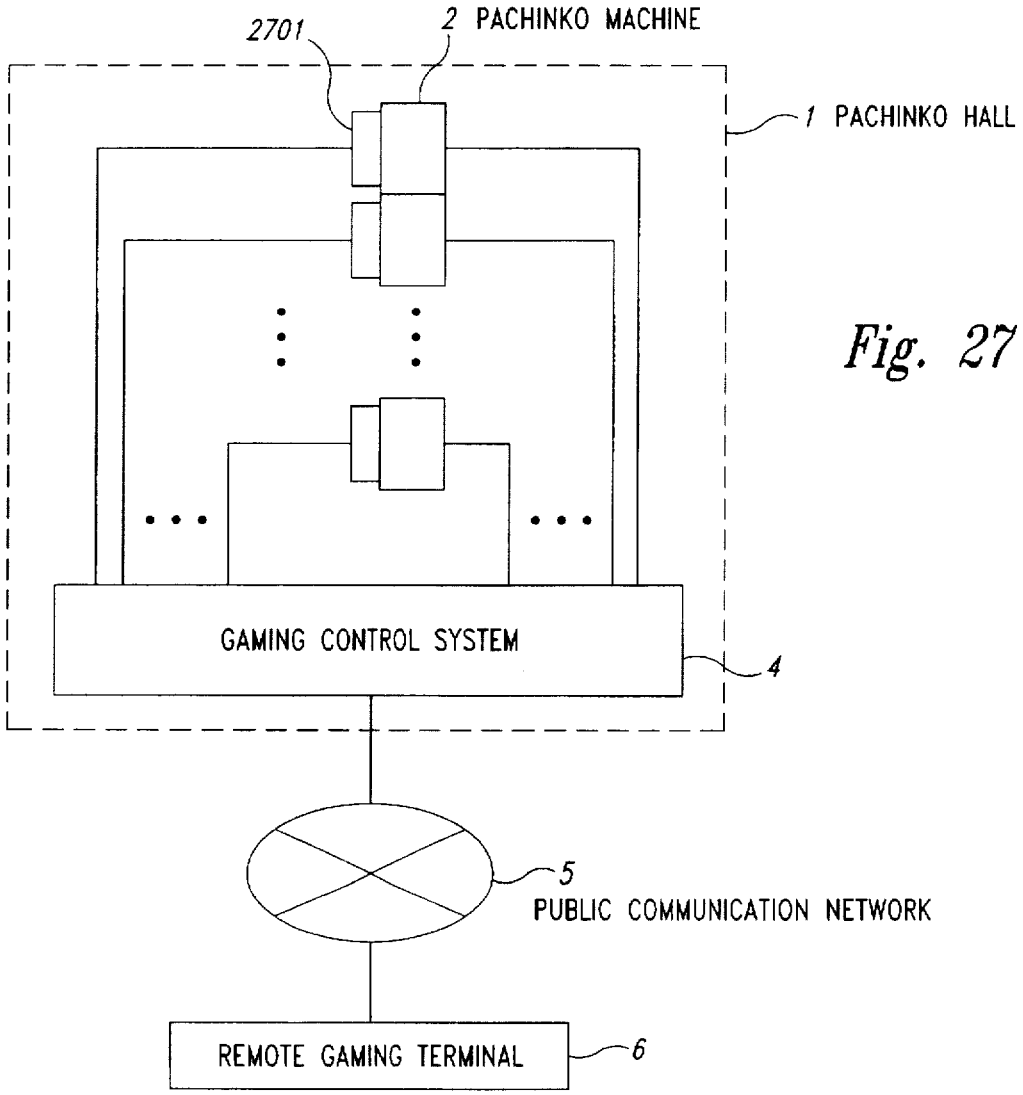
FIG. 27 is a block diagram of another embodiment of the pachinko remote gaming system.

As shown in FIG. 27, the embodiment has pachinko machines 2 placed in a pachinko hall 1 and played by players and pachinko ball detection systems 2701 each for successively detecting positions of pachinko balls on a gaming board 200 (see FIG. 2) in the corresponding pachinko machine 2.

The pachinko machine 2 of the embodiment has the same configuration and function as that of the first embodiment (see FIG. 2) and will not be discussed again.

A player does not face the pachinko machine 2 of the embodiment for operating it. Thus, components not directly involved in gaming, such as illumination and a sound effect system usually used to arouse the gaming atmosphere, can be omitted.

Further, since the player does not directly see the shape, appearance, decoration, etc., of the pachinko machine 2 of the embodiment, the composition not related to basic conditions required for gaming need not be considered.

In the embodiment, the player sees an image generated based on data on motion of pachinko balls detected by the pachinko ball detection system 2701 and displayed on a display of a remote gaming terminal 6 as described later and operates the machine.

Thus, in the embodiment, the lighting effect arousing the gaming atmosphere such as decoration blinking when a pachinko ball enters a predetermined winning hole as in conventional pachinko machines is contained in the image data by predetermined data processing based on game play data from the pachinko machine 2. Likewise, sound data is also generated for producing the sound effect from a sound system installed in the gaming terminal.

The pachinko ball detection system 2701 uses a matrix sensor installed so as to cover the gaming board 200 of the pachinko machine 2 to detect the positions of pachinko balls on the gaming board 200 in a predetermined cycle. The configuration of the pachinko ball detection system 2710 will be discussed later in detail.

The embodiment further includes a gaming control system 4 and a remote gaming terminal 6 having a similar configuration and function to those of the first embodiment.

Figure 28:
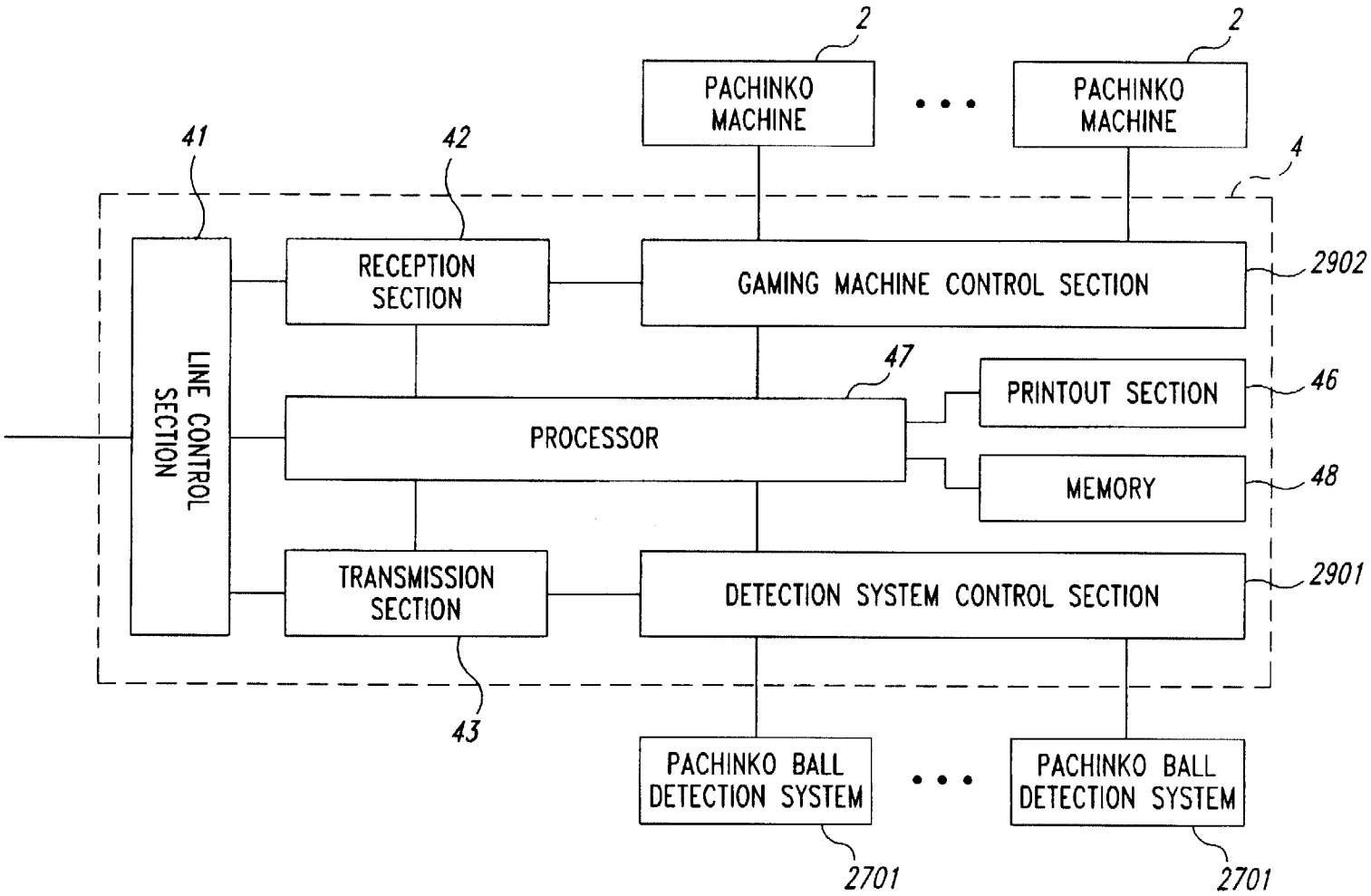
FIG. 28 is a block diagram of another example of the gaming control system.

As shown in FIG. 28, the gaming control system 4 has a detection system control section 2901 for controlling the operation of the pachinko ball detection systems 2701 and collecting their detection data in place of the camera control section and a gaming machine control section 2902 for controlling the operation of the pachinko machines 2 and detecting conditions of winning parts made in the gaming board 200, dynamic change conditions of symbols, and game play conditions of coming-close-to-winning and big win events, etc.

Other components contained in the gaming control system 4 provide the same functions as those in the first embodiment. The components identical with those previously described in the first embodiment are denoted by the same reference numerals in the embodiment and will not be discussed again.

The gaming control system 4 of the embodiment collects data indicating game play conditions of each pachinko machine 2 remotely operated, such as the positions of pachinko balls detected by the pachinko ball detection system 2701 and conditions of the winning parts, and transmits the data to the corresponding remote gaming terminal 6 connected to the gaming control system 4 by a communication network 5.

The data concerning the pachinko ball positions in the transmitted data changes rapidly and thus is preferably updated in a cycle as similar to the position detection cycle as much as possible. The data concerning the conditions of the winning parts of the pachinko machine 2, etc., changes slowly compared with the pachinko ball position data, and is updated in a longer cycle. Alternatively, only when the condition of each winning part changes, the updated data corresponding to the change condition maybe sent.

The embodiment uses a public communication network as the communication network 5; in addition, it can use a wideband communication network such as an ISDN line network, a telephone line network, or a facsimile dedicated line, a cable television line network, a high-speed digital transmission service line network, etc. A telephone line service like dial $Q^2$ can also be used.

Figure 29:
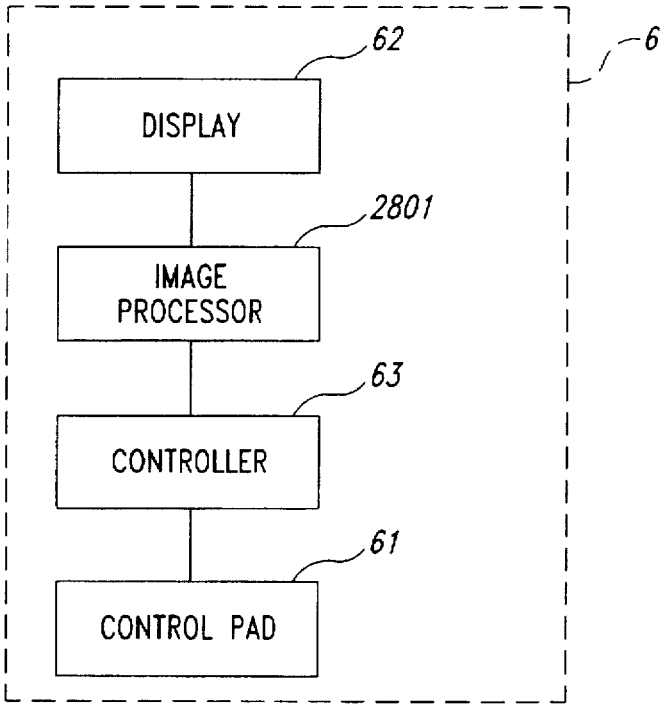
FIG. 29 is a block diagram of another example of the remote gaming terminal.

As shown in FIG. 29, the remote gaming terminal 6 has an image processor 2801 for generating image data indicating a game play condition based on pachinko ball position data, game play condition data, etc., sent via the gaming control system 4 and the communication network 5, a display 62 for displaying the image data, a control pad 61, and a controller 63.

The control pad 61 and the controller 63 basically have the same configuration and function as those in the first embodiment and will not be discussed again in detail.

Figure 30:
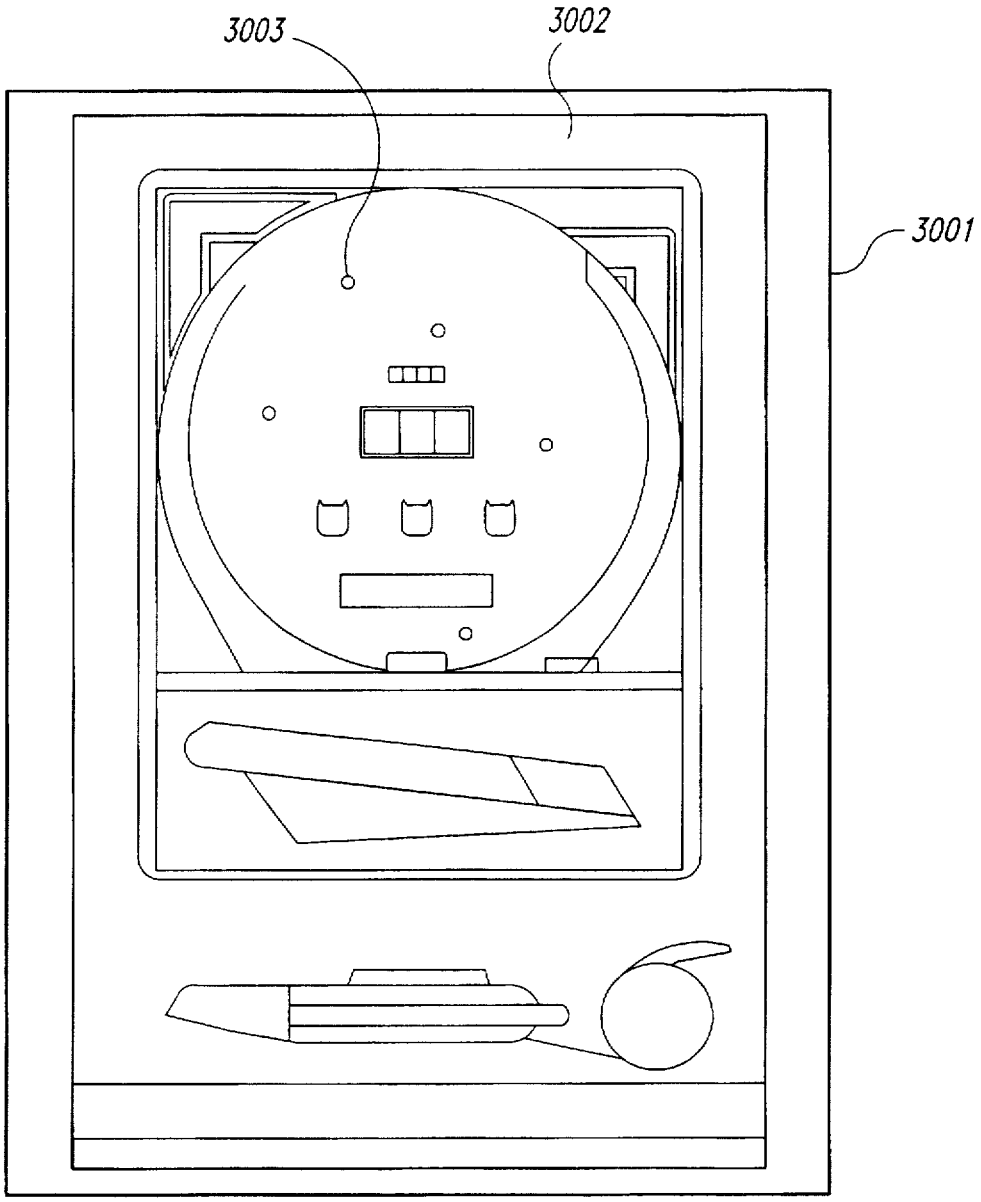
FIG. 30 is an illustration of an example of a display screen.

The image processor 2801 generates image data for displaying symbols 3003 indicating pachinko ball positions superposed on a background display 3002 indicating the conditions of the winning parts on the gaming board 200 of the pachinko machine 2 on a display screen 3001 of the display 62, for example, as shown in FIG. 30.

The background display 3002 is generated based on the winning part conditions, symbol change conditions, etc., in the pachinko machine 2 sent via the communication line, and the pachinko ball symbol 3003 is displayed at positions on the display screen 3001 corresponding to the pachinko ball position data sent via the communication line, superposed on the background display 3002 so that the time-varying pachinko ball positions are shown for the player as a reasonably continuous change, namely, as a moving picture.

Further, the parts disposed on the pachinko machine 2 as shown in FIG. 2 may be displayed in an image as the background display 3002. The image processor 2801 may be provided with storage means in which a plurality of image forms that can be displayed, for example, those different in colors and forms of components with the same basic placement of the winning parts and other components are stored; the player may select one of the image forms.

Figure 31:
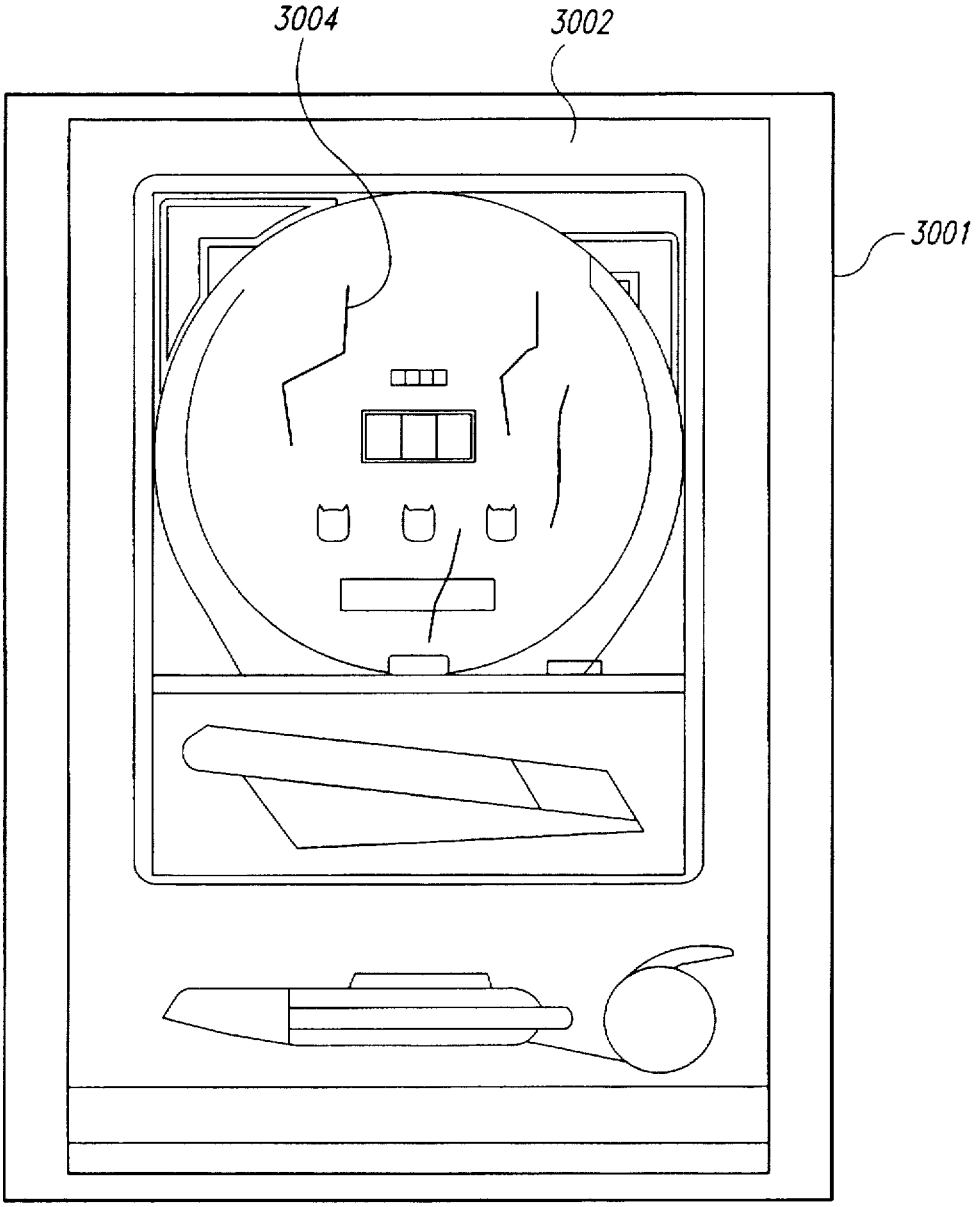
FIG. 31 is an illustration of another example of the display screen.

To display pachinko balls, instead of displaying the positions directly, a pachinko ball move path 3004 may be calculated from the position data sent by the image processor 2801 and be displayed, for example, as shown in FIG. 31. In doing so, pachinko ball motion can be shown more clearly.

The display 62, which displays a still or moving picture as described above, can be provided by LEDs, incandescent lamps, neon tubes, CRT, EL (electro luminescence) devices, liquid crystal devices, electrochromic devices, plasma devices, etc.

In the embodiment, the display 62 is provided by a liquid crystal display panel, which comprises a liquid crystal layer of TN liquid crystal, STN liquid crystal, macro-molecular dispersion liquid crystal PDLC, ferroelectric liquid crystal FLC, or the like sandwiched between oriented paired glass substrates and a pair of deflection plates disposed on the outsides thereof.

Further, one liquid crystal display panel may be divided into subpanels for providing a plurality of virtual display panels. At this time, any display portion may be able to be selected from among the predetermined virtual display panels as instructed by the player.

This enables the player to selectively display only the portion to which he or she wants to give attention. That is, the player sees pachinko ball motion in the noted region in the image corresponding to the gaming board 200 of the pachinko machine 2 and changes the manipulation amount of a handle for controlling the ball propelling strength, etc., while strategically thinking about the propelling position and ball path, thereby obtaining a high gain.

That is, a highly amusing, powerful, and enjoyable game with similar features to a video game is added to the former game playing situation.

In the embodiment, pachinko balls are made essentially of Fe. Further, to enhance the detection sensitivity of the pachinko ball detection system described later, a ferromagnetic substance of Ni, Co, Mn, Mo, Gd, Dy, EuO, etc., and an alloy of the ferromagnetic substances with nitride, carbide, oxide, boride, silicide are used with the essential material metal. An alloy with ferroceramics of Y3Fe3013YIG, etc., may be used. Well known pachinko balls may be used, of course.

Next, an example of the pachinko ball detection system 2701 will be discussed. It uses a matrix sensor to detect an electromagnetic effect produced by the presence of a pachinko ball, but the pachinko ball detection system that can be used in the invention is not limited to it. For example, a system may be used which applies light to the gaming board 200 and optically detects light reflection or transmission caused by the presence of a pachinko ball, thereby detecting the position of the pachinko ball.

Figure 32:
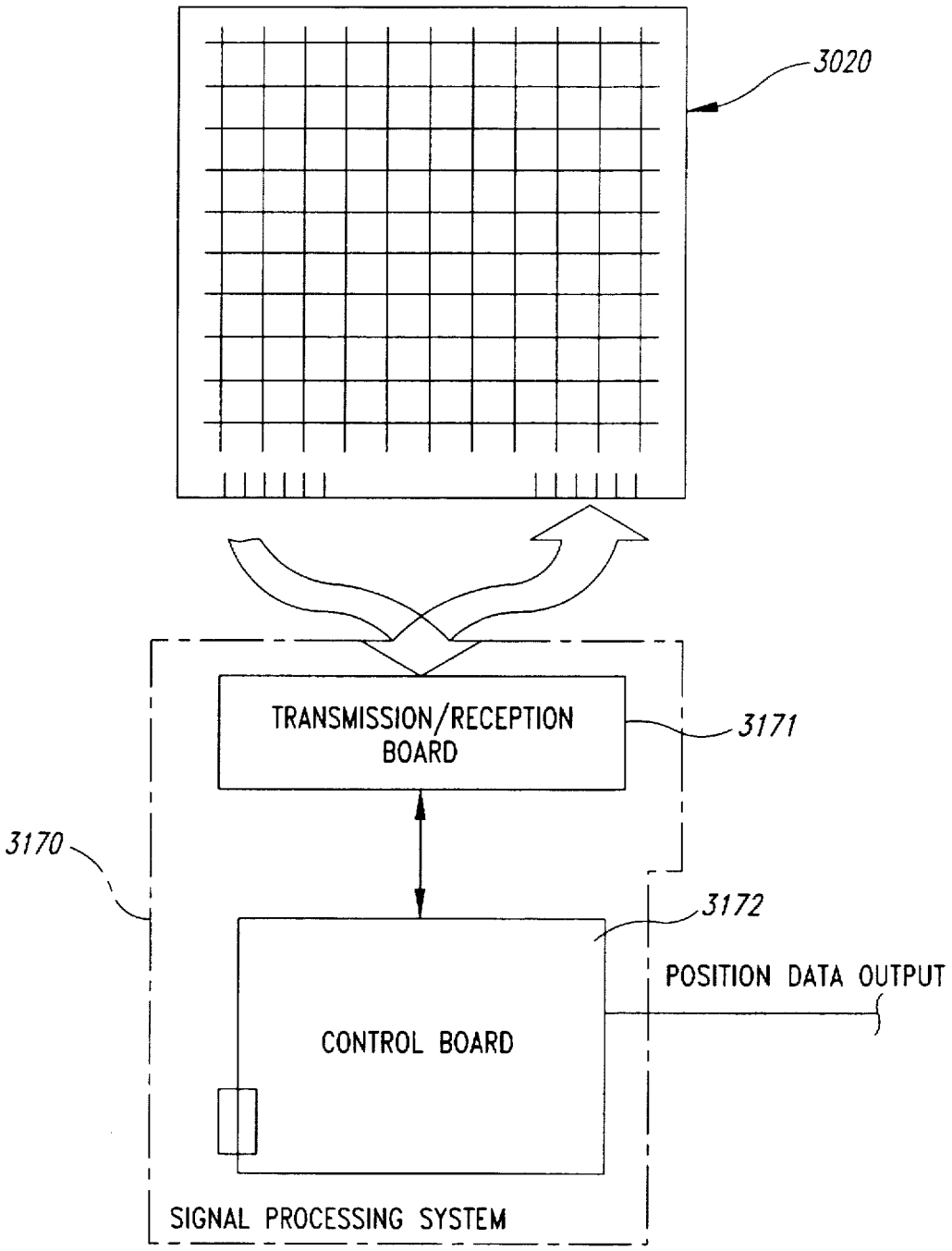
FIG. 32 is a block diagram of an example of a pachinko ball detection system.

The pachinko ball detection system of the embodiment comprises a matrix sensor 3020 having a detection area spreading like a plane and functioning as a metal sensor and a signal processing system (signal processor) 3170 which drives the matrix sensor 3020 for sensing the presence of a pachinko ball and detecting the position thereof, as shown in FIG. 32.

Figure 33:
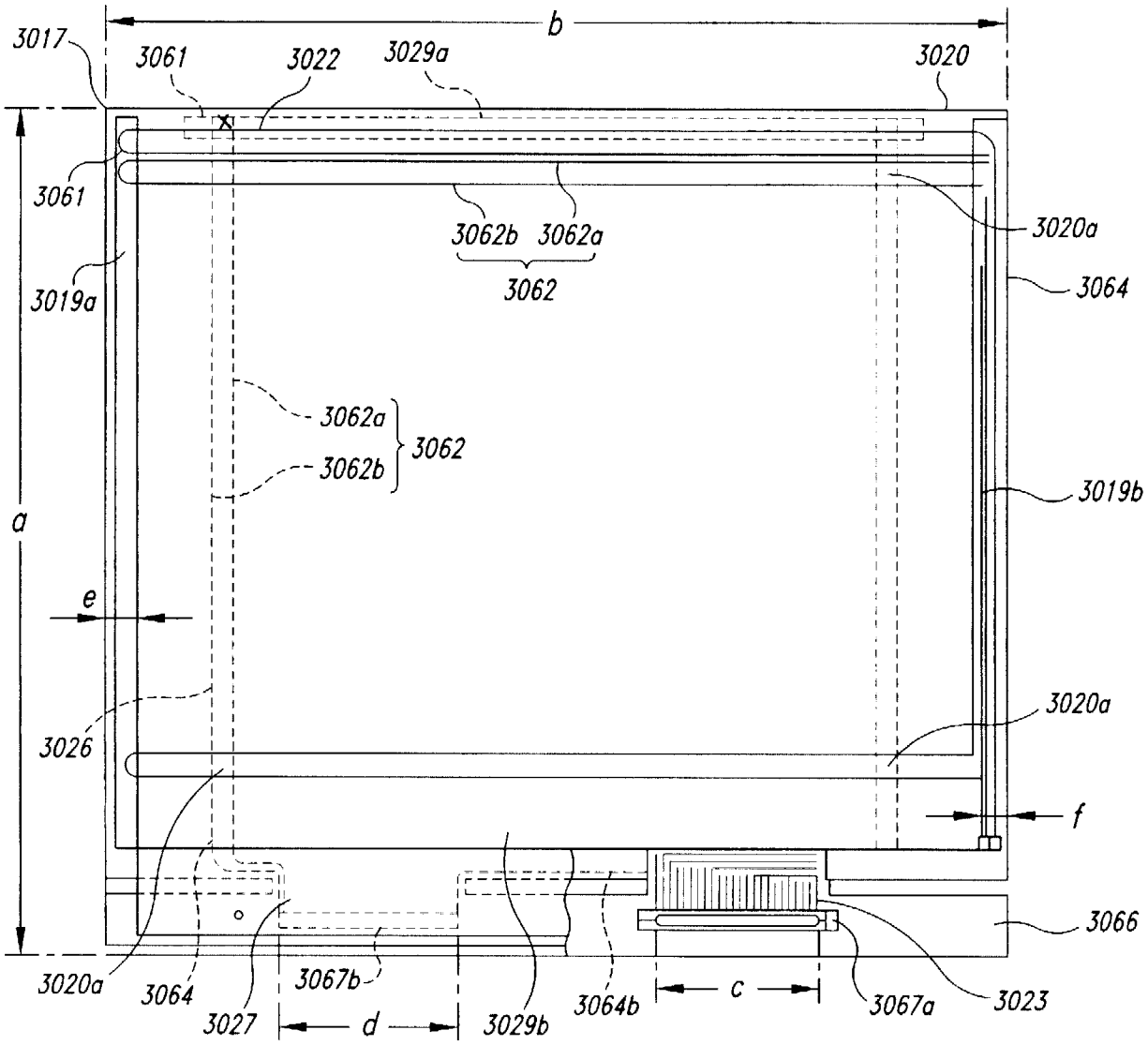
FIG. 33 is a diagram of the configuration of an example of a matrix sensor.

The matrix sensor 3020 has a plurality of transmission lines 3022, a plurality of reception lines 3026, and a board for supporting the lines, as shown in FIG. 33. Each of the transmission lines 3022 consists of a pair of conductors 3062 forming a going way **3062*a* and a returning way 3062*b*, which are parallel to each other. Likewise, each of the reception lines 3026 consists of a pair of conductors 3062 forming a going way 3062*a* and a returning way 3062*b* which are parallel to each other. In the embodiment, the conductor 3062 is made of copper wire coated with polyurethane for insulation, for example. A pair of the conductors 3062** comprises a going way and a returning way connected at one end and serving as input and output terminals of a signal at the other end.

The transmission lines 3022 and the reception lines 3026 are placed so as to cross each other. Specifically, for example, the transmission lines 3022 are arranged at given intervals in a row direction and the reception lines 3026 are arranged at given intervals in a column direction. The transmission lines 3022 and the reception lines 3026 are placed in such a manner as to provide the intersections of the transmission lines 3022 and the reception lines 3026 like a matrix as sensing regions. Either the transmission lines 22 or the reception lines 26 may be placed in the row or column direction as desired.

The signal processing system 3170 has a transmission/reception board 3171 functioning as transmission/reception means for driving the matrix sensor 3020 and a control board 3172 functioning as signal processing means for controlling the transmission/reception board 3171 for receiving a detection signal and determining whether or not a pachinko ball exists based on the detection signal and detecting the pachinko ball sensing position when a pachinko ball exists.

The transmission/reception board 3171 has a transmission circuit 3040 (see FIG. 34) for scanning the specified lines of the transmission lines 3022 in sequence and sending a transmission signal thereto and a reception circuit 3050 (see FIG. 35) for scanning the specified lines of the reception lines 3026 in sequence and reading reception signals of the reception lines in sequence, as described below.

The control board 3172 specifies the transmission and reception lines to be scanned for the transmission/reception board 3171, determines whether or not a pachinko ball exists from a signal received at the reception circuit 3050, and detects the pachinko ball sensing position based on information indicating the transmission line scanning position at the transmission circuit 3040 and information indicating the reception line scanning position at the reception circuit 3050.

The control board 3172 can store information indicating the presence position of a pachinko ball in time sequence for finding the movement path of the pachinko ball. From the movement path, the characteristics of the pachinko machine can be known and an abnormal path can also be detected for judging whether or not illegal operation has been performed.

Next, the matrix sensor 3020 will be described in more detail.

Figure 36:
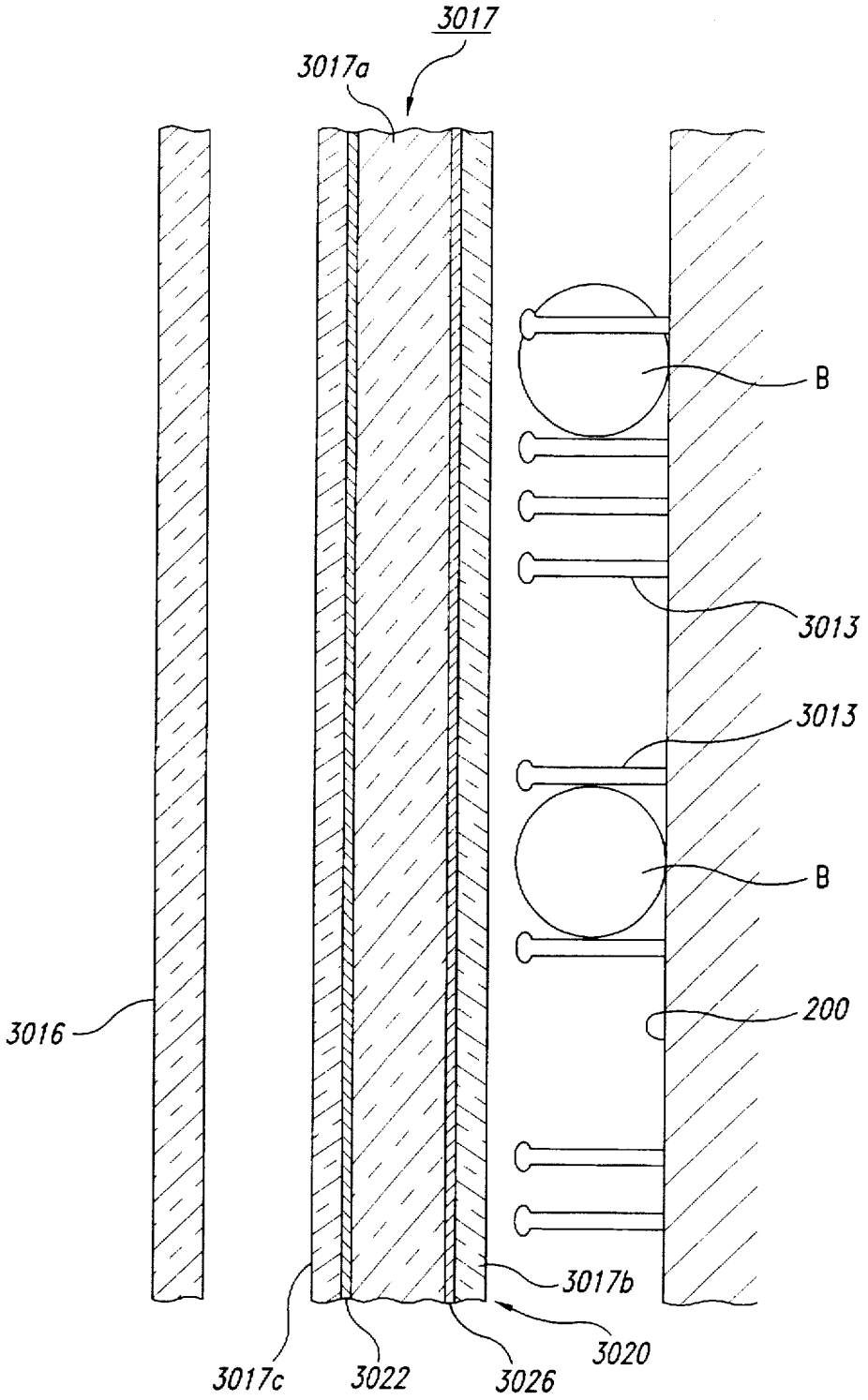
FIG. 36 is a sectional view showing the positional relationship between a base board of the pachinko machine and the matrix sensor.

As shown in FIG. 36, the matrix sensor 3020 is formed like a plane within an inner glass substance 3017, which is on the side of the base board 200, of the two glass substances covering the base board 200, and is therefore disposed between a front glass substance 3016 and the base board 200.

As shown in FIG. 33, in the matrix sensor 3020, the transmission lines 3022 are placed on one face (on the side of the surface glass) of a glass substrate 3017*a* of the inner glass substance 3017 in parallel in one direction. Each transmission line 3022 is located on the glass substrate 3017*a* so as to make a U-turn at the end of the glass substrate 3017*a*.

Likewise, the reception lines 3026 are placed on the opposed face (on the side of the base board 200) of the glass substrate 3017*a* of the inner glass substance 3017 in parallel in one direction. Each reception line 3026 is located on the glass substrate 3017*a* so as to make a U-turn at the end of the glass substrate 3017*a*. A transmission terminal section 3023 and a reception terminal section 3027 functioning as connection sections of the transmission lines 3022 and the reception lines 3026 are placed collectively on the lower end of the inner glass substance 3017 in top and bottom relation when the matrix sensor is mounted on a pachinko machine.

The reception lines 3026 are located at right angles to plane parallel positions with the transmission lines 3022 so as to be electro-magnetically coupled with the transmission lines 3022, namely, having a positional relationship such that a magnetic flux from the transmission line 3022 interlinks. The transmission lines 3022 and the reception lines 3026 with the inner glass substance 3017 as a substrate make up the plane matrix sensor 3020.

As shown in FIG. 33, detection positions which are square portions surrounded by the transmission lines 3022 and the reception lines 3026 crossing each other, provide sensing units 3020*a*, 3020*a*, . . . for sensing a pachinko ball. In the embodiment, the sensing unit 3020*a* is set to a size being capable of sensing a pachinko ball.

To form the inner glass substance 3017, the transmission lines 3022 are bonded to one face of the glass substrate 3017*a* with an adhesive layer and a surface glass 3017*c* is bonded thereon with an adhesive layer; the reception lines 3026 are bonded to the other face of the glass substrate 3017*a* with an adhesive layer and a surface glass 3017*b* is bonded thereon with an adhesive layer.

A turn substrate 3019*a* and a transmission route substrate 3019*b* like a letter L are disposed in the left end part and right end part, respectively, on one face of the glass substrate 3017*a*. A turn substrate 3029*a* and a route substrate 3029*b* are disposed in the upper end part and lower end part, respectively, on the other face of the glass substrate 3017*a*.

Each of the transmission lines 3022 consists of a turn part 3061 formed on the turn substrate 3019*a* and wires 3062*a* and 3062*b* soldered to the turn part 3061. The input and output terminals of the transmission line 3022 are connected via route wires to the transmission terminal section 3023.

On the other hand, each of the reception lines 3026 consists of a turn part 3061 formed on the turn substrate 3029*a* and wires 3062*a* and 3062*b* soldered to the turn part 3061. The lower end part of the reception line 3026 is connected to the reception terminal section 3027 by a route part 3064 formed on the route substrate 3029*b* bonded to the lower end of the other face of the glass substrate 3017*a*.

A preferred pattern of the matrix sensor 3020 of a normal pachinko machine 2 consists of 32 rows of transmission lines 3022 and 32 columns of reception lines 3026, namely, 1024 sensing units 3020*a* in total. The embodiment takes the pattern of the 32 rows of the transmission lines 3022 and 32 columns of the reception lines 3026 as an example. In FIG. 33, only peripheral parts of the pattern are shown.

The matrix sensor 3020 is formed with a connector mounting plate 3066 in the lower end part of the glass substrate 3017*a*. The connector mounting plate 3066 has both sides between which the lower end of the glass substrate 3017*a* is sandwiched, and is integral with the inner glass substance 3017. The connector mounting plate 3066, which is made of plastic or stainless material, extends downward along the width of the inner glass substance 3017 and is on an extension plane of the inner glass substance 3017 of the matrix sensor 3020.

A transmission connector 3067*a* and a reception connector 3067*b* are fixed to the positions of the connector mounting plate 3066 corresponding to the transmission terminal section 3023 and the reception terminal section 3027. The terminals of the transmission terminal section 3023 and the reception terminal section 3027 are connected via the transmission and reception connectors to the transmission circuit 3040 and the reception circuit 3050.

The connector mounting plate 3066 has the thickest portions in which the transmission connector 3067*a* and the reception connector 3067*b* are mounted. On the other hand, the transmission connector 3067*a* and the reception connector 3067*b* are short and the thickest portion of the connector mounting plate 3066 is as thick as or thinner than the inner glass substance 3017 of the matrix sensor 3020.

The transmission/reception board 3171 (see FIG. 32) connected to the transmission connector 3067*a* and the reception connector 3067*b* is placed on the connector mounting plate 3066. The transmission/reception board 3171 has the transmission circuit 3040 (see FIG. 34) for transmitting signals to the transmission lines 3022 of the matrix sensor 3020, the reception circuit 3050 (see FIG. 35) for receiving signals from the reception lines 3026, and junction connectors (not shown) connected to the transmission connector 3067*a* and the reception connector 3067*b*.

The junction connectors are connected to the transmission connector 3067*a* and the reception connector 3067*b* for connecting the transmission terminal section 3023 to the transmission circuit 3040 and the reception terminal section 3027 to the reception circuit 3050.

Next, the signal processing system which processes signals of the matrix sensor 3020 will be discussed.

As shown in FIG. 32, the matrix sensor 3020 is placed under the control of the control board 3172 spaced from the matrix sensor 3020 via the transmission/reception board 3171. The control board 3172 has an information processor 3030 shown in FIG. 37. It is connected to the detection controller 2901 in the gaming control system 4 and outputs detected position data. The information processor 3030 has at least a central processing unit (CPU) 3030*a* and a memory 3030*b* for storing CPU programs and data such as detected pachinko ball position data.

The transmission circuit 3040 is a circuit for transmitting a signal of a predetermined frequency to each transmission line 3022 in sequence. The reception circuit 3050 is a circuit for receiving a signal from each reception line 3026 in sequence in synchronization with the transmission circuit 3040. For example, a continuous sine wave of frequency 1–1.3 MHz centering on 0 V is used as a voltage waveform applied to the transmission line 3022 by the transmission circuit 3040.

Figure 34:
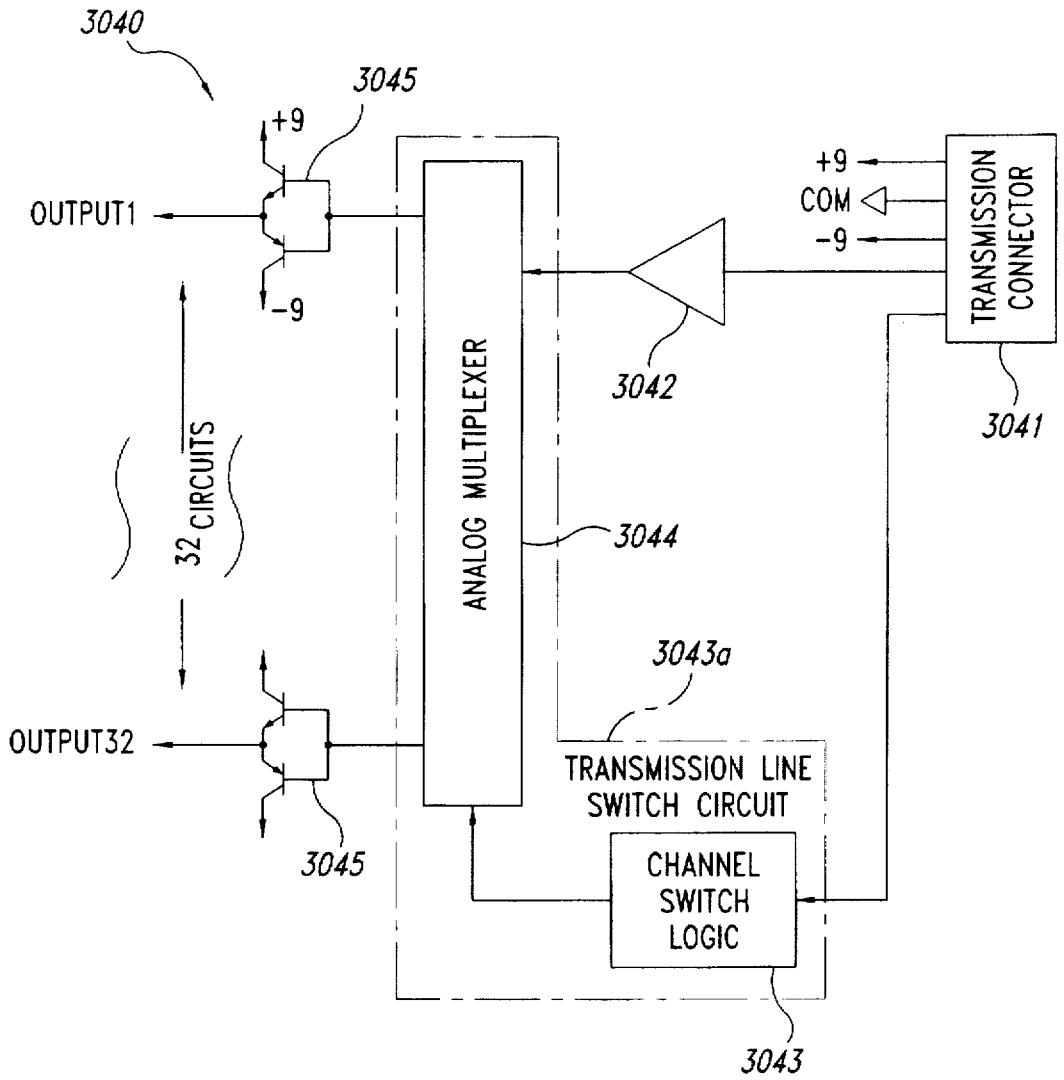
FIG. 34 is a block diagram of an example of a transmission circuit.

As shown in FIG. 34, the transmission circuit 3040 consists of a transmission connector 3041, an amplifier 3042 connected to the transmission connector 3041, a transmission line switch circuit 3043*a* for switching the transmission line to which a signal current is to be transmitted in sequence each time a transmission line switch pulse is input, and 32 drivers 3045 each connected to one end of each of the 32 transmission lines 3022 via the transmission connector 3067*a*. The transmission line switch circuit 3043a has a channel switch logic 3043 and an analog multiplexer 3044 being connected to the amplifier 3042 and the channel switch logic 3043 for switching so as to connect the amplifier 3042 to the driver 3045 corresponding to the specified transmission line 3022. Each driver 3045 comprises an NPN transistor and a PNP transistor, which have emitters connected to each other and bases connected to each other.

Figure 38:
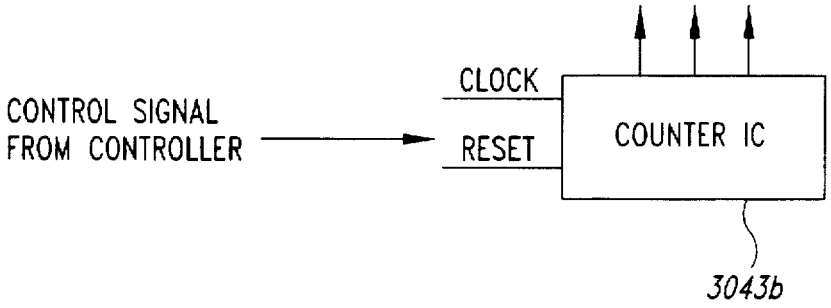
FIG. 38 is an illustration showing the main part of a switch logic.

The channel switch logic 3043 has a counter IC 3043*b* and operates with two control lines for clock and reset, as shown in FIG. 38. Specifically, each time a transmission line switch pulse from a sequence controller 3047 described later is input, the connection state of the analog multiplexer 3044 is switched in sequence so as to connect to the specified transmission line.

Figure 35:
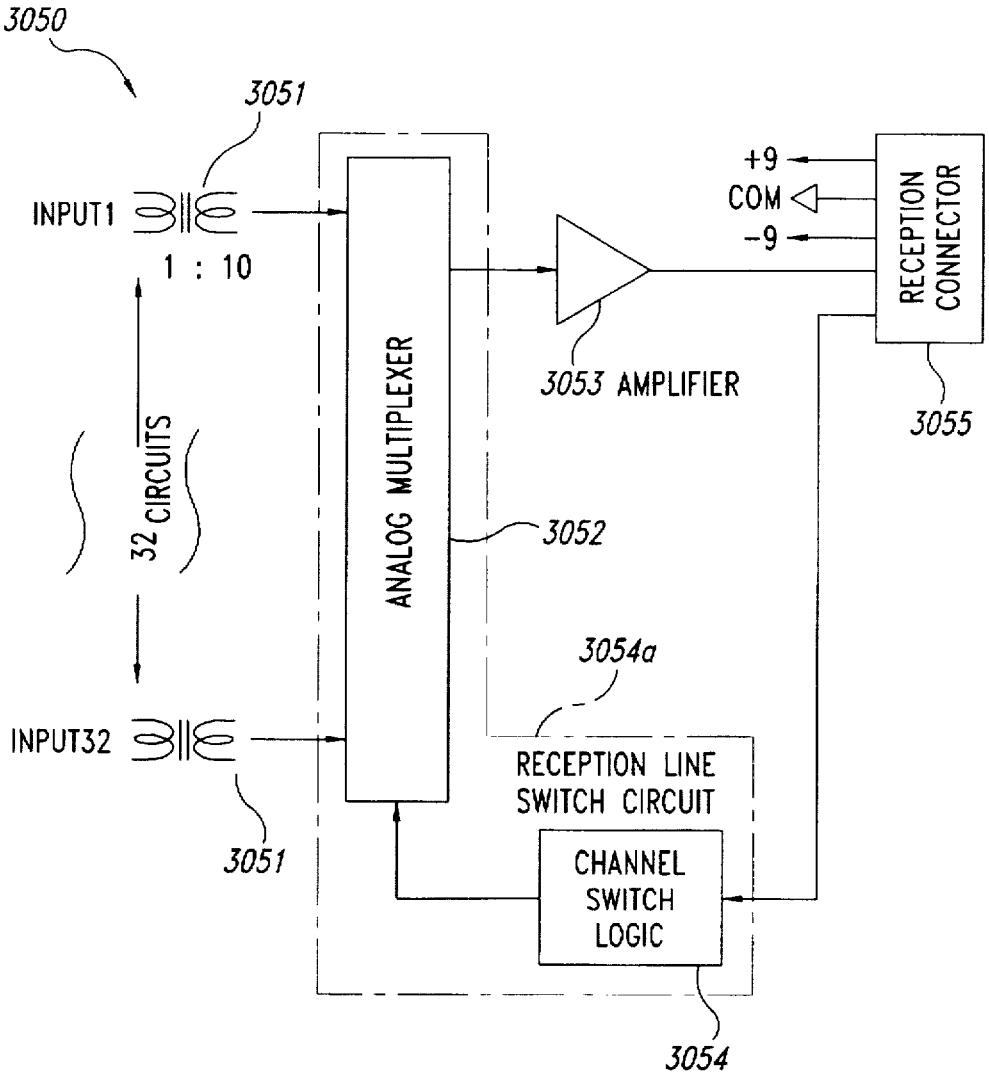
FIG. 35 is a block diagram of an example of a reception circuit.

As shown in FIG. 35, the reception circuit 3050 consists of 32 CTs (current transformers) 3051 connected to the 32 reception lines 3026 via the reception connector 3067*b*, a reception line switch circuit 3054*a* being connected to the CTs 3051 for switching the reception line to be detected in sequence each time a reception line switch pulse is input, an amplifier 3053 connected to the reception line switch circuit 3054*a*, and a reception connector 3055 connected to the amplifier 3053 and the reception line switch circuit 3054*a*. The reception line switch circuit 3054*a* has an analog multiplexer 3052 and a channel switch logic 3054 connected to the analog multiplexer 3052. Therefore, the reception circuit 3050 is adapted to receive a signal from each reception line 3026 via each CT 3051.

The CT 3051 insulates its corresponding reception line from the analog multiplexer 3052 and magnifies a signal from the corresponding reception line by 10 times. The analog multiplexer 3052 receives signals in sequence from the specified CTs 3051 based on a command of the channel switch logic 3054. The amplifier 3053 amplifies a signal from the analog multiplexer 3052.

The channel switch logic 3054 has similar elements to those of the channel switch logic 3043 of the transmission circuit 3040. Each time a reception line switch pulse signal is input from the sequence controller 3047 (every scanning period), the input switch state of the analog multiplexer 3052 is changed on the falling edge of the pulse signal.

Figure 37:
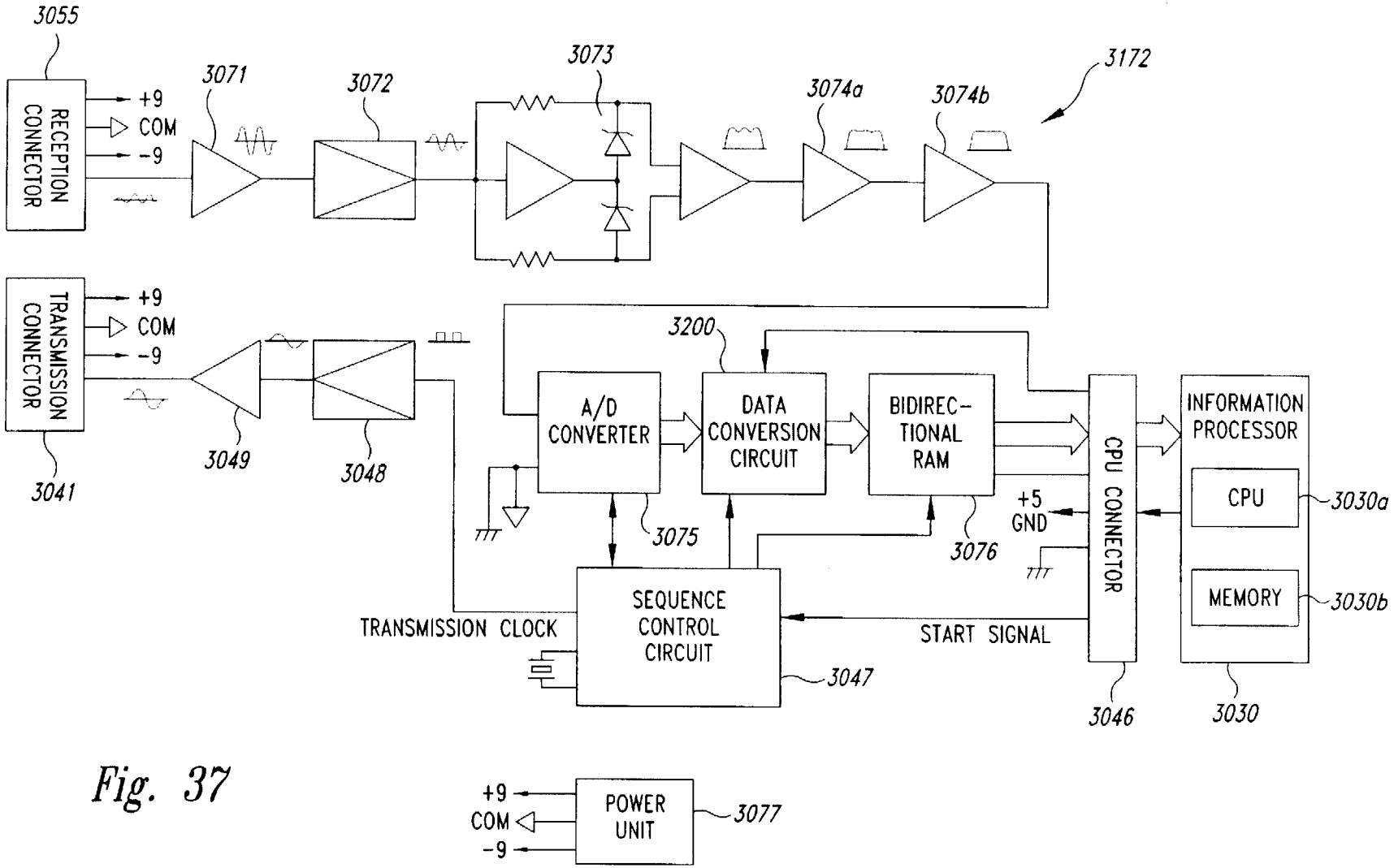
FIG. 37 is a block diagram of an example of a control board.

As shown in FIG. 37, the control board 3172, which contains the information processor 3030, has a transmission section comprising a sequence controller 3047 for sending a transmission clock in response to a start signal input from the information processor 3030 via a CPU connector 3046, a bandpass filter for receiving the transmission clock and outputting a transmission signal, and an amplifier 3049 for amplifying the transmission signal and sending the amplified signal to the transmission connector 3041.

The control board 3172 has a reception section comprising an amplifier 3071 for amplifying a reception signal from the reception connector 3055, a band-pass filter 3072 for receiving the amplified signal, a full-wave rectification amplifier 3073 for receiving the reception signal through the band-pass filter 3072, two low-pass filters 3074*a* and 3074*b* for receiving the reception signal from the full-wave rectification amplifier 3073, an A/D converter 3075 for receiving the reception signal through the low-pass filter 3074*b*, converting the reception signal into digital data under the control of the sequence controller 3047, and outputting the digital data, a data conversion circuit 3200 for receiving the digital data as raw data X and converting the raw data X into response data Z representing the presence or absence of an electromagnetic characteristic change at each sensing position (presence or absence of a pachinko ball), and a bidirectional RAM 3076 for writing the response data Z under the control of the sequence controller 3047 and sending the response data Z via the CPU connector 3046 to the information processor 3030 in response to a read signal from the CPU connector 3046.

The amplifiers in the reception section have characteristics set so that even if the matrix sensor 3020 responds to a metal guide rail being disposed on the base board 200 for guiding propelled pachinko balls to the gaming area, an input signal caused by the response does not exceed the input voltage range of the A/D converter 3075.

The data conversion circuit 3200, which makes a calculation from the following expressions (1) and (2), comprises an arithmetic circuit capable of performing absolute value subtraction, data A and S, a memory for storing the calculation result, etc.:

$$Y=|X-X_0| \quad \text{Expression (1)}$$

$$Z=Y-S \quad \text{Expression (2)}$$

where $X_0$ denotes offset data, which is raw data X in the absence of a pachinko ball, S denotes slice data having a predetermined variation width value to remove a ripple of the raw data X, and Y denotes change data containing the ripple.

The bidirectional RAM 3076 stores the response data Z for each sensing unit 3020*a* under the control of the sequence controller 3047. That is, the response data Z output from the data conversion circuit 3200 is registered in an address of the bidirectional RAM 3076 specified by a signal from the sequence controller 3047. The bidirectional RAM 3076 has a capacity of 2048 bytes, for example.

The control board 3172 has a power unit 3077.

The information processor 3030 reads the response data Z in the bidirectional RAM 3076 and finds the pachinko ball position from the response data Z and the position of the sensing unit 3020*a* at the point in time.

Next, the operation of the pachinko ball detection system will be discussed.

Figure 39:
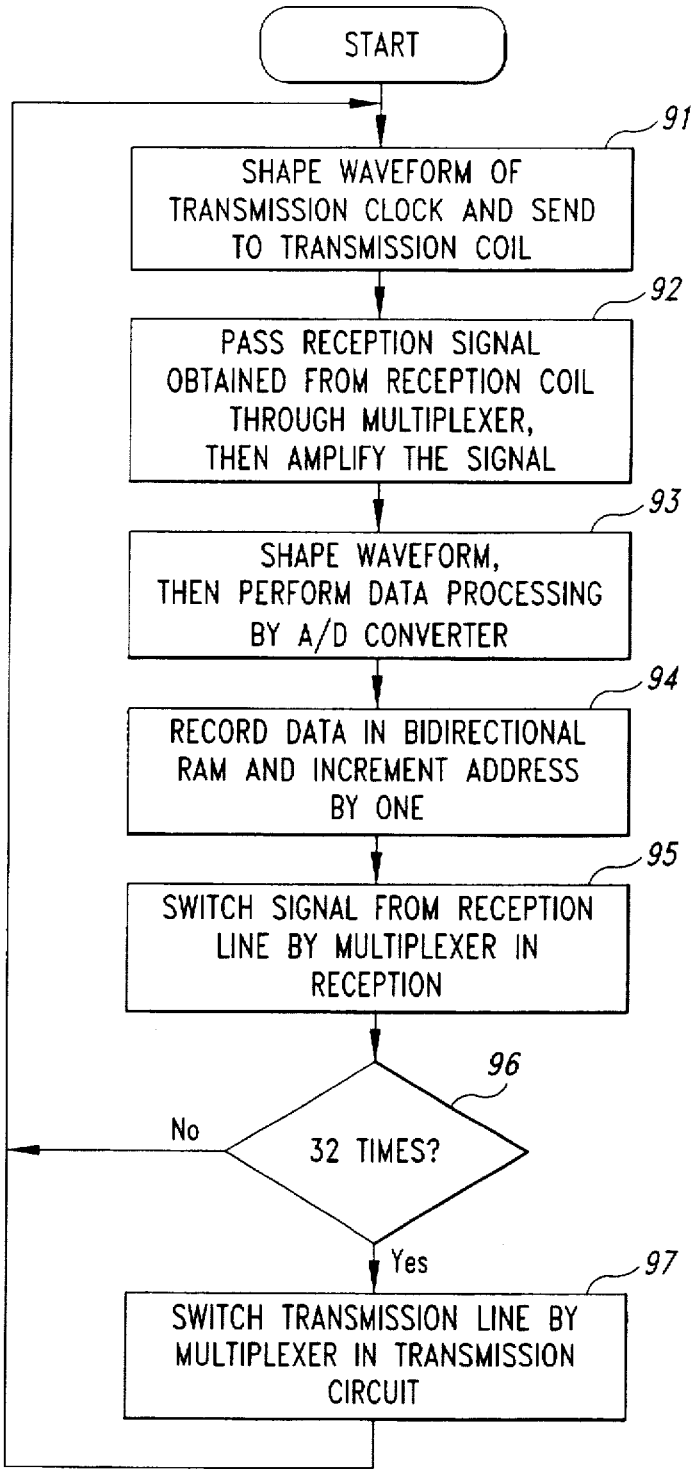
FIG. 39 is a flowchart showing an example of an operation flow of the pachinko ball detection system.

Address signals and control signals from the information processor 3030 are output via the CPU connector 3046. FIG. 39 shows a process flow.

First, adjustment of the system during pachinko ball detection will be described. Since various metal members such as obstacle pegs repelling pachinko balls and the guide rail are placed on the base board 200, the A/D converter 3075 is adjusted so that the presence of the metal members does not cause reception signals from the reception lines in the proximity of the metal members to become saturated values.

When a start signal is transmitted from the information processor 3030 to the sequence controller 3047, the sequence controller 3047 divides a 16-MHz basic clock in response to necessary clock frequency for generating and outputting a transmission clock. The waveform of the transmission clock from the sequence controller 3047 is shaped from digital signal into an analog signal through the band-pass filter 3048, then the analog signal is amplified by the amplifier 3049 and sent to the transmission connector 3041.

Further, the transmission signal is amplified by the amplifier 3042 in the transmission circuit 3040. The analog multiplexer 3044 operates the drivers 3045 in sequence on channels switched by the channel switch logic 3043, whereby the drivers 3045 output the signal amplified by the amplifier 3042 to the transmission lines 3022 in sequence at step 91.

Then, an electromagnetic induction effect causes an electromotive force to occur on the reception lines 3026 crossing the transmission line 3022 on which the signal is transmitted. At the time, as a pachinko ball which is metal approaches a sensing unit 3020*a*, the magnitude of the electromotive force (induced current) of the reception line 3026 changes in the sensing unit 3020*a*.

The reason why it changes is not analyzed clearly at present, but can be considered as follows: First, a pachinko ball, which made of a material consisting essentially of iron, is a ferromagnetic substance. Thus, a magnetic flux occurring on the transmission line 3022 and spread into a space converges on the pachinko ball and the magnetic flux distribution interlinking the reception lines changes. Second, an eddy current occurs on the pachinko ball in a direction canceling the magnetic flux on the transmission line 3022. These cause the induced current to change. Which cause is dominant varies depending on the relative positional relationship between the pachinko ball and the transmission line 3022 and reception line 3026. Whether or not the magnetic flux interlinking with the reception line 3026 increases also varies depending on the relative positional relationship with the pachinko ball. It also varies depending on whether or not metal exists on the background. In any case, it is only necessary to be able to detect the change.

In the reception section, the reception circuit 3050 receives a signal from each reception line 3026 via each CT 3051 in synchronization with the transmission circuit 3040 under the control of the sequence controller 3047. As shown in FIG. 35, voltage caused by induced current appearing on the reception lines 3026 is magnified by 10 times by the CT 3051. This eliminates the need for giving the amplifier in the reception circuit a large gain. The CTs 3051 insulate the reception lines 3026 of the matrix sensor 3020 from the analog multiplexer 3052 in the reception circuit 3050 for preventing noise from entering the reception circuit 3050 from the pachinko ball machine 2.

The analog multiplexer 3052 switches signals received from the reception lines 3026 through the CTs 3051 by the channel switch logic 3054 and outputs them in sequence. Each signal output from the analog multiplexer 3052 is amplified by 100 times by the amplifier 3053 at step 92.

The reception signal is amplified and detected via the reception connector 3055, the amplifier 3071, and the band-pass filter 3072. The reception signal passed through the band-pass filter 3072 results in an analog signal, which is then shaped by the full-wave rectification amplifier 3073. The output signal from the full-wave rectification amplifier 3073 is averaged by integration processing through the low-pass filters 3074*a* and 3074*b*.

Next, the reception signal is sent to the A/D converter 3075, which then converts the signal from the reception line 3026 into a digital signal in predetermined bit units, such as 12 bits, and outputs the resultant digital signal (sense data) to the bidirectional RAM 3076 for storage under the control of the sequence controller 3047 at step 93.

That is, the sense data is recorded in the bidirectional RAM 3076 in response to a write signal from the sequence controller 3047 independently of the operation of the information processor 3030, then the address is incremented by one every scanning period based on the clock signal output by the sequence controller 3047, for example, every clock at step 94, and the sense data is stored in a different address for each sensing unit 3020*a*.

These steps are repeated for every scanning period. That is, the analog multiplexer 3052 in the reception circuit 3050 switches the signal from each reception line 3026 every scanning period at step 95 and the above-mentioned operation is performed 32 times for the 32 reception lines 3026 (once for each line). Upon completion at step 96, the analog multiplexer 3044 in the transmission circuit 3040 switches the current transmission line 3022 at step 97. Again, similar processing is repeated 32 times for storing the sense data for each sensing unit 3020*a* in different addresses of the bidirectional RAM 3076 in sequence, in relation to the sensing units 3020*a*.

Therefore, the information processor 3030 can read the sense data stored in the bidirectional RAM 3076 for judging whether a pachinko ball exists, at what time and at what position (sensing unit 3020*a*) under any desired retrieval conditions, whenever necessary, independently of the above-mentioned detection signal processing.

We have discussed an example of the pachinko ball detection system, but the system may have any other configuration if it can detect the positions of pachinko balls moving in the gaming area of the pachinko machine 2. For example, a pachinko ball detection system described in U.S. Pat. No. 5,388,828(PCT/JP91/01353) may be used.

The pachinko remote gaming system of the embodiment enables the player to access a pachinko machine 2 in the pachinko hall 1 from a distant location such as his or her home, and further to play the pachinko machine 2 by remote operation from the distant location. This means that even a player at a distant location does not spend time or effort for moving to the pachinko hall. As a result, the player can concentrate on playing a game and enjoy playing the amusement game.

Further, according to the embodiment, the position of a pachinko ball moving on the pachinko machine 2 is directly detected and the detected position data is transmitted, thus decreasing the amount of data transferred via a communication line in game play progress, whereby the communication means can be relieved of its work load.

Further, since the player does not directly see the pachinko machine 2, the pachinko machine 2 need not be provided with illumination or a sound system, thus the manufacturing cost of the pachinko machine 2 can be reduced. In addition, a background display image displayed on the remote gaming terminal can be designed as desired and the pachinko ball positions can be superposed on the background display image.

We claim:

1. Gaming facilities comprising:

one or more gaming machines;

one or more gaming condition detection systems being provided in a one-to-one correspondence with said one or more gaming machines for detecting gaming progress conditions thereof;

a gaming control system being connected to said one or more gaming machines and said one or more gaming condition detection systems and comprising a control section for controlling operation of said gaming machines, a first transmission section for transmitting a signal to a communication line, and a first reception section for receiving a signal transmitted over the communication line; and one or more remote gaming terminals each comprising a second transmission section for transmitting a signal to a communication line, a second reception section for receiving a signal transmitted over the communication line, a display section for displaying the signal received by said second reception section, an operation section for accepting an external command, and a signal generation section for generating a signal based on the command accepted through the operation section, characterized in that said first transmission section transmits a signal indicating a gaming condition detected by any of said one or more gaming condition detection systems to one of said one or more remote gaming terminals via a communication line, that said second reception section receives the signal indicating the gaming condition transmitted via the communication line, that said display section displays an image indicating the gaming condition in said gaming machine based on the signal indicating the gaming condition received by said second reception section, that said operation section accepts an operation command for causing said gaming machine whose image indicating the gaming condition therein is displayed by said display section to operate, that said signal generation section generates a gaming signal, which is a signal indicating a command for causing said gaming machine to operate, based on the operation command accepted through said operation section, that said second transmission section transmits the gaming signal generated by said signal generation section to said gaming control system via the communication line, that said first reception section receives the gaming signal transmitted via the communication line from said remote gaming terminal, and that said control section controls said gaming machine for which said first transmission section transmits the signal indicating the gaming condition so that said gaming machine operates based on the gaming signal received by said first reception section.

2. The gaming facilities as claimed in claim 1 wherein one or more pachinko machines are provided as said gaming machines, wherein as said gaming condition detection systems, one or more shooting devices are provided in a one-to-one correspondence with said pachinko machines for shooting the corresponding gaming machines, wherein said gaming control system is provided with a pachinko control section being connected to said one or more pachinko machines and said one or more shooting devices for controlling the operation of said one or more pachinko machines as said control section, wherein one or more units of said remote gaming terminal are provided, wherein said first transmission section transmits a video signal of the pachinko machine shot by any of said one or more shooting devices to said remote gaming terminal via said communication line, wherein said second reception section receives the video signal of the pachinko machine transmitted via the communication line from said gaming control system, wherein said display section displays the video signal of the pachinko machine received by said second reception section, wherein said operation section accepts an operation command for causing the pachinko machine whose video signal is displayed by said display section to operate, and wherein said pachinko control section controls the pachinko machine for which said first transmission section transmits the video signal so that the pachinko machine operates based on the gaming signal received by said first reception section.

3. The gaming facilities as claimed in claim 2 wherein said pachinko control section is made up of one or more information processors connected to at least one pachinko machine and a shooting device corresponding thereto.

4. The gaming facilities as claimed in claim 2 wherein said operation section accepts a gaming start command to indicate starting a game play and a gaming end command to indicate quitting a game play, wherein said signal generation section generates a gaming start signal indicating a gaming start instruction based on the gaming start command accepted through said operation section and generates a gaming end signal indicating a gaming end instruction based on the gaming end command accepted through said operation section, wherein said second transmission section transmits the gaming start signal and the gaming end signal generated by said signal generation section to said gaming control system via the communication line, and wherein said first reception section receives the gaming start signal and the gaming end signal transmitted via the communication line from said remote gaming terminal.

5. The gaming facilities as claimed in claim 4 wherein said remote gaming terminal comprises a first line connection section for connecting said remote gaming terminal and said gaming control system by a communication line when said operation section accepts the gaming start command, and wherein said gaming control system comprises a second line connection section for disconnecting the communication line between said gaming control system and said remote gaming terminal when said first reception section receives the gaming end signal.

6. The gaming facilities as claimed in claim 4 wherein said gaming control system comprises a menu generation section for generating a data signal representing a menu for enabling a player of said remote gaming terminal to select a pachinko machine to be played from among said one or more pachinko machines when said first reception section receives the gaming start signal, wherein said first transmission section transmits the data signal generated by said menu generation section to said remote gaming terminal via the communication line, wherein said second reception section receives the data signal transmitted from said gaming control system via the communication line, wherein said display section displays the data signal received by said second reception section, wherein said operation section accepts a selection command of the pachinko machine to be played out of the menu represented by the data signal displayed by said display section, wherein said signal generation section generates a menu signal indicating the pachinko machine to be played based on the selection command accepted through said operation section, wherein said second transmission section transmits the menu signal generated by said signal generation section to said gaming control system via the communication line, wherein said first reception section receives the menu signal transmitted via the communication line from said remote gaming terminal, and wherein said first transmission section transmits a video signal of the pachinko machine indicated by the menu signal received by said first reception section.

7. The gaming facilities as claimed in claim 6 wherein said gaming control system comprises a first storage section for storing gaming machine identification information for identifying each pachinko machine and operation information indicating whether or not the pachinko machine is operating in relation to each other for each of said one or more pachinko machines, and wherein said menu generation section generates a data signal representing a list of gaming machine identification information of pachinko machines whose operation information stored in said first storage section indicates that the pachinko machines are not operating.

8. The gaming facilities as claimed in claim 2 wherein said operation section has a handle that can be turned laterally, wherein said signal generation section generates a gaming signal at a level responsive to a turn angle of said handle, and wherein each of said one or more pachinko machines comprises a propelling section for propelling a pachinko ball in strength responsive to the level of the gaming signal, one or more winning parts that a pachinko ball propelled by said propelling section can enter, a gaming condition change section operating so as to change to either of a big win condition of a predetermined gaming condition and a loss condition of any other gaming condition if a pachinko ball enters a special winning part of a predetermined one of said winning parts, a variable winning part changing to a win enable state in which a pachinko ball can enter said variable winning part if said gaming condition change section changes to the big win condition, a number-of-paid-balls count section for counting the number of pachinko balls to be paid out to the player of said remote gaming terminal based on the number of pachinko balls entering said winning parts containing said special winning part and said variable winning part, and a number-of-propelled-balls count section for counting the number of pachinko balls propelled by said propelling section.

9. The gaming facilities as claimed in claim 8 wherein said gaming condition change section starts displaying one or more types of symbols in each of one or more display positions so that the types of symbols displayed in the display positions change dynamically in sequence, after a lapse of a predetermined time, stops the dynamic change display of the symbols in the one or more display positions, and when the dynamic change display of the symbols in the one or more display positions is stopped, if a combination of the symbols displayed in the display positions matches a predetermined symbol combination, changes to the big win condition; otherwise, changes to the loss condition.

10. The gaming facilities as claimed in claim 8 wherein said gaming control system comprises a first calculation section for determining whether the player of the remote gaming terminal has finally won or lost pachinko balls based on a difference between the number of propelled balls calculated by said number of-propelled-balls count section and the number of paid balls calculated by said number-of-paid-balls count section, when determining that the player has finally won pachinko balls, for calculating the number of won pachinko balls and when determining that the player has finally lost pachinko balls, for calculating the number of lost pachinko balls, and a second calculation section for calculating a won amount of money related to the number of won balls if said first calculation section calculates the number of won balls or a lost amount of money related to the number of lost balls if said first calculation section calculates the number of lost balls.

11. The gaming facilities as claimed in claim 10 wherein said first transmission section comprises a message generation section for generating a data signal representing a message indicating the number of won balls if said first calculation section calculates the number of won balls and generating a data signal representing a message indicating the number of lost balls if said first calculation section calculates the number of lost balls, wherein said first transmission section transmits the data signal generated by said message generation section to said remote gaming terminal via the communication line, wherein said second reception section receives the data signal transmitted via the communication line from said gaming control system, and wherein said display section displays the data signal received by said second reception section.

12. The gaming facilities as claimed in claim 11 wherein said gaming control system comprises a message generation section for generating a data signal representing a message to the effect that an owner of said gaming control system pays out a share related to the won amount of money to the player of said remote gaming terminal if said second calculation section calculates the won amount of money and generating a data signal representing a message to the effect that the player pays out a charge related to the lost amount of money to the owner if said second calculation section calculates the lost amount of money, wherein said first transmission section transmits the data signal generated by said message generation section to said remote gaming terminal via the communication line, wherein said second reception section receives the data signal transmitted via the communication line from said gaming control system, and wherein said display section displays the data signal received by said second reception section.

13. The gaming facilities as claimed in claim 12 wherein the share is a product or cash or securities equivalent thereto.

14. The gaming facilities as claimed in claim 10 wherein said gaming control system comprises a second storage section for storing user information containing the user name and user financial institution account number for each user of said remote gaming terminal.

15. The gaming facilities as claimed in claim 14 wherein said gaming control system comprises a printout section for printing out storage contents of said second storage section.

16. The gaming facilities as claimed in claim 14 wherein said gaming control system comprises a third transmission section for transmitting storage contents of said second storage section to another information processor via the communication line or a leased line.

17. The gaming facilities as claimed in claim 10 wherein said gaming control system comprises a second storage section for storing user identification information for identifying each user and user information containing the user name and user financial institution account number in relation to each other for each user of said remote gaming terminal, wherein said signal generation section generates an identification signal indicating the user identification information of the user of said remote gaming terminal, wherein said second transmission section transmits the identification signal generated by said signal generation section to said gaming control system via the communication line, wherein said first reception section receives the identification signal transmitted via the communication line from said remote gaming terminal, and wherein said second storage section stores the won amount of money and the lost amount of money calculated by said second calculation section in relation to the user identification information indicated by the identification signal received by said first reception section.

18. The gaming facilities as claimed in claim 1 wherein said gaming machine comprises a gaming area into which a game play medium is loaded for a move, thereby executing a game play, wherein said gaming condition detection system detects a position of the game play medium moving in the gaming area, and wherein said first transmission section transmits data indicating the detected position of the game play medium as the gaming condition indicating signal.

19. The gaming facilities as claimed in claim 18 wherein said game play medium is a pachinko ball, wherein said gaming machine is a pachinko machine formed with a plurality of winning parts in the gaming area, wherein said control section senses whether or not a pachinko ball enters each of the winning parts, and wherein said first transmission section further transmits data indicating a pachinko ball entering one of the winning parts sensed as the gaming condition indicating signal.

20. The gaming facilities as claimed in claim 19 wherein said display section displays a symbol indicating a pachinko ball at a position on a display screen responsive to the pachinko ball position data contained in the signal received by said second reception section.

21. The gaming facilities as claimed in claim 20 wherein said remote gaming terminal has a storage section for storing the pachinko ball position data contained in the signal received by said second reception section only for a predetermined time and a path generation section for generating an image indicating a path of the pachinko ball formed for the predetermined time from the stored position data and displaying the path image on a display screen of said display section, and wherein said display section displays the symbol indicating the pachinko ball and the path in combination at a position on the display screen responsive to the pachinko ball position data contained in the signal received by said second reception section.

22. The gaming facilities as claimed in claim 20 wherein said display section generates an image indicating a plurality of winning parts placed in the gaming area of the pachinko machine as a background image when displaying the symbol indicating the pachinko ball.

23. The gaming facilities as claimed in claim 22 wherein said display section differently displays the winning parts that a pachinko ball has entered and those that no pachinko ball enters based on data concerning a pachinko data entering each winning part received by said second reception section when displaying the background image.

24. The gaming facilities as claimed in claim 19 wherein said remote gaming terminal has a storage section for storing the pachinko ball position data contained in the signal received by said second reception section only for a predetermined time and a path generation section for generating an image indicating a path of the pachinko ball formed for the predetermined time from the stored position data and displaying the path image on a display screen of said display section.

25. The gaming facilities as claimed in claim 18 wherein the game play medium used with said gaming machine is a metal substance, and wherein said gaming condition detection system comprises a sensor having a detection area spreading like a plane and a signal processing system for driving said sensor for detecting presence of a metal substance and a position thereof.

26. The gaming facilities as claimed in claim 25 wherein said sensor has a transmission line group consisting of parallel lines, a reception line group consisting of parallel lines, and a board for supporting them, the transmission line group and the reception line group crossing each other with intersections of the transmission and reception lines being arranged like a matrix on the board.

27. The gaming facilities as claimed in claim 26 wherein said signal processing system comprises:

a transmission circuit for scanning the transmission lines in sequence and sending a signal current to them;

a reception circuit for scanning the reception lines in sequence and reading their reception signals in sequence; and a signal processor for outputting control signals to said transmission and reception circuits for causing said circuits to scan the transmission lines and the reception lines respectively, determining whether or not a metal substance exists from the signal received at said reception circuit, and detecting a position at which the metal substance is sensed, based on information indicating a transmission line scanning position of said transmission circuit and information indicating a reception line scanning position of said reception circuit.

28. A gaming control system being connected to one or more pachinko machines and one or more shooting devices being provided in a one-to-one correspondence with the pachinko machines for shooting gaming conditions of the corresponding pachinko machines for controlling operation of said one or more pachinko machines, said gaming control system comprising:

a transmission section for transmitting, via a communication line, a video signal of the pachinko machine shot by any of said one or more shooting devices;

a reception section for receiving a gaming signal, which is a signal indicating a command for causing the gaming machine to operate, transmitted via a communication line; and a control section for controlling the pachinko machine corresponding to the video signal transmitted by said transmission section so that the pachinko machine operates based on the gaming signal received by said reception section.

29. A remote gaming terminal comprising:

a reception section for receiving a video signal of a pachinko machine transmitted via a communication line;

a display section for displaying a gaming condition based on the video signal received by said reception section;

an operation section for accepting an operation command for causing the pachinko machine whose gaming condition is displayed by said display section to operate;

a signal generation section for generating a signal indicating an instruction for causing said gaming machine to operate based on the operation command accepted through said operation section; and a transmission section for transmitting the gaming signal generated by said signal generation section to the communication line.

30. A gaming control system being connected to one or more pachinko machines and one or more pachinko ball detection systems being provided in a one-to-one correspondence with the pachinko machines for detecting a position of a pachinko ball moving in gaming areas of the corresponding pachinko machines for controlling the operation of said one or more pachinko machines, said gaming control system comprising:

a transmission section for transmitting, via a communication line, a signal indicating the position of a pachinko ball detected by any of said one or more pachinko ball detection systems a reception section for receiving a gaming signal, which is a signal indicating a command for causing the gaming machine to operate, transmitted via a communication line; and a control section for controlling the pachinko machine for which said transmission section transmits the signal indicating the pachinko ball position so that the pachinko machine operates based on the gaming signal received by said reception section.

31. A remote gaming terminal comprising:

a reception section for receiving a signal indicating a position of a pachinko ball moving in a gaming area of a pachinko machine transmitted via a communication line;

a display section for displaying a move state of the pachinko ball moving in the gaming area from the signal indicating the pachinko ball position received by said reception section;

an operation section for accepting an operation command for causing the pachinko machine corresponding to a move state of the pachinko ball displayed by said display section to operate;

a signal generation section for generating a signal indicating an instruction for causing said gaming machine to operate based on the operation command accepted through said operation section; and a transmission section for transmitting the gaming signal generated by said signal generation section to the communication line.

32. A remote operation method of a gaming machine in gaming facilities having one or more gaming machines, one or more gaming condition detection systems provided in a one-to-one correspondence with said one or more gaming machines for detecting gaming progress conditions of said gaming machines, a gaming control system for controlling operation of said one or more gaming machines, and one or more remote gaming terminals being connected to said gaming control system in a data communication enable state, said method comprising the steps of:

transmitting a signal indicating a gaming condition detected by the corresponding gaming condition detection system for one gaming machine selected from among said one or more gaming machines to one of said one or more remote gaming terminals;

at said remote terminal to which the signal is transmitted, displaying an image indicating the gaming condition based on the transmitted signal, accepting an operation command given to the gaming machine whose gaming condition is displayed, generating a gaming signal indicating an instruction for causing said gaming machine to operate based on the accepted operation command, and transmitting the gaming signal to said gaming control system; and in said gaming control system, controlling operation of said gaming machine for which the signal indicating the gaming condition is transmitted so that said gaming machine operates based on the transmitted gaming signal.

* * * * *